US005979334A

United States Patent [19]

Lund

[11] Patent Number: 5,979,334

[45] Date of Patent: Nov. 9, 1999

[54] SYSTEM FOR AUTOMATED TRANSPORT OF AUTOMOBILE PLATFORMS, PASSENGER CABINS AND OTHER LOADS

[75] Inventor: Van Metre Lund, Evanston, Ill.

[73] Assignee: Autran Corp., Evanston, Ill.

[21] Appl. No.: 08/945,919

[22] PCT Filed: Jun. 6, 1996

[86] PCT No.: PCT/US96/09390

§ 371 Date: Dec. 1, 1997

§ 102(e) Date: Dec. 1, 1997

[87] PCT Pub. No.: WO96/40545

PCT Pub. Date: Dec. 19, 1996

Related U.S. Application Data

[63] Continuation-in-part of application No. 08/475,750, Jun. 7, 1995, Pat. No. 5,598,783, application No. 08/477,182, Jun. 7, 1995, Pat. No. 5,590,603, and application No. 08/481,771, Jun. 7, 1995, Pat. No. 5,590,604.

[51] Int. Cl.[6] ..... B61J 3/00

[52] U.S. Cl. ..... 104/88.04; 104/88.03; 104/130.07; 104/139; 104/299; 104/300; 246/28 R; 246/182 R

[58] Field of Search ..... 104/88.03, 88.04, 104/31, 48, 124, 125, 130.07, 139, 298, 299, 300; 246/28 R, 63 R, 182 R

[56] References Cited

U.S. PATENT DOCUMENTS

| | | | |
|---|---|---|---|
| 3,368,496 | 2/1968 | Falk et al. | 104/88.04 |
| 4,991,516 | 2/1991 | Rixen et al. | 104/130 |
| 5,775,227 | 7/1998 | Mullen | 104/88.04 |

*Primary Examiner*—Robert J. Oberleitner
*Assistant Examiner*—Robert J. McCarry, Jr.

[57] ABSTRACT

A system is provided that uses small carrier vehicles that operate along electrified guide ways and use standardized connections to automatically carry passenger cabins, freight loads and automobile platforms to desired destinations. The connections are made to upper ends of posts that extend from front and rear portions of each carrier vehicle and up through a narrow centrally located slot in the guide way. The guide way provides a protected environment for error-free data transmissions made through closely spaced inductive couplings between monitoring and control circuits along the guide way and control circuits of the carrier vehicles. Control circuitry is provided to obtain highly reliable control of vehicle speed and of starting, stopping and merge operations. Automobiles are securely held on platforms which are so handled as to permit rapid loading and unloading operations.

80 Claims, 42 Drawing Sheets

75
130
169
166
170
130A
75A
98
167
140
140A
87A
98A
87
83
83A
85A
164
165

202
86A
85A
87A
212
211
177
196
195
186
179
190
199
214
213
181
175
185
207
210
208
189
74
72
95
202
10
95A
72A
87
203
205
184
188
189
185
206
204
87A
179
181
74
10

220
222
224
223
226
227
228
229
230
232
233
234
236
14
14

238
237
227B
228B
227
228
224
223
222
240
239
238A
237A
228A
227A
228
227
226

248
247
224
223
222
252
251
246
245
244
243
242
241
254
250
249
253

81
82
441
442
443
444
448
449
445
446
450
451
452
453
454
456
457
458
460
461
462
464
466
467
468
51
52
SIGNAL TRANSMITTING & RECEIVING CIRCUIT
SIGNAL TRANSMITTING & RECEIVING CIRCUIT
CARRIER VEHICLE CIRCUIT UNIT
SIGNAL PROCESSING CIRCUIT
TRANSCEIVERS
TRANSCEIVERS 624A
624B
624D
624C
34
33
34R
33R
624
623
628
WEIGHING CIRCUIT
598

624A
624B
624D
624C
34
33
34R
33R
624
623
628
WEIGHING CIRCUIT
598

624A
624B
624D
624C
34
33
34R
33R
624
623
628
WEIGHING CIRCUIT
598

57B
57A
57C
750
751
752
754
756
757
758
760
691
781
782
52
760A
760B
761
762
763
763A
63
764
765
766
768
769
770
771
772
773
774
775
776
777
778
780
783

SYSTEM FOR AUTOMATED TRANSPORT OF AUTOMOBILE PLATFORMS, PASSENGER CABINS AND OTHER LOADS

CROSS REFERENCE TO RELATED APPLICATIONS

The priority of the following prior copending national applications is claimed, this application being a continuation-in-part thereof:

1) Application in the USA of Van Metre Lund entitled "INTEGRATED TRANSPORTATION SYSTEM INCLUDING TRANSFER VEHICLES", U.S. Ser. No. 08/475,750, filed Jun. 7, 1995 now U.S. Pat. No. 5,598,783;
2) Application in the USA of Van Metre Lund entitled "TRANSPORTATION SYSTEM INCLUDING ELEVATED GUIDEWAY", U.S. Ser. No. 08/477,182, filed Jun. 7, 1995 now U.S. Pat. No. 5,590,603; and
3) Application in the USA of Van Metre Lund entitled "TRANSPORTATION SYSTEM WITH HIGH SPEED VEHICLES AND AUTOMATIC CONTROL, U.S. Ser. No. 08/481,771, filed Jun. 7, 1995 now U.S. Pat. No. 5,590,604.

The disclosures of said prior applications are incorporated herein by reference.

BACKGROUND OF THE INVENTION

1. Field of the Invention

This invention relates to a transportation system and more particularly to a system usable for transportation of people as well as automobiles and other freight loads with very high safety, efficiency, speed and convenience, with capital costs and fuel, labor and other operating costs being minimized and with minimal adverse environmental effects. The system is compatible with existing systems and is readily integrated therewith.

2. Background of the Prior Art

Conventional rail systems have become increasingly costly to construct, maintain and operate with the result that their use for transport of freight and for interurban passenger travel has been supplanted to a large degree by use of trucks and automobiles. For public transportation in cities, rail-supported street cars have been replaced by buses which have been used less and less as a result of the increased use of automobiles for personal travel. The resulting truck and automobile traffic over streets and highways is a problem of increasing magnitude.

Systems known as "Intelligent Vehicle Highway Systems" are now being proposed for reducing certain problems associated with automobiles and are receiving considerable attention, but it appears that they may be very expensive and the degree to which such systems will be successful is open to question. Systems have been also been used or proposed using automatically operated and driver-less vehicles supported on elevated "monorail" guideways, but such systems have generally been limited to use on a small scale in special applications and have not enjoyed widespread success.

SUMMARY OF THE INVENTION

This invention was evolved with the general object of overcoming disadvantages of prior transportation systems and of providing a practical system for general use in transportation of people and freight in urban and interurban use.

Another object of the invention is to provide a transportation system which is compatible with existing transportation systems.

A further object of the invention is to provide a transportation system which makes practical use of existing technology and which is so constructed as to allow for expansion and for the use of improvements which may reasonably be expected in the future from advancing technology.

Important aspects of the invention relate to the recognition and discovery of problems with systems and proposed systems of the prior art and to an analysis of what is necessary to overcome such problems and otherwise provide an improved transportation system. Major problems with street-highway systems arise from roadways which are difficult and expensive to maintain and from the deaths and injuries and property losses from collisions of automobiles.

Rail systems, with steel wheels rolling on steel tracks, reduce the energy losses of automobiles and some of the noise generation associated therewith, but they have used very heavy locomotives pulling trains of heavy cars, making bridges and elevated supports very expensive and thereby requiring that tracks be supported from the earth through most of their length. Derailments have not been uncommon and there have been many fatalities from collisions with automobiles and trucks at crossings.

High speed trains and so called "light rail" systems which have been used or proposed for carrying passengers have been patterned after conventional rail systems and have had relatively heavy and expensive constructions. For handling of freight, longer and longer trains have been used to more efficiently utilize operating personnel, but increased costs have resulted from the need to load, move and assemble a large number of cars of a long train before departure and to disassemble, move and unload the cars upon arrival at a destination.

Personal transportation systems have also been proposed, using small vehicles carrying a single person and automatically controlled to move from one stop to another along an elevated guideway in an urban setting, but such systems have not been as practical and economically attractive as would be desirable and have not enjoyed substantial success.

A system constructed in accordance with the invention has similarities to proposed personal transportation systems in that it uses vehicles of small load capacity moving on an elevated guideway under automatic control, but differs from prior known systems with respect to being directed to interurban as well as urban transportation and with respect to handling of freight as well as passengers and particularly with respect to moving of single automobiles from one point to another.

The system of this invention uses small carrier vehicles that automatically carry loads of various types from one station to another along an electrified guideway. One type of load is a platform on which an automobile can be securely held. Others include a cabin that may be a six or eight passenger cabin, cabins in the form of small mobile homes or offices and containers for various types of freight.

Any one of such loads may be releasably locked through standardized connections to upper ends of posts that extend from front and rear portions of each carrier vehicle and up through a narrow centrally located slot in the guideway. The guideway provides a protected environment for error-free data transmissions made through closely spaced inductive couplings between monitoring and control circuits along the guideway and control circuits of the carrier vehicles. A highly reliable control of vehicle speed and of starting, stopping and merge operations is obtained.

The vehicles preferably have steel wheels guided on steel tracks within the guideways to move quietly in accurately defined and very smooth paths. Any sound that is developed is absorbed by materials within the guideway. A turn control system allows a vehicle to go at a low speed around a guideway turn of short radius, e.g. twenty feet, while it can also go at a high speed when either continuing on one guideway or gradually branching off to another guideway.

The load to be carried by the carrier vehicles and any platform carried thereby is preferably limited to a value of on the order of 5000 pounds which not only minimizes costs associated with such vehicles but also helps minimize right of way costs and costs of construction of the guideways.

The guideways include straight and curved sections that may span forty foot distances and that can be accurately prefabricated after first making a survey to determine an optimum path and the position of supporting columns. After installing footings and erecting the columns, ends of the sections are then connected and are so supported on the columns as to permit easy adjustment as may be necessary from time to time to compensate for movements in the underlying earth and to maintain a very smooth path for vehicle travel.

With the system, users will find it to be easier, faster, safer, more pleasant and less costly for them to go when they want to go and where they want to go. They may go most of the way in their own automobile while it is carried on a platform, or they have the option of going in a passenger cabin, either by themselves or with others. Freight, too, will be more efficiently handled and move at less cost and faster. The system also provides a quieter environment, much less waste of valuable natural resources and much less air pollution.

With the system, electrified guideways rather than polluting engines are used to move people through major portions of their journeys, either in passenger cabins or in their own automobiles. The system makes electric automobiles very practical, even with batteries of limited capacity. Batteries will need to be discharged only while getting to and from stations or making other short trips. For long trips, electric automobiles can be carried on the electrified guideways and batteries can be charged during transit.

The system is designed to be available for use in travel by automobile at any time of the day or night. A conventional street or highway is used to get to the nearest station of the system and the user then drives through an entrance driveway to come to a stop at a gate, whereupon a previously issued signalling devices may be used to identify a desired destination. Then the gate will open and the user will see and hear requests to move ahead until the front bumper of his or her automobile touches a stop wall, followed by requests to place the transmission in "park" and to apply the parking brake. Apparatus then operates to securely fasten the automobile on an underlying platform, using wheel chocks, end flaps and a surrounding cage structure.

The automobile is then moved sideways a short distance to be above a carrier vehicle in a branch line guideway. The carrier vehicle is then securely locked to the underside of the platform to thereafter gradually accelerate on the branch line guideway and enter a main line guideway at a high speed without colliding with other vehicles moving on the main line guideway, using a merge feature of an automatic control system. The ride will be quiet, without the sounds from the normal roar of the engine. However, the engine may be started and allowed to quietly idle, to allow use of the heater or air conditioner of the car. The idling engine will not overheat, being cooled by air moving through its radiator.

If an electric automobile is carried, electricity will be supplied from the electrified guideway for various purposes including charging of batteries, lighting, and operation of heat pumps for heating or cooling.

An important specific feature of the invention relates to connection means that may be standardized to be operable to releasably connect automobile carrying platforms, passenger cabins, freight containers or other loads to any carrier vehicle of the system, so that any carrier vehicle may be used to carry a type of load that is in demand when another type is not and so that the carrier vehicles can be used efficiently. The connection means are also usable in supplying electricity from the electrified guideways to passenger cabins or other loads that are carried.

Many additional features relate to the construction of guideways and carrier vehicles, to provision of control systems which achieve a high degree of safely and reliability while being economically manufacturable.

Still further features relate to the construction of automobile platforms and to associated handling apparatus to permit rapid entrance and exit of automobiles and to obtain efficient use of carrier vehicles and platforms.

This invention contemplates many other objects, features and advantages which will become more fully apparent from the following detailed description taken in conjunction with the accompanying drawings.

DESCRIPTION OF PREFERRED EMBODIMENTS

Figure 1:
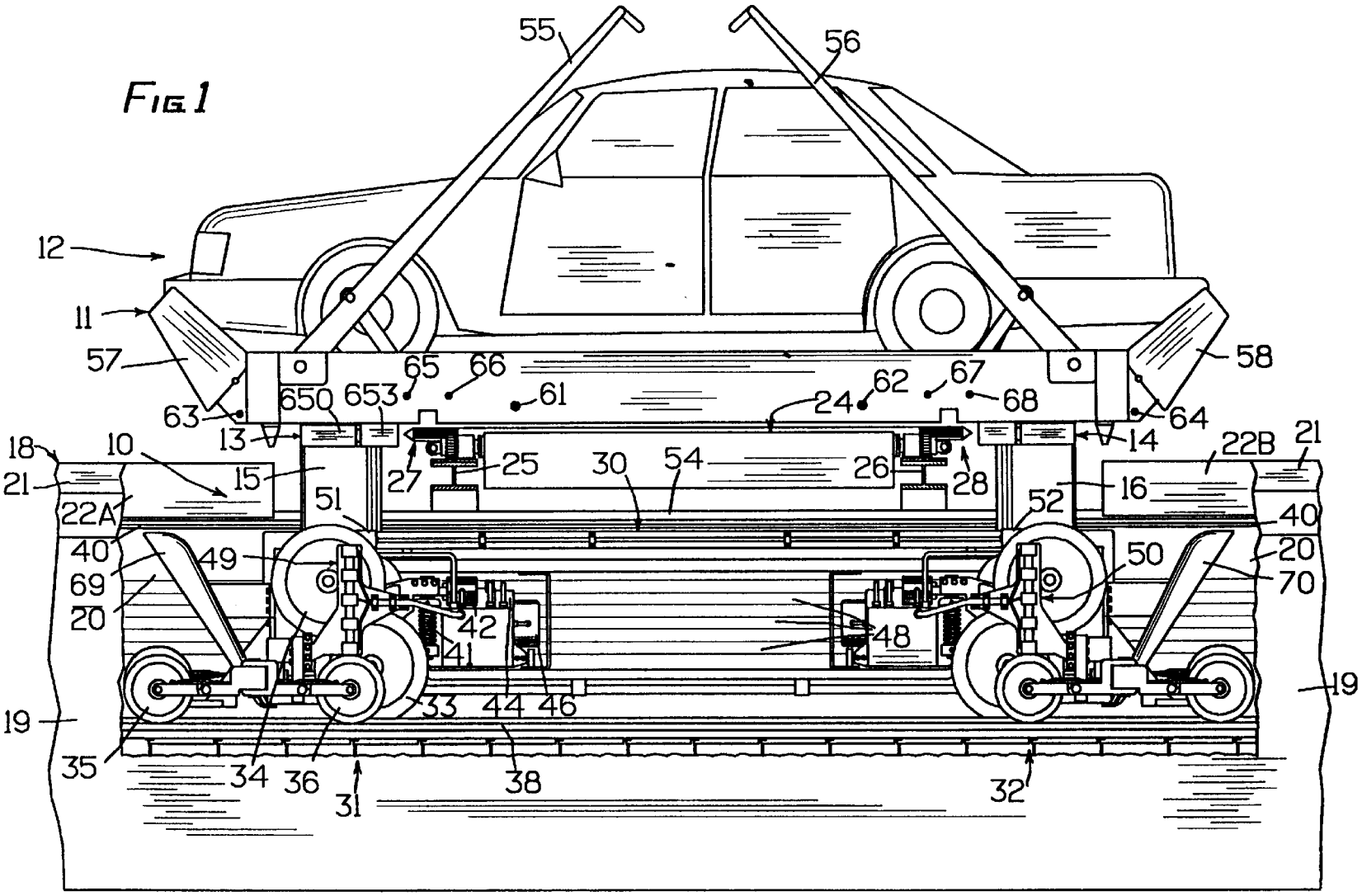
FIG. 1 is a side elevational view showing an automobile on a platform supported by a carrier vehicle in a transfer section of a guideway, portions of the guideway being shown broken away.

FIG. 1 provides a side elevational view of a carrier vehicle 10 positioned in a transfer section of a guideway. The carrier vehicle 10 is one of a number of such vehicles used in the system of this invention to automatically carry loads of various types along electrified guideways from one station to another.

The vehicle 10 is shown in FIG. 1 supporting one type of load which is a platform 11 on which an automobile 12 is securely held. Other types of loads include cabins that may carry six or eight passengers, cabins in the form of small mobile homes or offices and containers adapted to carry freight. Any one of such loads may be releasably locked through standardized connections 13 and 14 to the upper ends of posts 15 and 16 that extend upwardly from front and rear portions of the carrier vehicle 10.

As shown, the carrier vehicle 10 is movable in a guideway 18 that includes a pair of top walls extending inwardly from the upper ends of side walls and to ends that are spaced apart to provide an upwardly open slot through which the posts 15 and 16 extend. In FIG. 1, portions of one side wall 19 are shown broken away to provide a side elevational view of the carrier vehicle 10 and to show portions of an opposite side wall 20.

Portions of one top wall 21 are shown broken away to show portions 22A and 22B of an opposite top wall 22 which are spaced longitudinally to provide space for a transfer vehicle 24 in the illustrated transfer section of the guideway 18. The transfer vehicle 24 is movable transversely on beam structures 25 and 26 between a position at one side of the guideway and a position as shown in which it is over an intermediate portion of the transfer vehicle 10 and under the platform 11. In moving to the position as shown, the transfer vehicle 24 moves across gaps that are provided in the beam structures 25 and 25 and that are aligned with the slot provided between the top walls 21 and 22, so as to permit movement of the carrier vehicle into and through the transfer section when the transfer vehicle 24 is out of the way.

To transfer the platform 11 from the carrier vehicle 10, the transfer vehicle 24 is moved transversely from a position to one side of the guideway and to the position shown, after the carrier vehicle 10 has first been moved to the position shown. Forward and rearward prong structures 27 and 28 of the transfer vehicle 24 are then moved forwardly and rearwardly to engage support portions of the platform 11 and to simultaneously effect a release of the connections 13 and 14 between the platform 11 and the posts 15 and 16 of the carrier vehicle 10. The vehicle 24 then lifts the platform 11 and moves it transversely to a position at which the automobile 12 may be driven off the platform 11.

To connect the platform 11 or any other type of load to the carrier vehicle, the load is carried by the prong structures 27 and 28 of the transfer vehicle 24 to be positioned over the carrier vehicle 10, the prong structures 27 and 28 being then lowered and withdrawn to leave the connections 13 and 14 in locked positions in a manner as shown and described in detail hereinafter.

The posts 15 and 16 of the carrier vehicle 10 are supported on the forward and rearward ends of a frame structure generally designated by reference numeral 30 which is resiliently supported on a base frame that as hereinafter described is so supported from the forward and rearward bogies 31 and 32 as to permit movement of the bogies about vertical steering axes in approximate alignment with the posts 15 and 16. The illustrated bogies 31 and 32 are of substantially identical construction, and except as may be noted hereinafter, showings and descriptions of the construction of either bogie apply as well to the other.

On the left side thereof that is visible in FIG. 1, the forward bogie 31 includes lower and upper traction wheels 33 and 34, a grooved turn control wheel 35 and a position control wheel 36, similar wheels being provided on the opposite right side of the bogie. A lower left track 38 of the guideway supports the lower traction wheel 33 and has an upstanding flange or rib on its outer side that is engaged in the groove of the turn control wheel 35 and that is positioned between the lower traction wheel 33 and the position control wheel 36.

The upper traction wheel 34 engages an upper left track that is supported from the side wall 19 shown broken away in FIG. 1 so that the upper left track is not visible in FIG. 1. A similar upper right track 40 is engaged by an upper wheel on the opposite right side of the bogie 31, parts of the upper right track 40 being visible in FIG. 1.

To control the direction of movement of the carrier vehicle through Y-junctions, the turn and position control wheels 35 and 36 on the left side of the vehicle 10 are both lowered to active positions while similar wheels on the opposite right side of the bogie 31 are elevated to inactive positions, or vice versa. As shown, the wheels 35 and 36 on the left side of the vehicle are in lowered active positions to cause the vehicle to follow the path on the left in going through a Y-junction. When wheels 35 and 36 are elevated to inactive positions and the corresponding wheels on the opposite right side of the vehicle 10 are lowered to active positions, the vehicle 10 is caused to follow the path on the right in going through a Y-junction.

The turn control wheel 35 and the corresponding wheel on the opposite side are so connected to the bogie 31 as to provide a steering system which produces accurate tracking such that the axes of the traction wheels 33 and 34 and the traction wheels on the opposite side are in approximate alignment with the axis of any turn being executed by the vehicle 10. The steering system allows a vehicle to go at a low speed around a guideway turn of short radius, e.g. twenty feet, while it can also go at a high speed around a guideway turn of a very large radius when either continuing on one guideway or gradually branching off to another guideway.

The position control wheel 36 and the corresponding wheel on the opposite side of the bogie 31 perform functions that are especially important when moving through Y-junctions, each being operative to cooperate with the associated traction wheel to insure against outward sidewise movement of the bogie 31 relative to the track structure. When the vehicle is not travelling through Y-junctions, sidewise movements are limited by engagement of traction wheels with ribs on the sides of the tracks.

As hereinafter described, solenoids are provided through which the positions of the turn and position control wheels on opposite sides of the vehicle may be controlled. The arrangement is passive in the sense that no switches need be operated along the guideway, the direction being controlled from the vehicle. However, signals may be sent to the vehicle to control the direction of travel and certain cams may be operated along the guideway to effect a mechanical control in a manner as hereinafter described.

Another important feature relates to traction control. The bogie 31 is supported through left and right bearing units that journal the lower and upper traction wheels 33 and 34 on the left side of the vehicle 10 and corresponding wheels on the right side of the vehicle. Such bearing units are pivotal relative to the bogie about a horizontal axis midway between the axes of the lower and upper traction wheels. A compression spring 41 on the left side of the vehicle 10 and a similar spring on the right side of the vehicle exert torques on the left and right bearing units in a clockwise direction as viewed in FIG. 1. As a result forces are applied to urge the upper traction wheels into engagement with the upper tracks while applying forces aiding gravitational forces in urging the lower traction wheels into engagement with the lower tracks. The force applied to spring 41 is controlled by an electric traction control motor 42, a similar motor being provided on the opposite right side of the bogie 31. Such traction control motors are controlled in accordance with the weight of a load being carried and may also be controlled to increase traction when required, or to decrease traction and the loading of bearings under appropriate conditions.

An eclectic drive motor 44 and an associated brake unit 46 are provided for driving and braking the traction wheels 33 and 34 and the corresponding wheels on the opposite side of the bogie 31. A gearing assembly is provided which couples the drive motor 44 and brake unit 46 to both upper and lower traction wheels while allowing pivotal movement of the bearing units for the traction wheels. The gearing assembly includes a differential gearing that allows the wheels on opposite sides to rotate at different speed when moving through guideway turns.

For supply of electrical power, electrical supply rails 48 are supported on the inner side of side wall 20 for engagement with shoes of two contact shoe assemblies the right side of the carrier vehicle that is not visible in FIG. 1 and similar supply rails on the inner side of side wall 19 are engaged by contact shoes of a contact shoe assembly 49 of the front bogie and by shoes of a similar contact shoe assembly 50 of the rear bogie 32.

In the illustrated construction each contact shoe assembly carries five contact shoes in vertically spaced relation for engagement with corresponding supply rails. Two of the five supply rails may be connected to one terminal of a DC power source, another two may be connected to the opposite terminal of the DC power source and the remaining one of the five conductors may be used for communication or control purposes. For a three wire single phase AC source having a neutral terminal and two main terminals, two of the supply rails may be connected one main terminal, another two connected to the other main terminal and the remaining rail may be connected to the neutral terminal. For a three phase Y-connected source, three main terminals and a neutral terminal may be connected to four of the five rails and the remaining rail may be used for communication or control purposes.

During movement through Y-junctions of the guideway, supply rails on both sides of the guideway cannot be simultaneously engaged by contact shoes, so that current is then supplied only through contact shoes on one side or the other of the carrier vehicle. However, the supply rails on both sides are otherwise engaged by contact shoes on both sides the carrier vehicle 10 so as to normally provide two paths for current flow to each bogie from supply rails of the guideway.

Electrical power may be supplied from the carrier vehicle 10 to loads supported on the posts 15 and 16 through junction boxes 51 and 52 located adjacent the lower ends of the posts 15 and 16 and through components included in the connections 13 and 14. For control of operation of the carrier vehicle 10, devices which may be supported by such junction boxes are inductively coupled to lengths of transmission lines in assemblies that are on the underside of the top walls 21 and 22 and that extend along the guideway, parts of one of such assemblies 54 being shown in FIG. 1. Such assemblies 54 are connected to a series of monitoring and control units along the guideway.

As the carrier vehicle 10 moves along the guideway, it transmits identification and speed data to the monitoring and control units that are connected to the transmission line assemblies 54 and it receives data that include instructions as to speed, acceleration or deceleration and the path to be followed along Y-junctions being approached by the vehicle. To a substantial extent, the vehicles operate autonomously in response to data that are received from the monitoring and control units along the guideway. However, communication links are provided between the monitoring and control units and a central unit, either directly or through sectional and/or regional control units, usable for various purposes including control of any vehicle from a sectional, regional or central control unit, as may be appropriate. The movements of all carrier vehicles and all loads carried thereby may be continually tracked at all times.

As also shown in FIG. 1, the platform 11 includes adjustable cage structures 55 and 56 that include side and top portions extending alongside and overlying the automobile 12. Platform 11 also includes wheel chocks, not visible in FIG. 1, and end flaps 57 and 58 which are pivoted upwardly to positions as shown, after the automobile 12 has been driven onto the platform 11. Flaps 57 and 58 cooperate with the wheel chocks to provide protection against longitudinal movement of the automobile and also function to minimize aerodynamic losses.

For control of the cage structures, wheel chocks and end flaps, rotatable control elements project from the side of the platform for engagement by elements of actuating mechanisms when the platform 11 is positioned at loading and unloading positions. Such control elements include elements 61 and 62 for operating the cage structures 55 and 56, elements 63 and 64 for operating the end flaps 57 and 58, a pair of elements 65 and 66 for operating a forward pair of wheel chocks and a pair of elements 67 and 68 for operating a rearward pair of wheel chocks.

Aerodynamic drag losses from the platform and automobiles carried thereby are also minimized as a result of the fact that the relatively narrow underlying guideway provides minimal interference with movements of air when compared with the interference presented by the broad planar horizontal surface of a roadway underlying a conventional automobile moving therealong. Substantial aerodynamic losses do result from movement of the carrier vehicle in the guideway. However, such losses are minimized by the provision of aerodynamic fairings 69 and 70 that are carried by the forward and rearward bogies 31 and 32 and by the construction of the guideway 18 in a manner such that in major portions thereof, a space of substantial cross-sectional area is provided in underlying relation to the path of travel of the vehicle 10.

Energy losses are further minimized by use of solid materials, preferably steel, for the wheels 33–36 and the tracks engaged thereby so as to minimize friction losses.

A maximum load limit, preferably on the order of 5000 pounds, is set for the carrier vehicles to allow most automobiles and other loads to be carried while minimizing the cost of construction and the weight thereof, and while also minimizing the cost of construction of guideways. Important features relate to the construction of the guideways which include straight and curved sections that may typically span forty foot distances and that can be accurately prefabricated after first making a survey to determine an optimum path and the position of supporting columns. After installing footings and erecting the columns, ends of the sections are then connected and are so supported on the columns as to permit easy adjustment as may be necessary from time to time to compensate for movements in the underlying earth and to maintain a very smooth path for vehicle travel.

With guideways constructed in accordance with the invention, the carrier vehicle moves quietly in an accurately defined and very smooth path. Any sound that is developed is absorbed by materials within the guideway. The guideways are also advantageous in other respects. They provide a substantial degree of protection for the track structures from the elements since precipitation can enter the guideway only through a relatively narrow slot. In addition, the guideway provides a protected environment for error-free data transmissions made through the closely spaced inductive couplings between monitoring and control circuits along the guideway and control circuits of the vehicles.

The system achieves a highly reliable control of vehicle speed and of starting, stopping and merge operations and permits safe movement of vehicles at relatively high speeds and with short following distances between each vehicle and the vehicle ahead. As a result, the guideways can handle a large volume of traffic. For example, a single guideway has the potential carrying a substantially greater number of automobiles per hour than a single lane of a conventional freeway or tollway. It is found that to take advantage of this potential, it is important that loading and unloading facilities be provided with which automobiles can be quickly and easily loaded onto and unloaded from platform and important features of the invention relate to automobile loading and unloading facilities.

Figure 2:
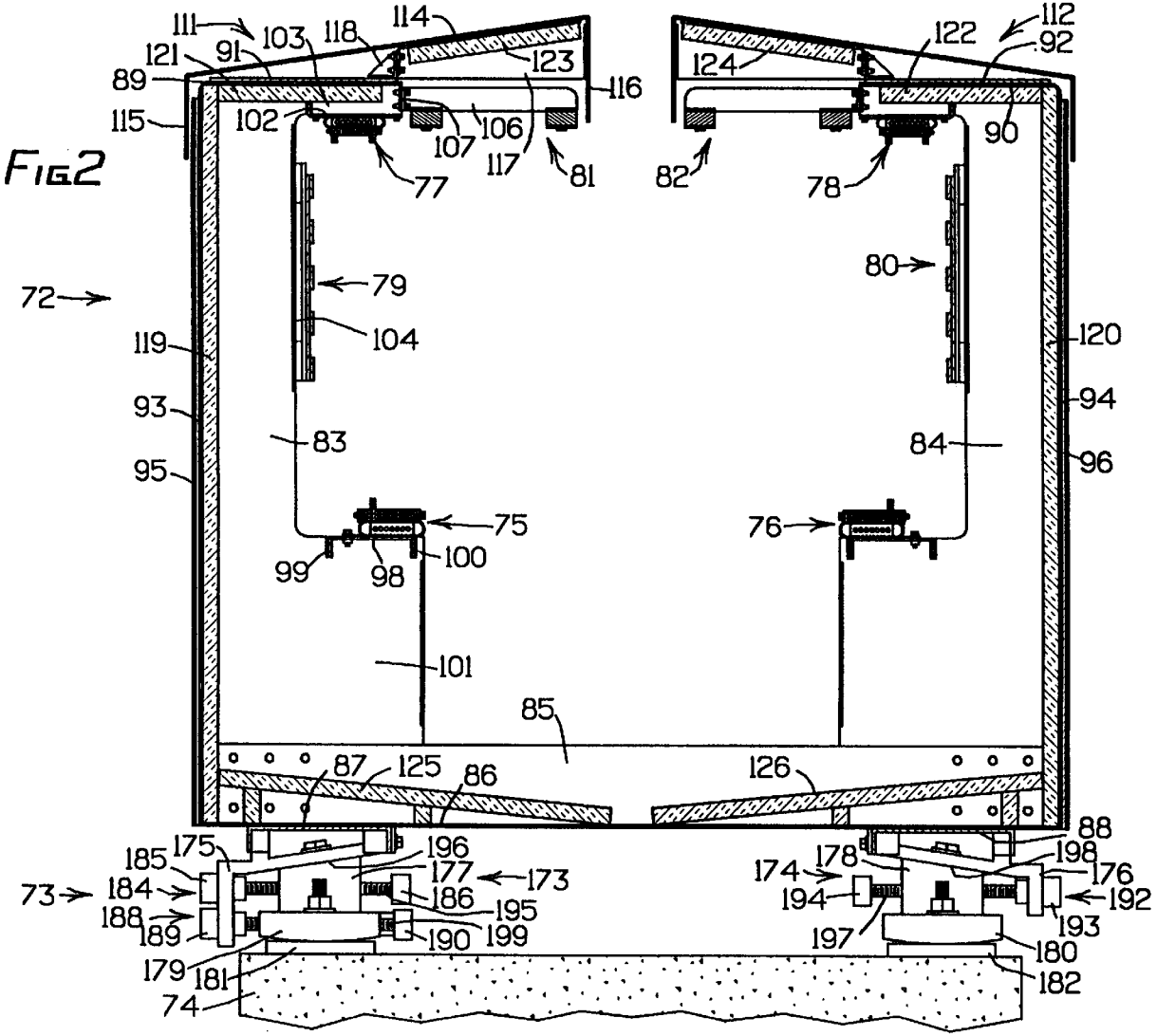
FIG. 2 is a sectional view of a guideway section constructed in accordance with the invention.

Construction of Guideway Sections (FIG. 2)

The guideway 18 is constructed in sections which are connected in end-to-end relation, the section shown in FIG. 1 being a transfer section as has been described. FIG. 2 is a cross-sectional view through a typical straight guideway section 72, looking forwardly with respect to the direction of travel of a carrier vehicle.

An adjustable support mechanism 73 is shown that supports one end of the section 72 and one end of an adjacent section from the upper end of a support column 74. The mechanism 73 allows such adjustment of the vertical position of each side and such sideways adjustments as may be required during installation or in response to shifts of movement of the support column 74 after installation.

The guideway section 72 includes left and right lower track structures 75 and 76 and left and right upper track structures 77 and 78 for engagement by left and right lower traction wheels and left and right upper traction wheels of the carrier vehicle 10. It also includes left and right electrical supply rail structures 79 and 80 and left and right transmission line assemblies 81 and 82.

A series of vertical support members are provided in spaced relation along the length of the guideway section 72, including left and right vertical support members 83 and 84 that have lower end portions riveted to ends of a cross member 85 to form an integral assembly. A flange 86 of cross member 85 is secured to left and right lower longitudinally extending frame members 87 and 88. Upper flanges 89 and 90 of the vertical support members 83 and 84 are secured to the undersides of left and right upper longitudinally extending members 91 and 92. Outer flanges 93 and 94 of the vertical support members 83 and 84 are secured to plates 95 and 96 that extend along the length of the section 72 and that form outer side walls thereof.

The left lower track structure 75 is supported by a horizontal portion 98 of the left support member 83 that has down-turned outer and inner flange portions 99 and 100 and that extends rearwardly from an upper end of an inwardly extending lower portion 101 of the left support member 83. The left upper track structure 77 is similarly supported by a horizontal portion 102 of the left support member 83 that extends rearwardly from a lower end of an inwardly extending upper portion 103 of the left support member 83.

The supply rail structure 79 is supported by a vertical flange 104 that extends rearwardly from the inner edge of an intermediate portion 105 of the vertical support member 83. The left transmission line assembly 81 includes a bracket 106 that is bolted or otherwise secured to a vertical flange 107 extending rearwardly from the inner end of the upper portion 103 of the left support member 83.

Left and right top structures 111 and 112 are provided. The left top structure 111 includes an inclined top wall 114, an outer apron 115 extending down from a lower end of the inclined top wall 113 on the outside of the upper end of the side wall 95 and an inner apron 116 extending down from an upper end of the inclined top wall and defining one side of a slot through which the posts 15 and 16 of the carrier vehicle 10 may move. The left top structure 111 also includes a series of longitudinally spaced brackets 117 secured to the underside of the top wall and to the inner apron, brackets 117 being secured to brackets 118 that are secured to the upper side of the upper frame member 91.

The support of the track structures 76 and 78, the supply rail structure 80 and the transmission line unit 82, as well as the construction of the top wall structure and other guideway components on the right side of the guideway section 72 are not described in detail being substantially the same as on the left side.

Sheets of an acoustic energy absorbing material are provided on the inside of the guideway section 72 to minimize the transmission of noise to regions outside the guideway section 72. A pair of sheets 119 and 120 are shown provided on the insides of the side walls 95 and 96 between the illustrated members 83 and 84 and the members spaced rearwardly therefrom, similar sheets being provided in spaces behind other similar members of the guideway section. Similarly, a pair of sheets 121 and 122 are provided on the undersides of the top frame members 91 and 92, a pair of sheets 123 and 124 are provided under the top wall structures 111 and 112 and a pair of sheets 125 and 126 are provided above the flange 86 of the cross member 85. Sheets 115 and 126 are inclined downwardly and inwardly to edges that are spaced apart a short distance, for drainage of any precipitation that may enter the guideway section through the upwardly open slot between the top wall structures 111 and 112.

Figure 3:
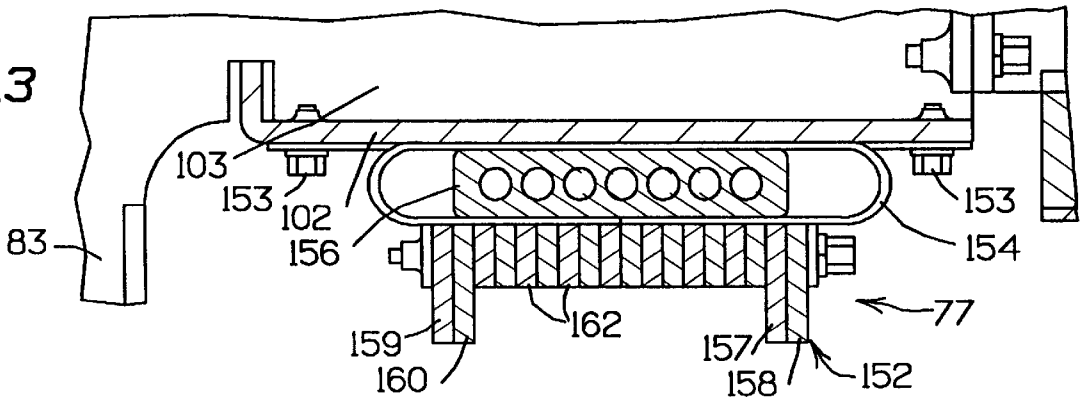
FIG. 3 is an enlarged cross-sectional view showing the construction of an upper track structure of the guideway shown in FIG. 2.
Figure 4:
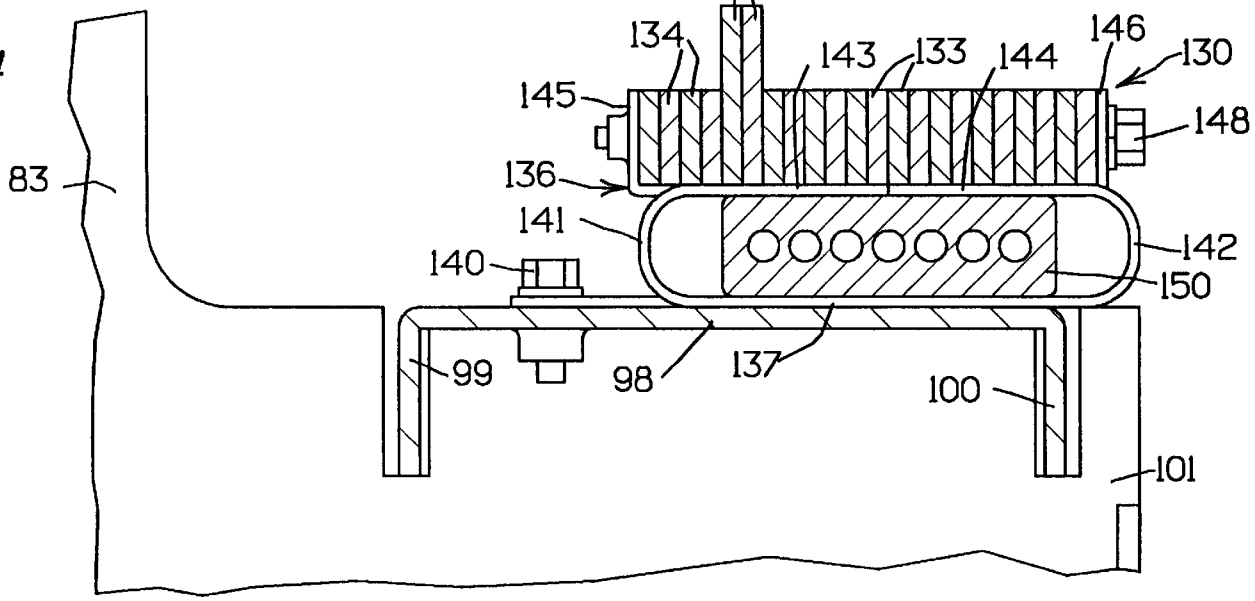
FIG. 4 is a view similar to FIG. 3 showing the construction of a lower track structure.

Track Support & Construction (FIGS. 3 & 4)

The support of the upper and lower track structures 77 and 75 is shown on an enlarged scale in FIGS. 3 and 4 which also show the construction and mounting of the track structures. As illustrated in FIG. 4, the lower track structure 75 includes a track 130 that is of laminated form and that includes a series of relatively thin elongated metal strips each of which has a width in a vertical direction that is substantially greater than its thickness in a transverse horizontal direction. Such strips include two strips 131 and 132 that form a upstanding rib portion of the track 130, sixteen strips 133 on the inside of strip 131 for engagement by lower traction wheels such as wheel 33 (FIG. 1) and four strips 134 on the outside of the strip 132 for engagement by position control wheels such as the wheel 36.

Mounting brackets 136 are provided along the length of the track structure 75. The illustrated bracket 136 includes a lower portion 137 disposed against the portion 98 of the member 83 and having a tab portion 138 secured to the member 83 by a bolt 140. Bracket 136 further includes portions 141 and 142 that extend upwardly to portions 143 and 144 that underlie the strips and that include flanges 145 and 146 extending upwardly to embrace the strips 131–134. Connectors 148 are provided that have shank portions extended through openings in the flanges 145 and 146 and in the strips to hold the strips 131–134 in assembly with the bracket 136. The illustrated connector 148 is in the form of a bolt but it will be understood that it may be in the form of a rivet. In either case, it is desirable that the openings in the strips be slightly elongated to allow relative longitudinal movement of the strips and to allow the track to be easily assembled and to extend in a curve without stressing individual strips.

As is also shown, a block 150 of a resilient energy absorbing material is disposed within the bracket 136, over the portion 137 and below the portions 143 and 144 to provide resilient support for the track 130. As hereinafter discussed, the resilient support provided by the blocks 50 is preferably varied along the length of guideway section as by varying the characteristics of the blocks or their spacing. To provide more resilient blocks, longitudinally extending holes in the block 150 may be provided as shown to increase the amount of deflection per unit of applied force, but solid blocks may be used in regions in which a stiffer support is indicated. The upwardly extending portions 141 and 142 of the bracket 136 have generally C-shaped configurations to allow vertical flexure thereof while minimizing horizontal flexure and thereby minimizing sidewise displacement of the track 130.

The left upper track structure 77 as shown in FIG. 3 has a construction similar to that of the lower track structure 75 shown in FIG. 4 and includes a track 152, a pair of bolts 153, a bracket 154 and a block 156, respectively corresponding to the track 130, bolt 140, bracket 136 and block 150 of the track structure 75. Vertical dimensions of the upper track structure 77 are less than corresponding dimensions of the lower track structure 75 because the applied loading is less. Another difference is that the track 152 of the upper track structure 77 has two ribs, an inner rib formed by one pair of strips 157 and 158 and an outer rib formed by another pair of strips 159 and 160. Strips 157–160 have vertical dimensions substantially greater than the vertical dimension of a plurality of strips 162 that are between strips 158 and 159 and that are engaged by upper traction wheels of a carrier vehicle.

Figure 5:
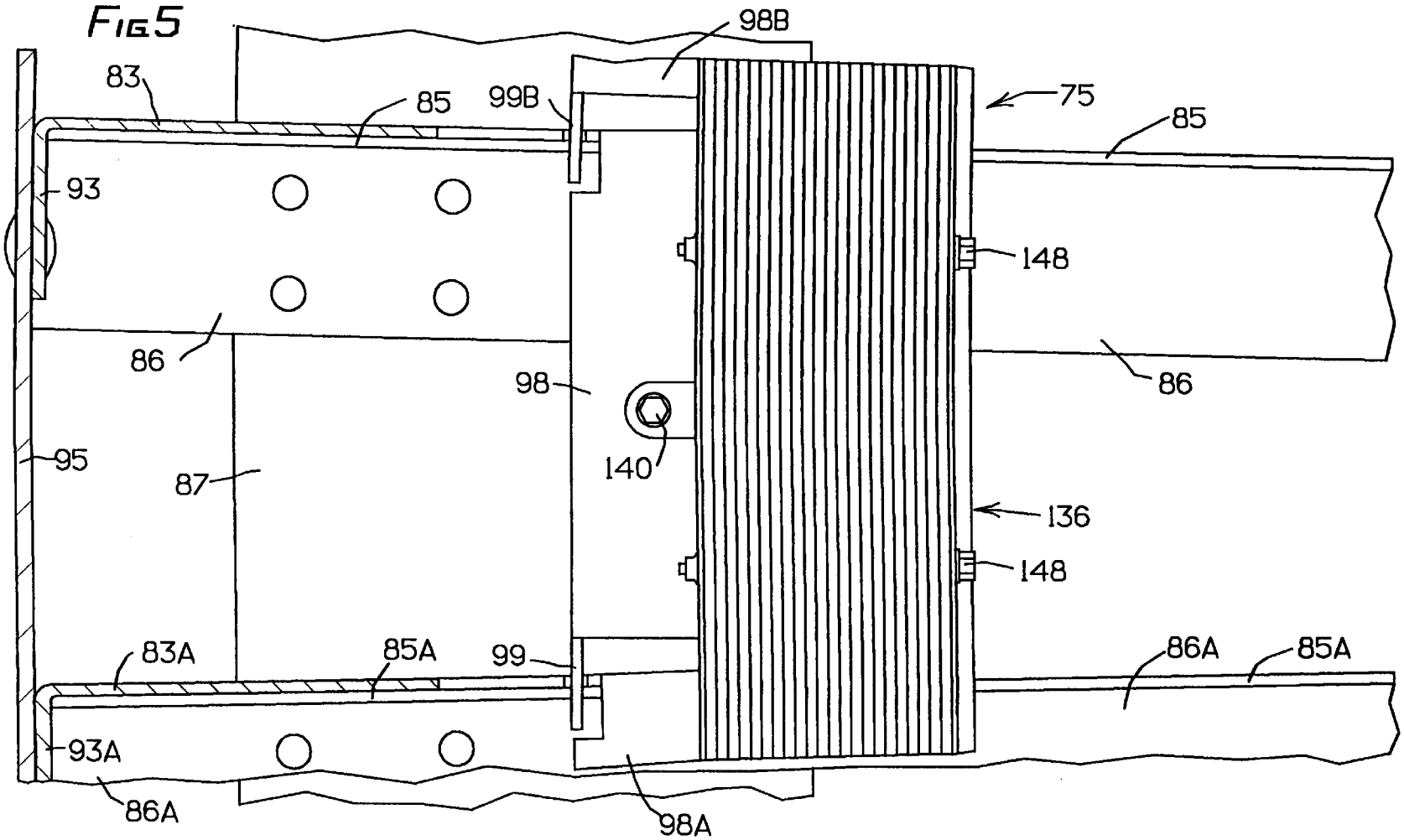
FIG. 5 is a sectional view looking downwardly at a portion of the lower track structure of FIG. 2.

Guideway Assembly (FIG. 5)

In prefabricating a guideway section, track support assemblies such as formed by members 83, 84 and 85 are secured at predetermined points of connection along the lower support members 87 and 88, the upper support members 91 and 92 and the side wall members 95 and 96. Such predetermined points of connection are such as to obtain predetermined axes and radii of curvature of the tracks in vertical and horizontal directions. For example, to obtain a straight section, the radii of curvatures are infinite and the longitudinal spacings of the points of connection of assemblies may preferably have a uniform value such as twelve inches. For a section in which the spacing of the side walls is eighty inches and in which there is a uniform turn to the right about a vertical axis spaced twenty feet from a point midway between the side walls 95 and 96, the longitudinal spacings of the points of connection to the left side wall 95 may be increased from a nominal value of twelve inches to a uniform value of fourteen inches and the longitudinal spacings of the points of connection to the right side wall 96 may be decreased from the nominal value of twelve inches to a uniform value of ten inches.

The radius of curvature need not be constant throughout the length of a section. For example, the positions of the aforementioned points of connection may be such as to obtain a radius of curvature that is graduated to gradually effect changes in centrifugal forces acting on carrier vehicles and loads carried thereby. In addition, exact positions of the aforementioned predetermined points of connection, especially those along the side wall members 95 and 96, should take into account static stresses of members of the guideway caused by gravitational forces acting thereon.

In the absence of a vehicle on a guideway section, the support of the track structures is such that in a static condition of the track and guideway structures, the track surfaces define a certain first path for vehicle movement, i.e. a path along which a weightless vehicle would move. The aforementioned connection points should preferably be such that the first path so defined is either a straight path or curved path of a certain character. If it is a curved path, the first path should be is such as to obtain a value which is zero or otherwise a constant as to any acceleration of a vehicle moving along the section that is attributable to a deviation of the curved path from a straight line.

When a vehicle moves along the guideway, the track structures will define a second path that is displaced from the first path as a function of the weight of the vehicle, its position along the guideway section and its velocity. In a guideway section constructed in accordance with the invention, the support provided by the resilient members is not uniform along the length of the section but is varied to produce a displacement of the second path from the first path that is as uniform as possible. In general, the deformation per unit force that is provided from by the resilient blocks and associated elements of the track structures should be greatest at the supported ends of a guideway section and should be least at a mid-point of a guideway section or at a point which may be offset forwardly from the mid-point in order to take into account any effect of the inertia of the guideway on deflections caused by a moving vehicle.

Preferably, each assembly of vertical support members and a cross member is of a standard construction with holes being provided at standard locations in the flange 86 of the cross member 85, in the flanges 93 and 89 of the support member 83 and in the flanges 94 and 90 of the support member 84, and holes are provided at specified locations in the lower support members 87 and 88, upper support members 91 and 92 and side wall members 93 and 94. The members are then riveted or otherwise secured together using such holes and, in addition, welding operations are performed for increased strength and rigidity. Painting or other finishing operations may then be performed.

In assembly, rearward end portions of the down-turned outer and inner flanges 99 and 100 of the portion 98 of member 83 are extended into slots in a portion of member behind member 83 that corresponds to portion 101 of member 83. The portion 98 is thereby supported from the member behind member 83 and the member 83 provides support for portion of a member ahead that corresponds to portion 101. This feature is illustrated in FIG. 5 which is a sectional view looking downwardly at a portion of the lower track structure 75, showing part of the portion 98 of the member 83. A rearward end portion of the outer flange 99 is shown extended through a slot in a portion 101A of the rearward member 83A and a rearward end portion of the inner flange 100, not shown in FIG. 5 is similarly extended through a slot in the portion 101A of the rearward member 83A. FIG. 5 also shows part of a portion 98A of a member 83A behind the member 83 and part of a portion 98B of a member ahead of the member 83.

FIG. 5 also shows other features of the assembly of a guideway section, particularly with regard to assembly of a turn section, the structure shown being that of a turn section of a guideway having a turn radius of twenty feet, measured from a point midway between left and right track structures to a vertical axis of a turn. FIG. 5 shows in section part of the member 83 and the flange 94 thereof and part of the member 83A behind member 83 and a flange 94A thereof. Also shown are parts of the cross member 85 and its flange 86 and parts of a cross member 85A behind member 85 and its flange 86A.

Prior to transport of a guideway section to an erection side, the rail structures 75–78 are preferably be assembled on and secured to the vertical support members 83 and 84 of the section, and an inspection is then made to determine that the rail structures are accurately positioned and to make such adjustments as may be indicated, as by adding shims, for example. However, the transmission line assemblies 81 and 82 and the top wall structures 111 and 112 may preferably be installed at the erection site.

Figures 6, 7, 8:
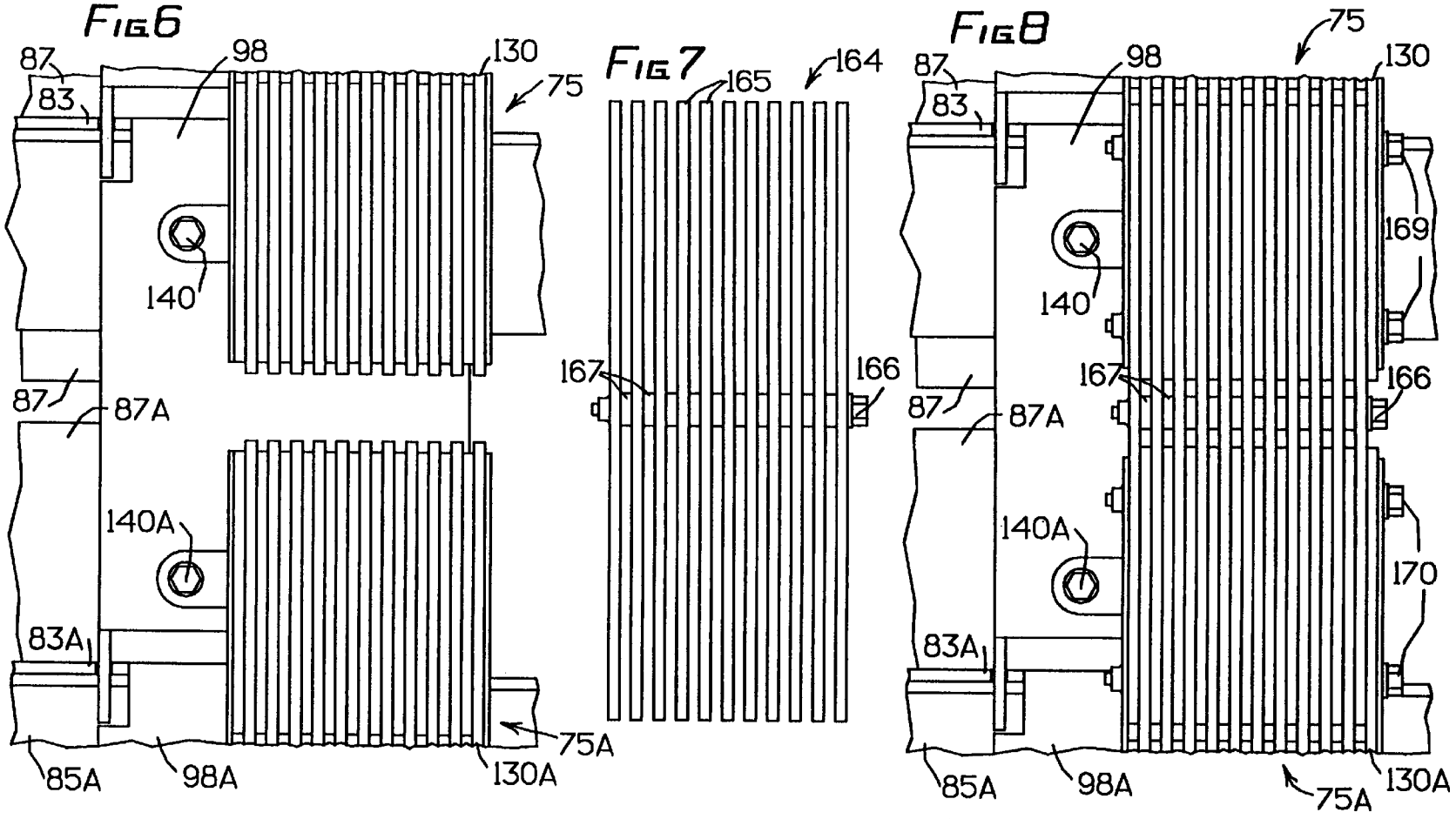
FIGS. 6, 7 and 8 illustrate the connection of adjacent ends of track sections.

Track Interconnect (FIGS. 6–8)

FIG. 6 is a plan view showing portions of a rearward end portion of a left lower track structure 75 of one guideway section 72 and the forward end portion of a left lower track structure 75A of a guideway section 72A behind the section 72 as they appear during an initial point during assembly of such guideway sections. FIG. 7 shows a track connect structure 164 that includes tines 165 secured together by a bolt 166 and held in spaced relation by spacers 167 on the shank of the bolt 166. FIG. 8 shows a completed connection after installation of the track connect structure using bolts 169 and 170.

In the condition shown in FIG. 6, the portion 98 of the most rearward left vertical member 83 of the forward guideway section 72 is disposed under the forward end portion of the track structure 75 and rearward end portions of the flanges 99 and 100 are extended into slots in a most forward left vertical member 83A of the rearward guideway section 72A. Then bolts 140 and 140A are installed to secure brackets 136 and 136A to the portion 98 of the member 83.

As shown, the rearward ends of alternate strips of the track 130 are spaced forwardly from the remaining strips thereof and the forward ends of corresponding alternate strips of a track 130A of the structure 75A are spaced rearwardly spaced from the forward ends of the remaining strips thereof. The result is that spaces are provided between such remaining strips into which the forward and rearward ends of the strips 165 of the connecting structure 164 can be inserted.

After doing so, the bolts 169 and 170 are installed to extend through openings in strips of the tracks 130 and 130A and openings in the strips 165 of the track connect structure 164. All of such openings are elongated in horizontal directions to allow relative longitudinal movement of the tracks 130 and 130A as may occur as a result of temperature variations or otherwise. However, the vertical dimensions of such openings are substantially equal to the diameters of the shank portions of the connecting bolts 169 and 170 to maintain the upper surfaces of the strips of the tracks 130 and 130A and of the strips 165 of the track connect structure at the same level for smooth support of traction wheels moving over the connect structure 164.

The illustrated connect structure 164, which is relatively short, may be made of substantially greater length than is illustrated and more than the two bolts 169 and the two bolts 170 may be used in providing a transition region of greater length.

To interconnect eclectic supply rails, interconnect structures similar to the track interconnect structure 164 may be used.

Figures 9, 10:
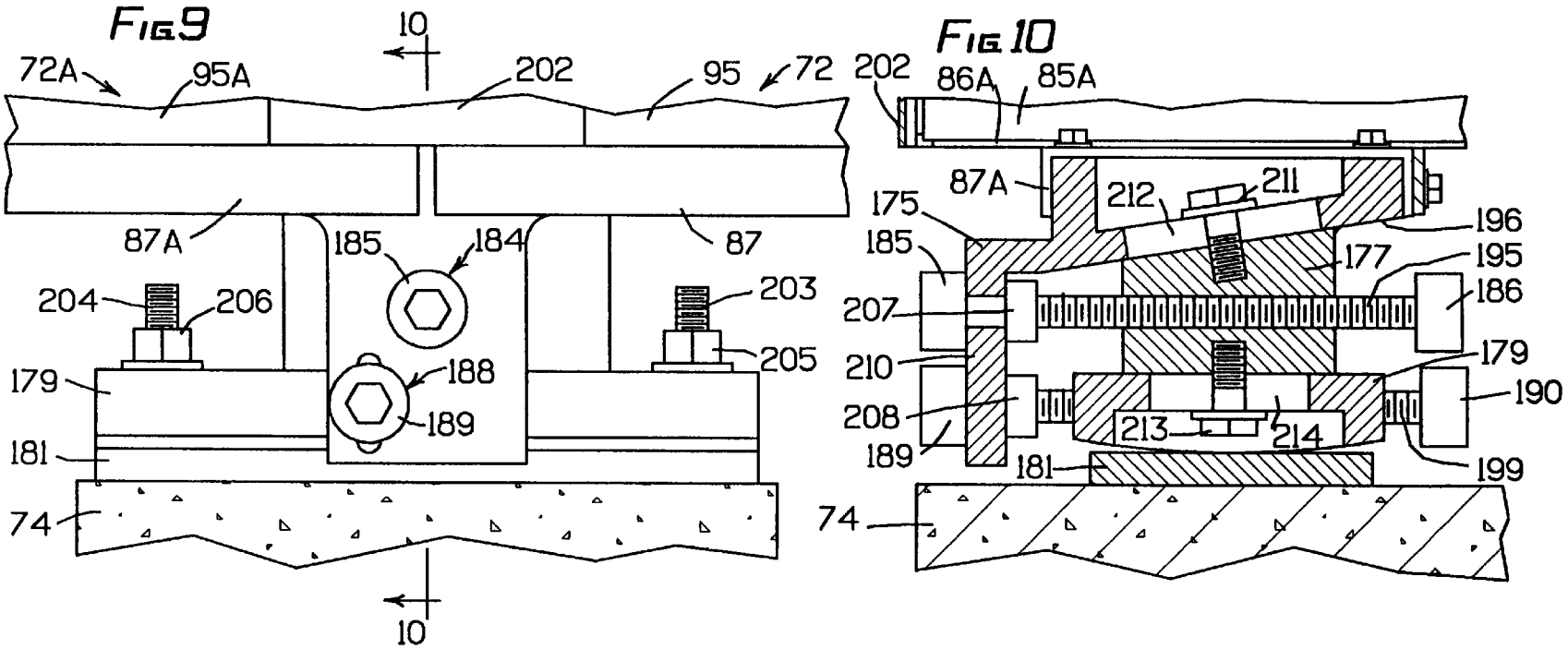
FIGS. 9 and 10 are side elevational and sectional views that illustrate an adjustable support mechanism for guideway sections such as shown in FIG. 2.

Adjustable Guideway Support (FIGS. 2, 9 and 10)

FIG. 2 includes a rear elevational view of the adjustable support mechanism 73 which has left and right side portions 173 and 174 including members 175 and 176 that are secured to forward ends of the left and right lower frame members 87 and 88 of the guideway section 72 and also to rearward ends of lower frame members of the guideway section ahead of section 72. Members 175 and 176 are adjustably supported through wedge members 177 and 178 from members 179 and 180 which are supported from the column 74 through spacer plates 181 and 182.

The mechanism 73 is so constructed as to be accessible from either the left side or the right side of the guideway. The mechanism 73 may also be accessed from within the guideway. The dimensions of the guideway are such that a servicing person may travel within the guideway on a servicing vehicle that is preferably driven by a battery operated electric motor or by an IC engine, so as to permit servicing under conditions in which no power is supplied to electrical supply rails of the guideway.

An adjustment member 184 of the left portion 173 of the mechanism 73 has head portions 185 and 186 at its outer and inner ends; another adjustment member 188 of the left portion 173 has head portions 189 and 190 at its outer and inner ends; and an adjustment member 192 of the right portion 174 of the mechanism 73 has head portions 193 and 194 at its outer and inner ends. Each of such head portions is formed with a hexagonal socket for actuation by an actuating tool.

When adjustment member 184 is rotated, a lead screw portion 195 thereof moves the wedge member 177 in a transverse direction to raise or lower the left support member 175, the wedge member 177 having an inclined upper surface engaged with an inclined lower surface portion 196 of the support member 175. Similarly, when adjustment member 192 is rotated, a lead screw portion 197 thereof moves the wedge member 178 in a transverse direction to raise or lower the right support member 176, the wedge member 178 having an inclined upper surface engaged with an inclined lower surface portion 198 of the support member 176.

When adjustment member 188 is rotated, a lead screw portion 199 thereof coacts with the member 179 to move the left support member 175 along with the left wedge member 177 in a transverse direction. Through lower guideway frame members and cross plates, including members 87 and 88 and cross plate 85, the right support member 176 along with the right wedge member 178 are also moved in a transverse direction in response to rotation of member 188.

When a servicing vehicle is stopped in the vicinity of the support column, members such as the acoustic insulating member 125 and 126 may be temporarily displaced to permit a servicing person to have access from the inside to the hexagonal sockets of the inner head portions 186, 190 and 194. An elongated tool may be used to access the inner head portion 194 of member 192 when servicing from the outside on the left or to access the inner head portions 186 and 190 when servicing from the outside on the right.

FIG. 9 is a side elevational view showing the left portion 173 of the adjustable support mechanism 73 and FIG. 10 is a sectional view taken along line 10—10 of FIG. 9. FIG. 9 shows a forward part of the lower left frame member 87 of guideway section 72 and a rearward part of a lower left frame member 87A of a guideway section 72A ahead of the section 72, also lower portions of sidewalls 95 and 95A of sections 72 and 72A and of a plate 202 that is on the outside of a junction between the forward end of sidewall 95 and the rearward end of sidewall 95A.

FIG. 9 also shows two stud bolts 203 and 204 that extend upwardly from the column 74 and through openings in the spacer plate 181 and the member 179, nuts 205 and 206 being threaded on the bolts 203 and 204. Similar bolts including a bolt 206 are used for the right portion 174 of the mechanism 73. The openings in the members 179 and 180 and the spacer plates 181 and 182 are relatively large and, as shown in FIG. 2 and 10, the lower surfaces of the members 179 and 180 which are engaged with the spacer plates 181 and 182 have cylindrically convex contours to allow for limited rocking movements about horizontal longitudinally extending axes as may be required when there are different vertical levels of the support members 179 and 180.

Spacer plates 181 and 182 may have different thicknesses, particularly for guiding a vehicle in turns where a large superelevation of one track is required relative to the other. Either or both of the spacer plates may also be removed and replaced by plates of different thicknesses in cases where a necessary vertical adjustment cannot be accomplished by rotation of either of the lead screws 195 or 197.

Collars 207 and 208 are provided on the adjustment members 184 and 188 on the inside of a depending portion 210 of the support member 175 to prevent outward movement of the adjustment members 184 relative to the support member 175. As shown in FIG. 9, the opening in the depending portion 210 through which the transverse adjustment member 188 extends is elongated in a vertical direction to allow the required vertical movement of support member during vertical adjustments. As shown in FIG. 10, a bolt 211 extends down through a slot 212 in a portion of the left support member 175 and into the left wedge member 177 and a bolt 213 extends upwardly through a slot 214 in a portion of the member 179 and into the wedge member. Such bolts hold the parts in assembly while permitting the required sliding movements between upper and lower surfaces of the left wedge member 177 and the members 175 and 179. A similar construction is used in the right portion 174 of the mechanism 73. A suitable grease is applied to the surfaces of the wedge members 177 and 178 during construction and at periodic maintenance times to prevent rust from forming and locking up the adjustable assemblies.

Y Junction Construction (FIGS. 11–15)

Figures 11, 12, 13:
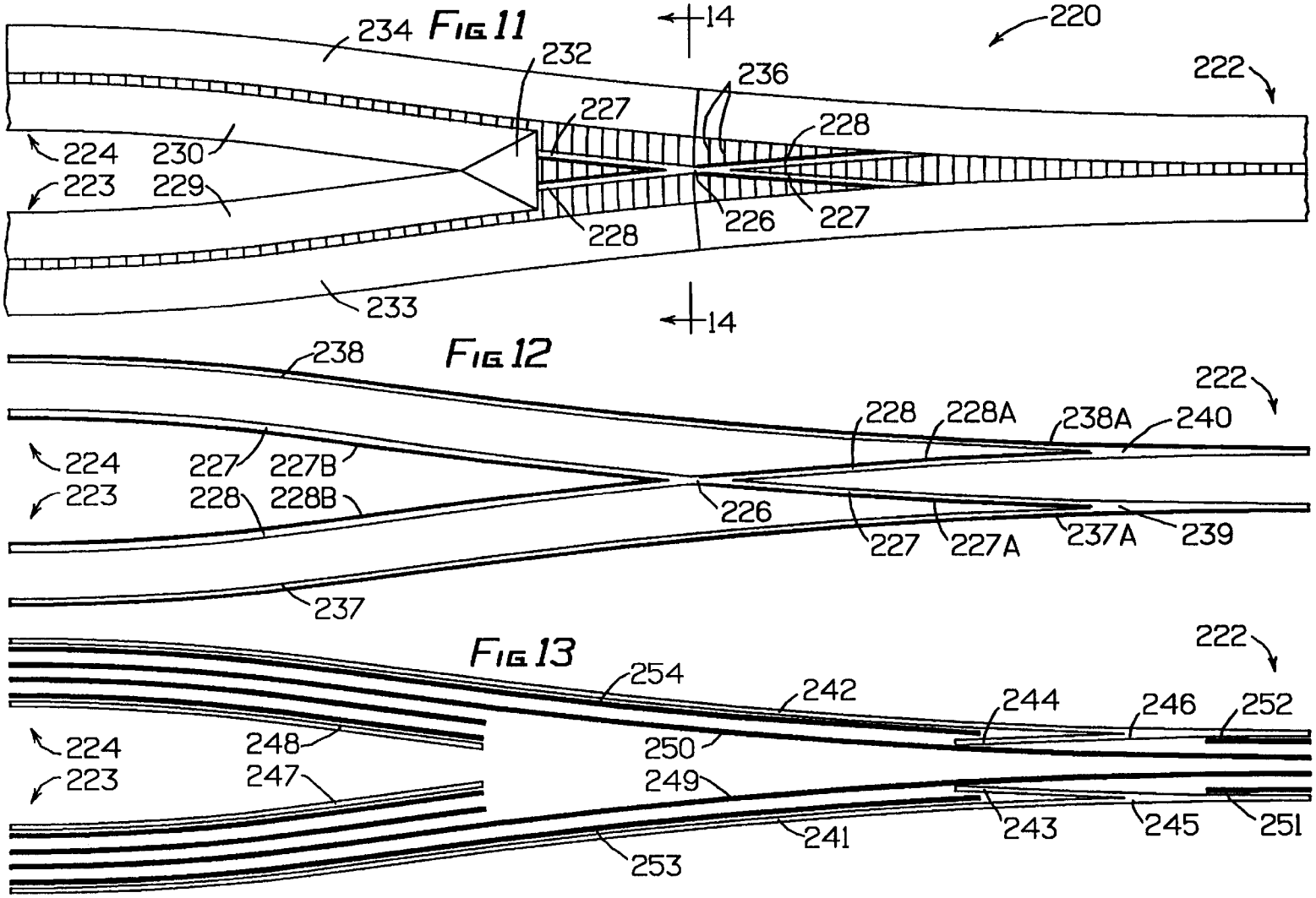
FIGS. 11, 12 and 13 illustrate the construction and operation of a Y junction of guideways.

FIG. 11 is a top plan view of a Y guideway junction 220 which will be described with the assumption that a vehicle may be entering a single end 222 on the right and exiting from either of two ends 223 and 224 on the left. However, the junction 220 would operate as well with vehicles entering either of the left ends 223 or 224 and exiting from the single right end 222. A cross over junction 226 of two lower tracks 227 and 228 is shown, track 227 forming the left lower track at the right end 222 and at the left end 223 and track 228 forming the right lower track at the right end 222 and at the left end 224.

FIG. 11 also shows top walls 229 and 230 that extend from sides of the separated left ends 223 and 224 to a top wall section 232 positioned to the left of the cross over junction 226 of the lower tracks 227 and 228. Additional top walls 233 and 234 extend from sides of the separated left ends and converge to form a narrow slot at the right end 222 of the Y junction 220.

The lower tracks 227 and 228 and the cross over junction thereof are supported on a series of plates 236 that extend between vertical support members and that are in approximate alignment with cross plates, one of such plates being shown in the sectional view of FIG. 14 as is described hereinafter.

FIG. 12 shows the layout of lower tracks of the Y junction 220. These include the lower tracks 227 and 228 that cross at the cross over junction 226, a track 237 that forms the left lower track at the left end 223 and that extends to the right to merge in a region 239 with a right end portion of track 227 to form the left lower track at the right end 222 and a track 238 that forms the right lower track at the left end 224 and that extends to the right to merge in a region 240 with a right end portion of track 228 to form the right lower track at the right end 222.

Guide ribs 237A and 228A of the lower tracks 237 and 238 extend continuously along the length thereof. A pair of guide ribs 227A and 228A of the lower tracks 227 and 228 extend from the merge regions 239 and 240 to the crossover junction 226 and an additional pair of guide ribs 227B and 228B of the lower tracks 227 and 228 extend to the left from a point to the left of the crossover junction 226.

If turn and position control wheels that correspond to wheels 35 and 36 of FIG. 1 and that are positioned on the right side of a carrier vehicle are active while the vehicle is moving to the left and entering the right end 222, the vehicle will be controlled by the guide rib 238A to move on the tracks 227 and 238 to the end 224. If the turn and position control wheels on the opposite left side are active, the vehicle will be controlled by the guide rib 237A to move on the tracks 237 and 228 to the end 223.

The position control wheels corresponding to wheel 36 perform a very important function in insuring a positive limit on transverse movement of a vehicle at all times, particularly during times when lower wheels of a bogie are moving through the regions 239 and 240 and when such wheels moving through the track crossover junction 226. During such times, only one of the lower traction wheels of a bogie is adjacent a guide rib to positively limit transverse movement of a vehicle in one direction but the then active position control wheel is then on the opposite side of the controlling guide rib to limit transverse movement in the opposite direction.

At other times when passing through a Y junction, guide ribs are engageable by traction wheels to limit transverse movement. For example, when moving between the junctions 239 and 240 and the track crossover junction 226, the traction wheels are engageable with the ribs 237A and 228A or with the ribs 227A and 238A to limit transverse movement.

The guide ribs thus provide a safe limit on transverse movement but so long as centrifugal or other transverse forces do not exceed transverse frictional forces between traction wheels and tracks, engagement between guide ribs and traction or position control wheels is limited. To reduce centrifugal forces or the their effects, a reduced speed or a superelevation of the outside track may be used, neither being desirable in a Y junction especially in that the track should be flat in regions 239 and 240 and in the crossover junction 226 for proper contact with traction wheels. The effect of centrifugal forces is preferably reduced by using large turn radii for tracks in the Y junction, thereby increasing the length of the junction but without serious problems. Since there are no active switch elements, vehicles may safely move at reasonably high speed speeds through Y junctions.

FIG. 13 provides a diagrammatic showing of the positions of upper tracks and transmission line elements in the Y junction 220. A pair of left and right upper tracks 241 and 242 and second pair of left and right upper tracks 243 and 244 extend to the left from junction regions 243 and 244 at the left end of the Y junction. Tracks 241 and 242 extend to the ends 233 and 234 of the Y junction while tracks 243 and 244 extend to the left from the junction regions 245 and 246 and to positions well short of the lower track crossover junction 226. Another pair of upper tracks 247 and 248 extend to the left and to the ends 233 and 234 of the Y junction from positions well beyond the lower track cross-over junction 226.

When a vehicle moves to the left from the right end 222 to the left end 223 of the junction 220, the left upper wheels thereof engage the track 241 while the right upper wheels initially engage track 244, then move out of contact with any track and then engage track 247. Similarly, when a vehicle moves to the left from the right end 222 to the left end 224 of the junction 220, the right upper wheels thereof engage the track 242 while the left upper wheels initially engage track 243, then move out of contact with any track and then engage track 248. The tracks 243 and 244 are sloped upwardly from right ends at the junction regions 245 and 246 to elevated left ends, the result being that the upper wheels engaged thereby are gradually allowed to be moved upwardly by traction control springs of bogies until reaching an upper limit position. Similarly, the tracks 247 and 248 are gradually sloped downwardly from elevated right ends to left ends that are at the proper level for normal forces of engagement by upper traction wheels of vehicles.

FIG. 13 also illustrates the positions of transmission line elements that are provided for transmission of signals to and from vehicles, including elements 249 and 250 that extend for the full length of the Y junction from the right end 222 to the left ends 223 and 224, elements 251 and 252 that extend short distances from the right end 222 and elements 253 and 254 that extend to the left ends 223 and 224 of the Y junction from points to the left of the upper tracks 243 and 244. Continuous signal transmissions are obtained at all times through the elements 249 and 250, additional redundant transmissions being obtained through elements 251 and 252 or through elements 253 and 254, except during travel through relatively short distances. Multiple paths of signal transmission are provided in the system to obtain a high degree of redundancy and reliability.

Figure 14:
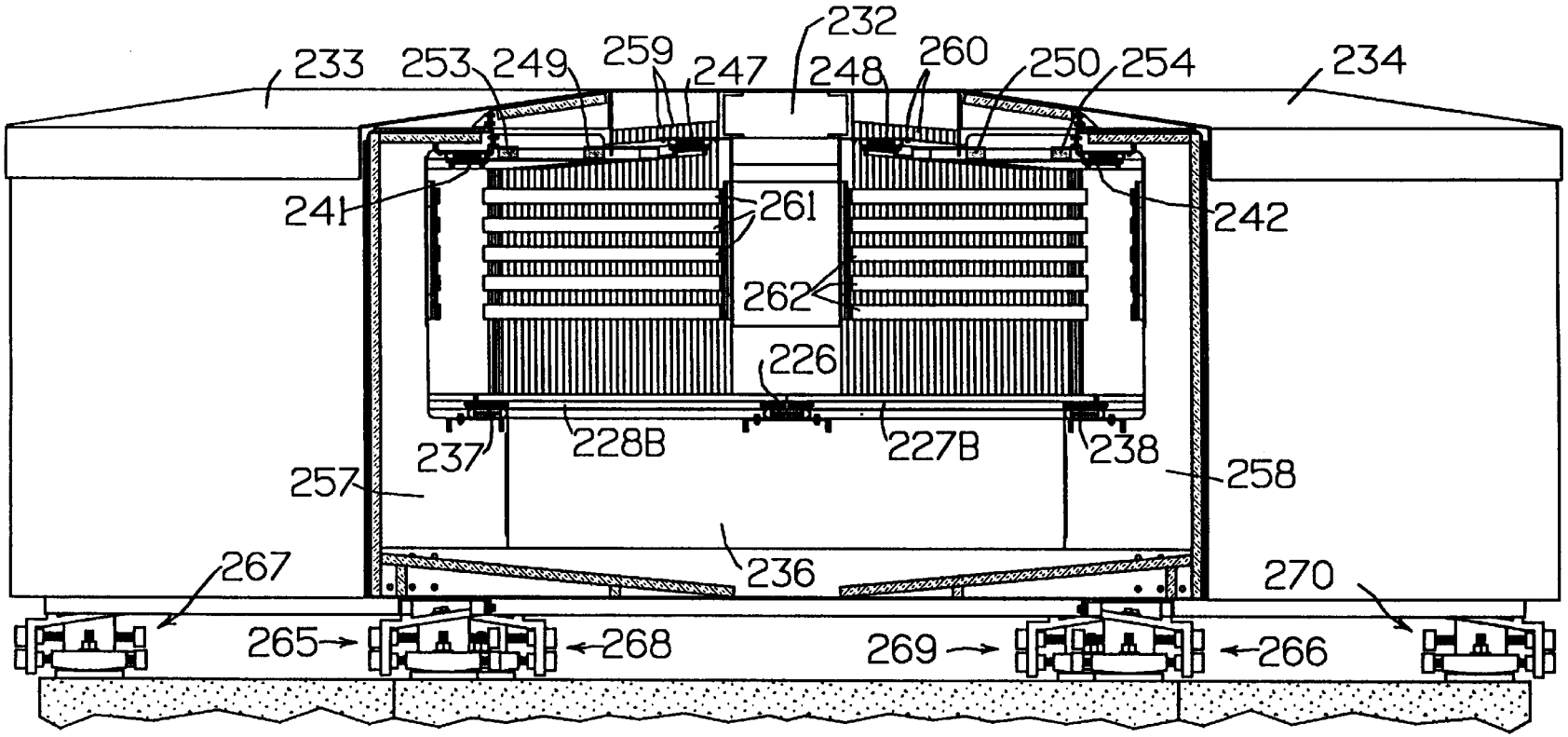
FIG. 14 is a sectional view taken substantially along line 14—14 of FIG. 11.
Figure 15:
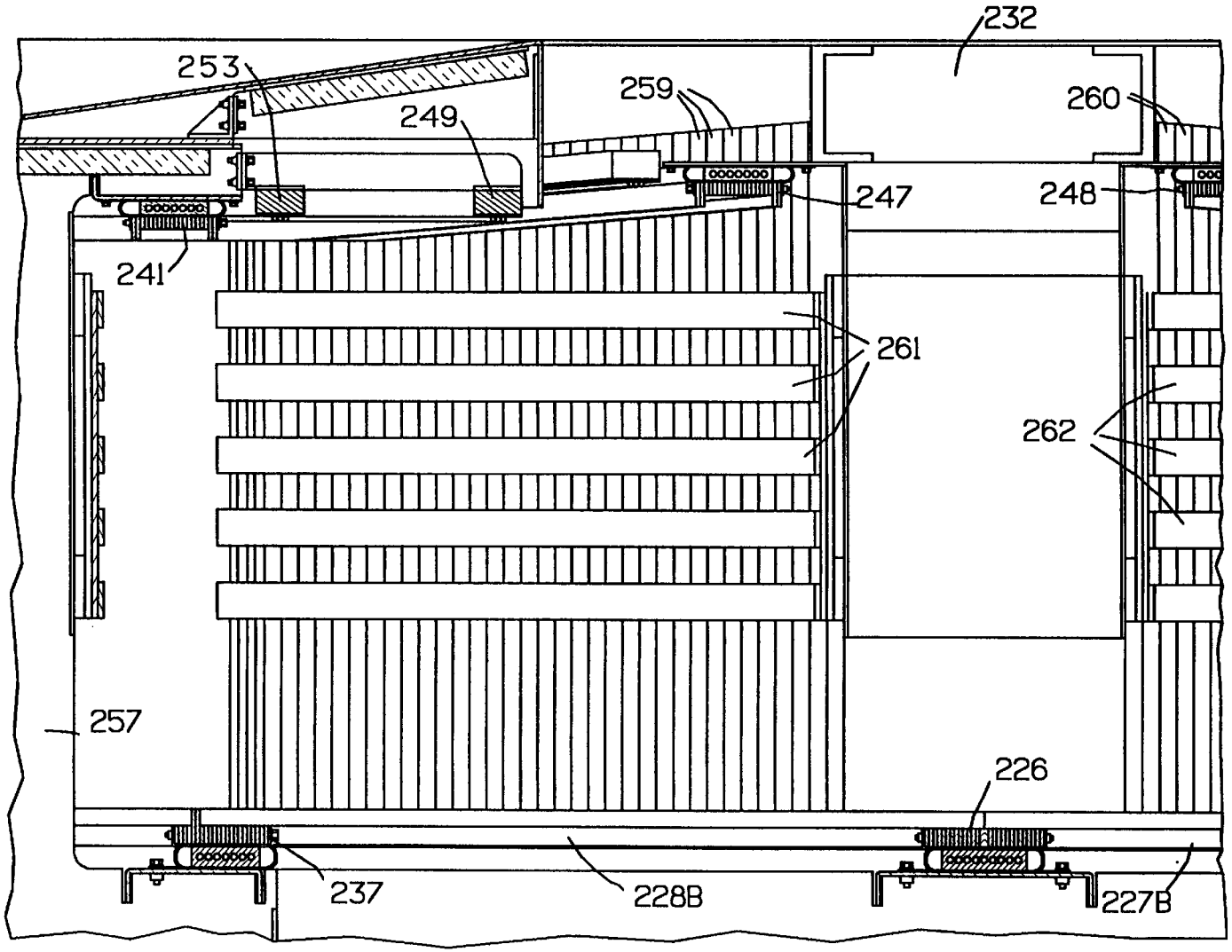
FIG. 15 is an enlargement of a portion of FIG. 14.

FIG. 14 is a cross-sectional view taken substantially along line 14—14 of FIG. 11 and FIG. 15 corresponds to a portion of FIG. 14 but on enlarged scale. One of the plates 236 is shown in elevation in supporting relation to the lower track crossover junction 226, opposite ends of the illustrated plate 236 being secured to vertical support members 257 and 258 that support the lower tracks 237 and 238 and the upper tracks 241 and 242 and that are like the vertical support members 83 and 84 (FIG. 2). Additional plates similar to plate 236 support portions 227B and 228B of tracks 227 and 228, shown in FIG. 14, as well as portions 227A and 228A, not visible in FIG. 14.

FIG. 14 also shows edge portions of two series of vertical support members 259 and 260 that support upper tracks 247 and 248 and that are similar to vertical support members 84 and 83 (FIG. 2) but have modified configurations such that tracks 247 and 248 are gradually sloped downwardly and outwardly, to the left and right as viewed in FIG. 14, from ends that are elevated ends that are at the proper level for normal forces of engagement by upper traction wheels of vehicles exiting the Y junction.

FIG. 14 additionally shows two groups of electrical supply rails 261 and 262. Rails 261 are engageable by shoes on the right side of vehicles moving to the left on tracks 237 and 228B after passing the track crossover junction 226 while rails 262 are engageable by shoes on the left side of vehicles moving to the right on tracks 238 and 227B after passing the track crossover junction 226. The supply rails 261 and 262 are so positioned that initial contact by the shoes occurs only after the shoes move forwardly beyond the rearward ends of the rails with pressure between shoes and rails gradually increases with further forward movement of the shoes.

The Y junction 220 is formed in sections, the forward end of each section and the rearward end of an adjacent section being supported by adjustable support mechanisms similar to mechanism 73. FIG. 14 shows left and right portions 265 and 266 of one mechanism supporting the ends of sections that are close to the lower track cross over junction 226, left and right portions 267 and 268 of another mechanism that supports the ends of sections at the end 223 of the Y junction 220 and left and right portions 269 and 270 of a third mechanism that supports the ends of sections at the end 224 of the Y junction 220.

Figure 16:
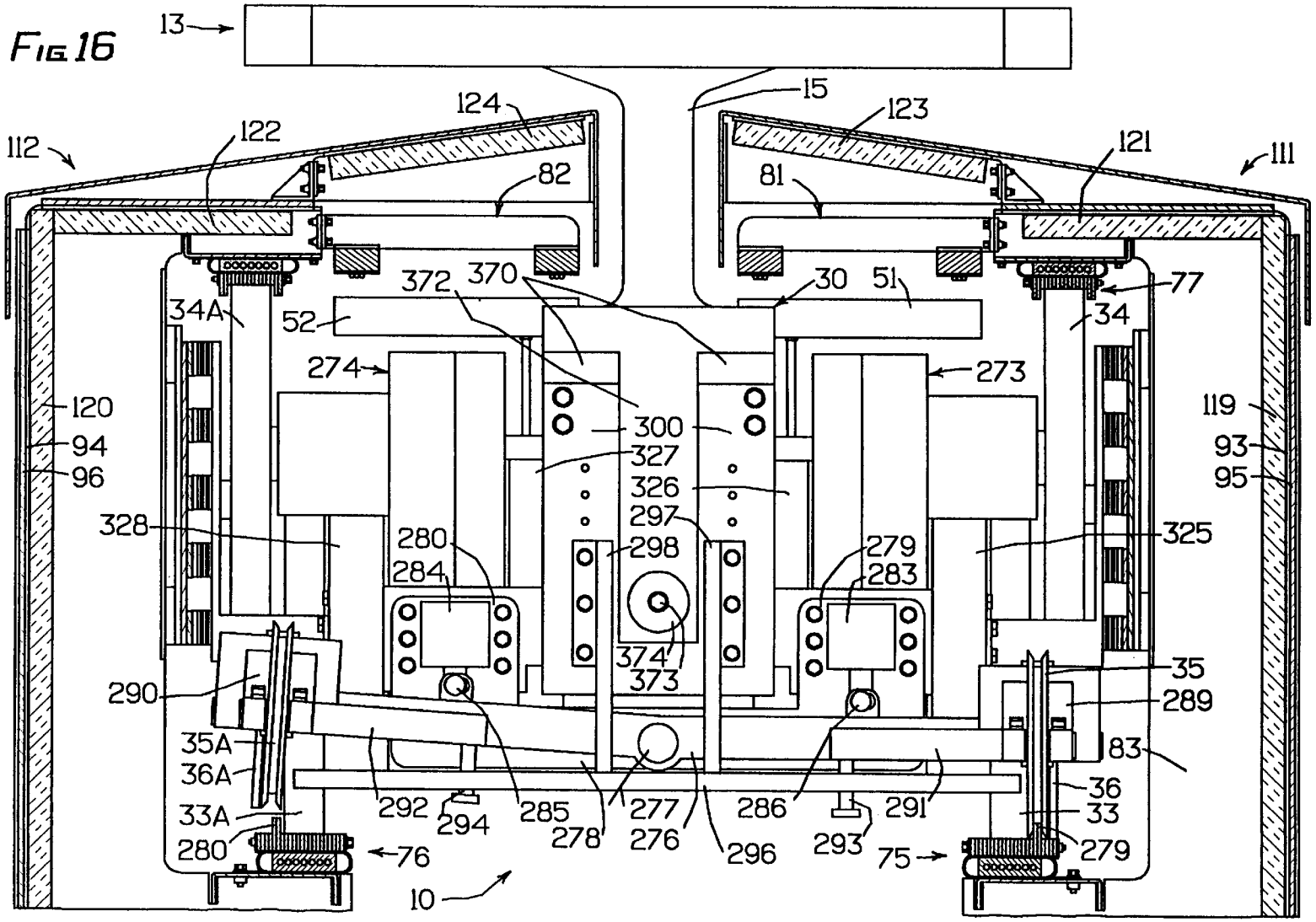
FIG. 16 is a cross-sectional view through a guideway of the invention, also providing a front elevational view of a carrier vehicle with a fairing structure thereof removed.
Figure 17:
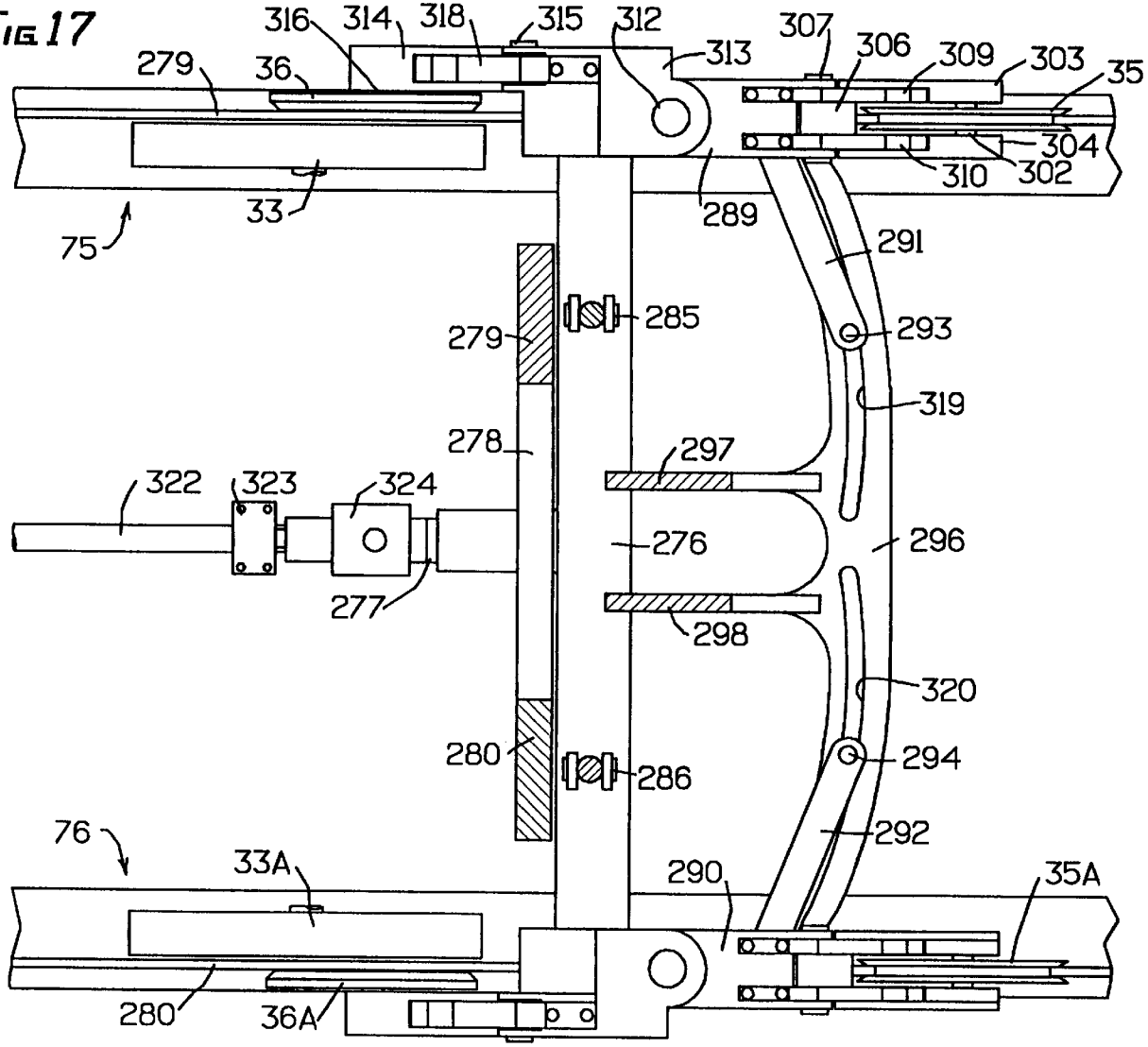
FIG. 17 is a sectional view looking downwardly at a turn control assembly of the carrier vehicle shown in FIG. 16.
Figure 18:
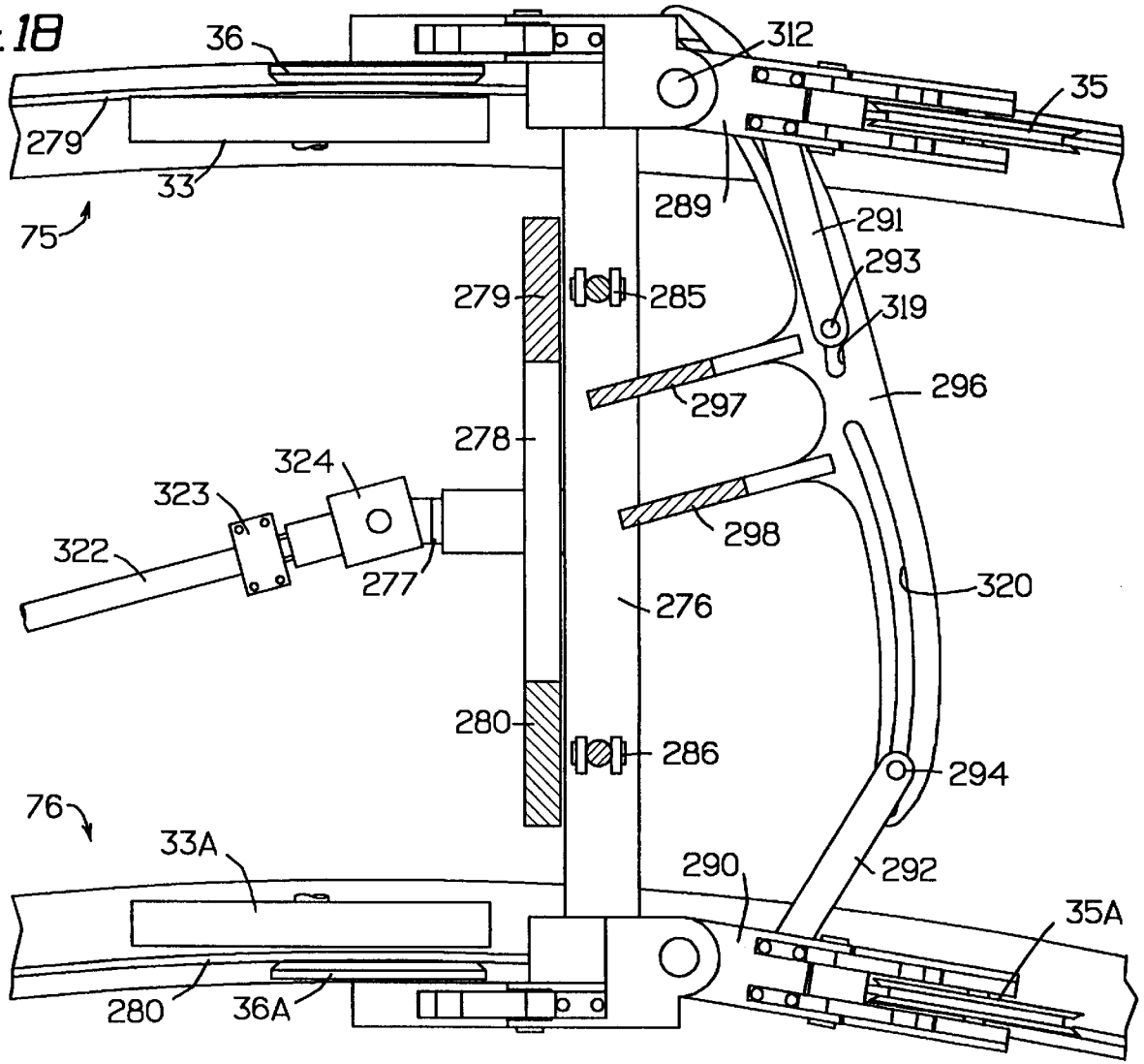
FIG. 18 is a view similar to FIG. 17 but showing the assembly in a turn condition.

Carrier Vehicle Turn Control (FIGS. 16–18)

FIG. 16 is a front elevational view of the carrier vehicle 10, shown positioned in the guideway section 72 of FIG. 2 but with the forward aerodynamic fairing 69 of the vehicle 10 removed. The forward and rearward bogies 31 and 32 so support a base frame 272 as to permit the bogies to pivot about vertical steering axes and the base frame 272 provides resilient support for the frame structure 30 that carries the forward and rearward posts 15 and 16.

The forward bogie 31 is supported through left and right bearing units 273 and 274 thereof which journal the lower and upper traction wheels 33 and 34 on the left side of the vehicle 10 and corresponding wheels 33A and 34A on the right side of the vehicle. The bearing units 273 and 274 are pivotal relative to the bogie 31 about a horizontal axis midway between the axes of the lower and upper traction wheels and, through springs acting thereon, forces are applied to urge the upper traction wheels into engagement with the upper tracks while applying forces aiding gravitational forces in urging the lower traction wheels into engagement with the lower tracks.

A transversely extending turn control member 276 is secured at a point intermediate its ends to a shaft 277 which is supported from the forward bogie 31 for movement about a horizontal axis that is midway between left and right sides of the guideway. Turn control member 276 supports the turn and position control wheels 35 and 36 from the left end thereof and corresponding turn and position control wheels 35A and 36A from the right end thereof. When turn control member 276 is positioned as shown in FIG. 16, the turn and position control wheels 35 and 36 are in lowered active positions to cooperate with a guide rib of the left track structure 75 that is indicated by reference numeral 279 and that may preferably be formed by the strips 131 and 132 of the laminated track 130 in the manner as illustrated in FIG. 4. When turn control member 276 is rotated in a counter-clockwise direction as viewed in FIG. 16, the left turn and position control wheels 35 and 36 are elevated to inactive positions while the right turn and position control wheels 35A and 36A are lowered from inactive elevated positions to active lowered positions to cooperate with a guide rib 280 of the right track structure 76.

The support shaft 277 for the turn control member 276 is journaled by a central portion of a transversely extending support member 278 which has upwardly extending portions 279 and 280 at its opposite ends that are bolted or otherwise secured to a transversely extending bar 282 of a frame structure of the bogie 31. Solenoids 283 and 284 are secured to the portions 279 and 280 of member 278 and have armatures linked through connections 285 and 286 to the turn control member 276. An internal permanent holding magnet of the solenoid 284 functions to exert a force on its armature that holds the turn control member 276 in the position shown, until the solenoid 283 is energized to overcome the force exerted by the permanent holding magnet of solenoid 284 and to move the turn control member 276 to a position opposite that shown. A permanent holding magnet of the solenoid 283 then operates to hold the turn control member in the position to which moved, until the solenoid 284 is energized to move the member 276 back to the position shown.

The grooved turn control wheels 35 and 35A are supported from control wheel support members 289 and 290 which are supported from opposite ends of the turn control member 276 for movement about vertical turn axes and which carry inwardly extending arms 291 and 292 that support cam follower elements in the form of pins 293 and 294 extending downwardly and through slots in a cam plate 296. Cam plate 296 is secured to brackets 297 and 298 that are bolted or otherwise secured to a front upwardly extending part 300 of the base frame 272.

FIGS. 17 and 18 are plan views illustrating features of support and control of the turn and position control wheels and their operation in controlling the direction of travel of a vehicle. FIG. 17 shows the positions of parts when the vehicle is moving straight ahead while FIG. 18 shows the positions of parts when the vehicle is moving around a turn of short radius such as a radius of twenty feet, for example.

The grooved turn control wheel 35 rotates on a shaft 302 carried between spaced arm portions 303 and 304 of a member 306 which is pivotal on a shaft 307 carried by the control wheel support member 289. Leaf springs 309 and 310 are secured to the member 289 and engage the arm portions 303 and 304 to urge the wheel 35 downwardly, downward movement thereof being limited by interengagement of surfaces of the arm portions with stop surfaces of the support member 289. A shaft 312 supports the control wheel support member 289 for movement about a vertical axis relative to a support part 313 at a left end of the turn control member 276. An arm 314 is supported from the part 313 through a shaft 315 and carries a support shaft 316 for the position control wheel. A leaf spring 318 is secured to the part 313 and engages the arm 314 to urge the wheel 36 downwardly, downward movement thereof being limited by interengagement of a surface of the arm 314 with a stop surface of the part 313.

The support of the turn and position control wheels on the right side is substantially the same as on the left side and is not described in detail.

FIGS. 17 and 18 show cam slots 319 and 320 through which the cam follower pins 293 and 294 extend. The configuration of the cam slots 319 and 320, the locations of the vertical turn axes of the control wheel support members 289 and 290, the dimensions and dimensional relationships of parts are such as that the axes of all the wheels 35, 36, 35A and 36A always intersect at a common vertical turn axis regardless of the magnitude of any angle of turn of the bogie 31 relative to frame elements of the vehicle 10, so long as the angle is less than a certain limiting value. In the illustrated construction, the distances from vertical axes of turn of the control wheel support members 289 and 290 to the points of contact of the respective turn and position control wheels 35 and 36 or 35A and 36A are equal and the cam surfaces 319 and 320 were so generated as to.

The conditions shown in FIG. 18 are such that the angle of turn of the front bogie 31 relative to the main frame of the carrier vehicle 10 is 15 degrees and are such that the diameter of the wheels is 20 inches with the distance between the turn axes of the front and rear bogies being 120 inches, all other dimensions being proportional to what is shown in the drawings. Under such conditions, the turn radius of the carrier vehicle 10, measured from its center, is slightly less than 20 feet, the angle of turn of the control wheel support member 289 from the straight ahead condition is approximately 7.5 9.25 degrees and the corresponding angle of turn of the control when support member 290 is approximately 9.25 degrees. The angle of turn of the right member 290 in the illustrated case of a turn to the right is greater than that of the left member since member 290 is closer to the turn axis of the carrier vehicle 490.

In the construction shown, the axis of the lower traction wheels 33 and 33A is displaced rearwardly from the axis of upper traction wheels 34 and 34A of the front bogie 31. In the illustrated arrangement, such axes are displaced rearwardly and forwardly from the axis of the position control wheels 36 and 36A. As a result, the arrangement does not produce precise tracking of either the lower traction wheels 33 and 33A or the upper traction wheels 34 and 34A. However, the displacements are quite small in relation to the turn radius and produce no substantial adverse effects, even in a minimum radius of turn condition.

It is also noted that the primary function of the grooved turn control wheels is to steer the bogie by applying sufficient torque to rotate the bogie to a position in which the axes of the traction wheels and the position control wheels are transverse to the direction of travel. When resisting of centrifugal or wind or other transverse forces is necessary, they are resisted primarily by frictional engagement of traction wheels and tracks, being limited by engagement of traction wheels with guide ribs of upper and lower tracks or, at certain times during travel through a Y junction, by interaction of position control wheels and guide ribs.

FIGS. 17 and 18 also illustrate a forward part of a shaft 322 that is journaled by a bearing 323 carried by the base frame of the vehicle. A universal joint connection 324 is located in a vertical plane in approximate alignment with the axis of the turn control wheels 34 and 34A and is provided between a splined forward end portion of the shaft 322 and the rearward end of the shaft 277 that carries the turn control member 276. The shaft 322 extends back to the rear bogie 32 and is similarly connected to a turn control member of the rear bogie that corresponds to the turn control member 276. The control system of the vehicle is operative to simultaneously energize the solenoids of both the front and rear bogies. However, the energization of a single solenoid is sufficient to operate the turn control members of both so that switching will occur even when one solenoid or its energizing circuit fails.

It is noted that switching may be remotely controlled from a central control center by sending signals to a carrier vehicle to selectively control energization of the solenoids 283 and 284. Switching may also be controlled through cam members that are not shown but that are positioned ahead of a Y junction at which switching is to occur and that may under remote control be selectively elevated to positions in the paths of lower end portions of the cam follower pins 293 and 29. For this reason, such end portions preferably enlarged as is shown.

Bogie Construction (FIGS. 19–24)

Figure 19:
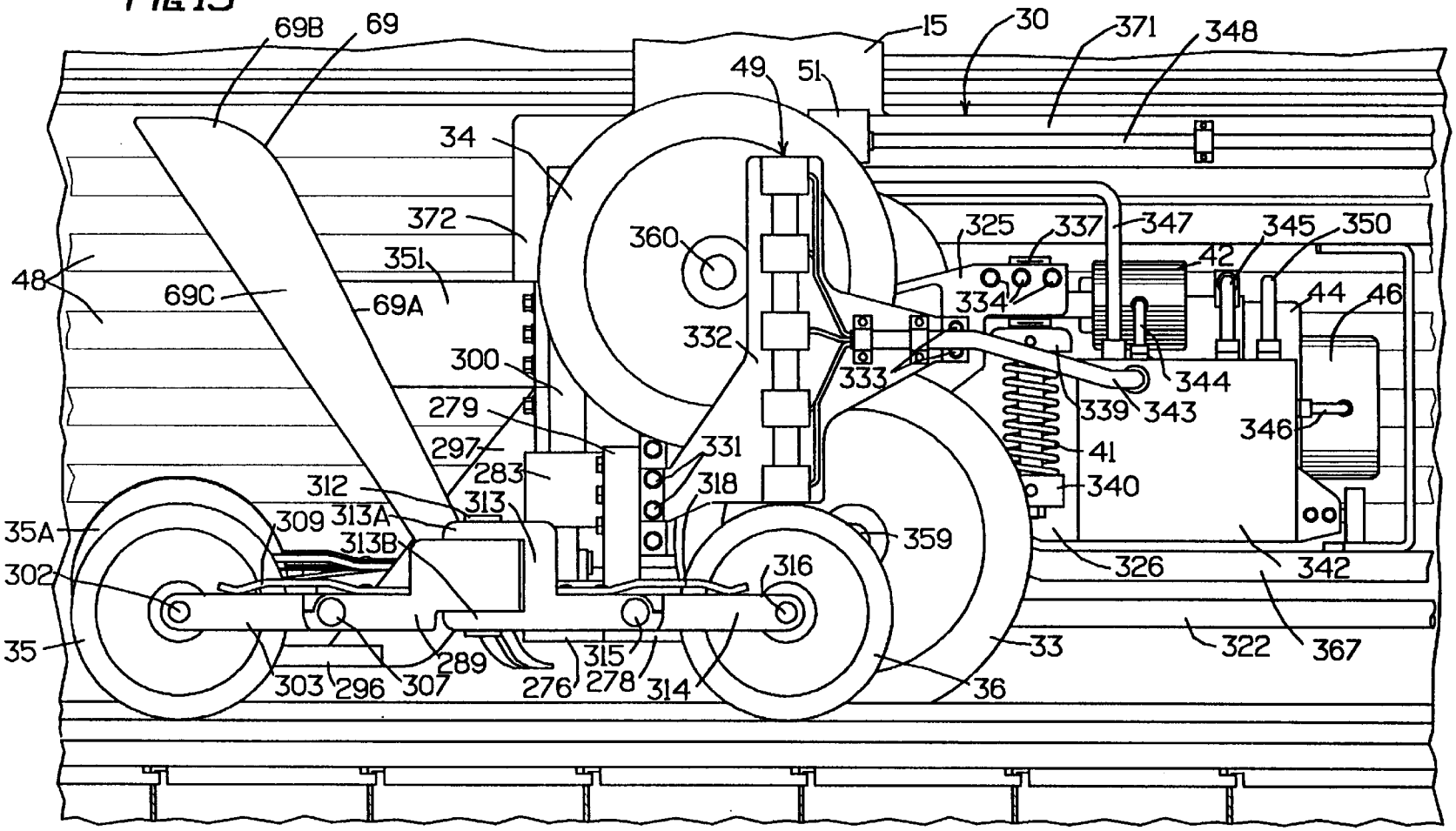
FIG. 19 is a side elevational view of the carrier vehicle shown in FIG. 16.
Figure 20:
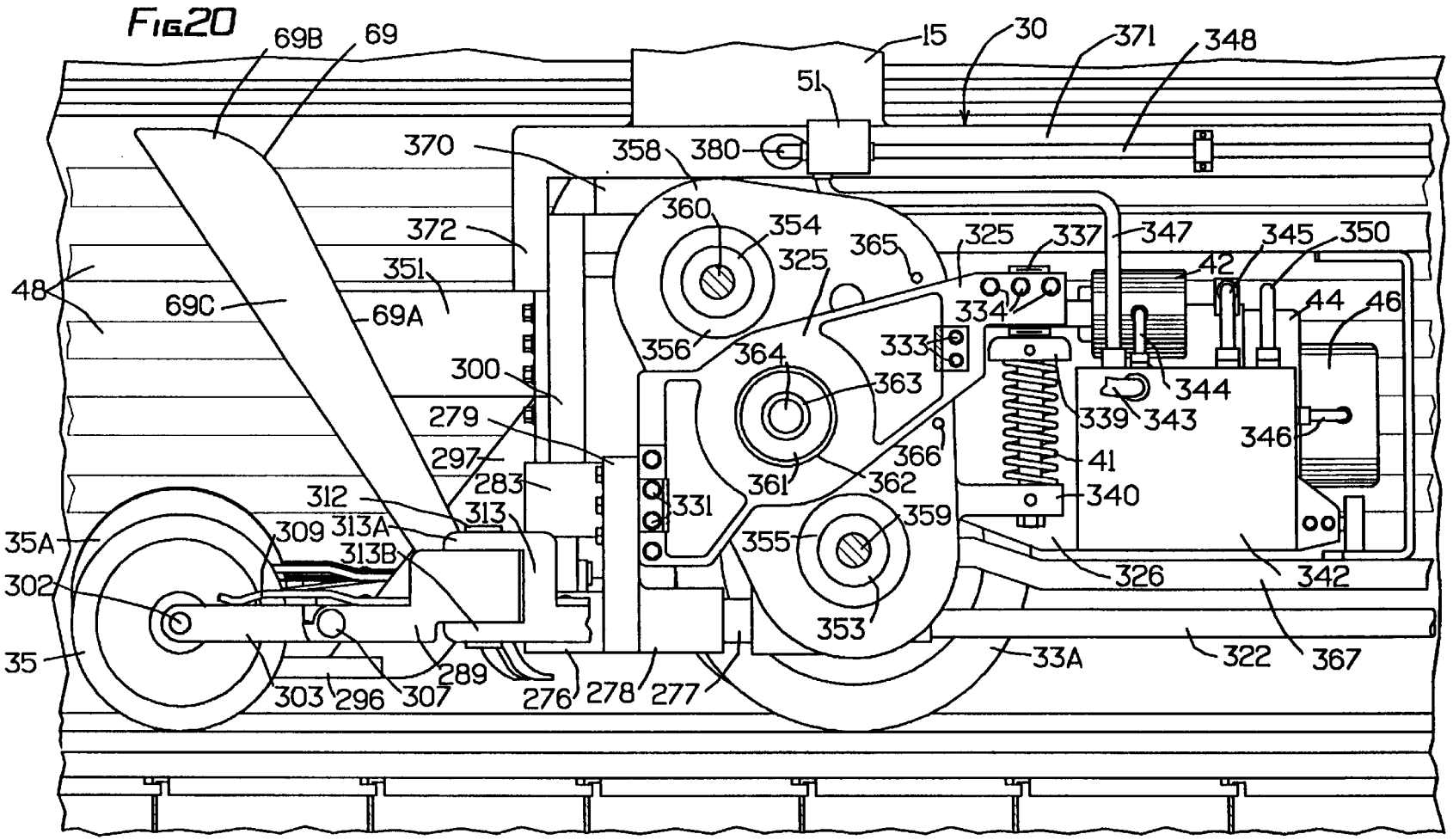
FIG. 20 is a view similar to FIG. 19 but with certain parts removed or shown broken away.
Figure 21:
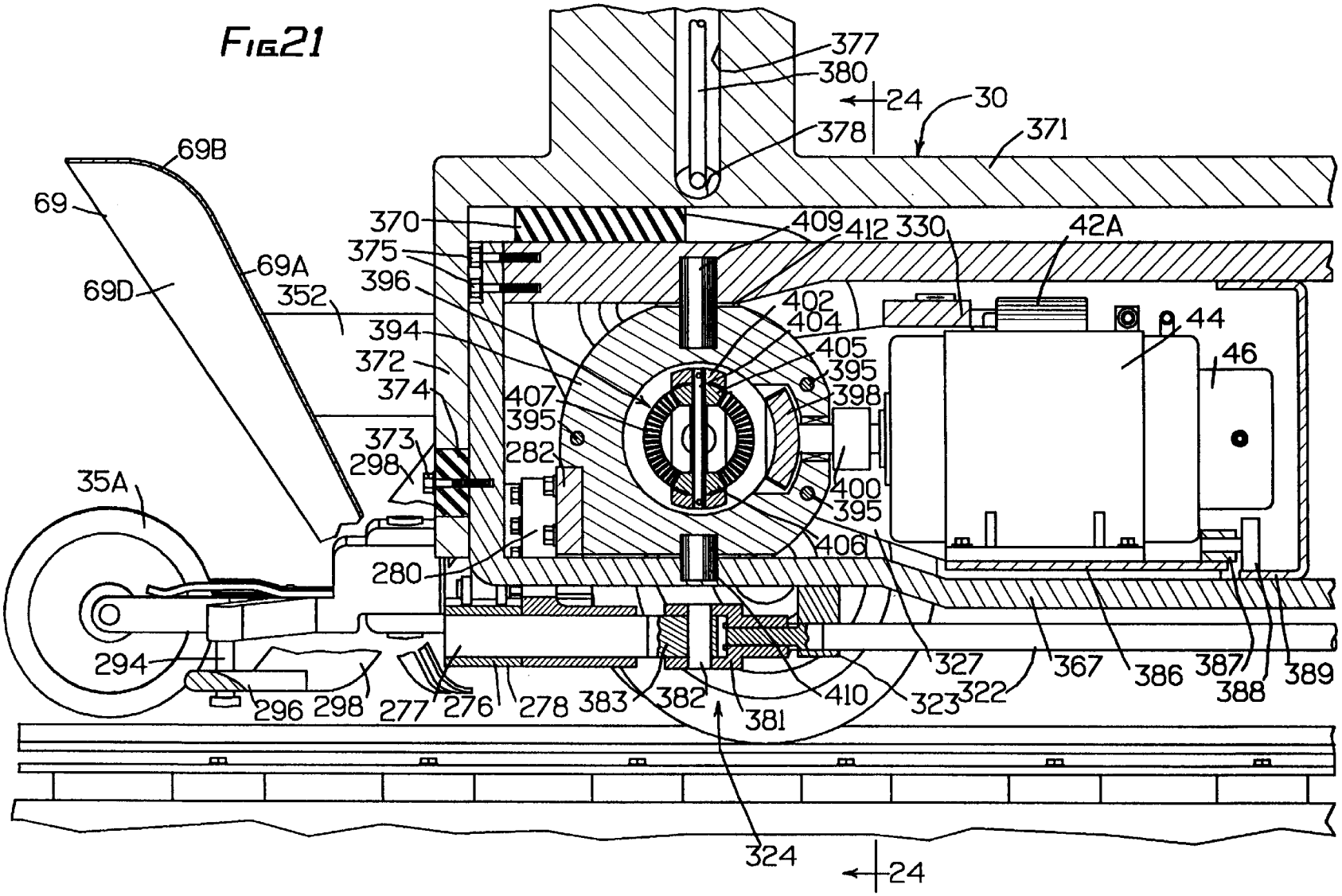
FIG. 21 is a sectional view of the carrier vehicle taken along a central vertical plane.
Figure 23:
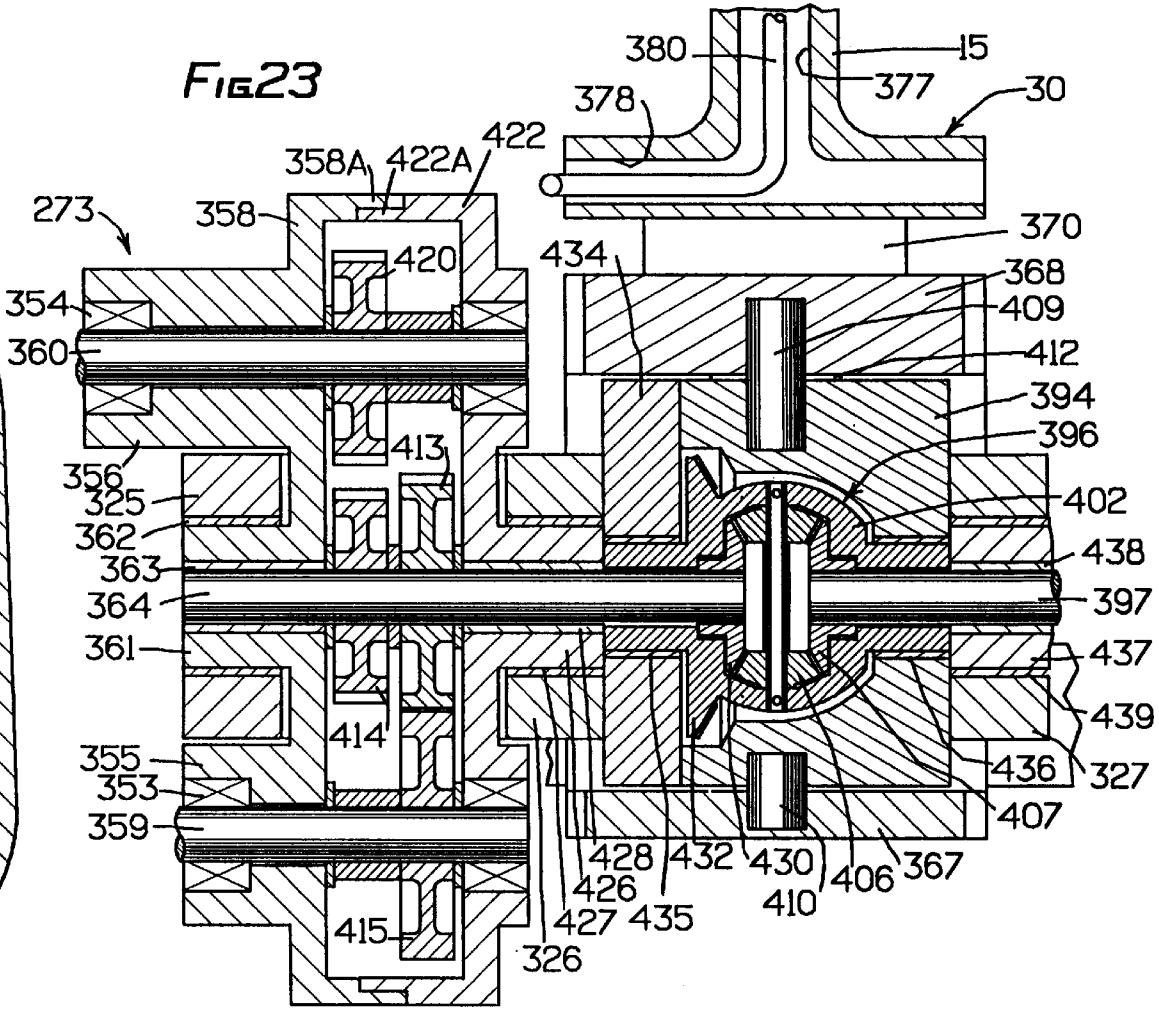
FIG. 23 is a cross-sectional view, the left hand part being taken substantially along an inclined plane line 23–23 of FIG. 23 and the right hand part being taken along a vertical plane and showing parts of a differential gearing assembly used in driving drive shafts of both right and left gear units.
Figure 22:
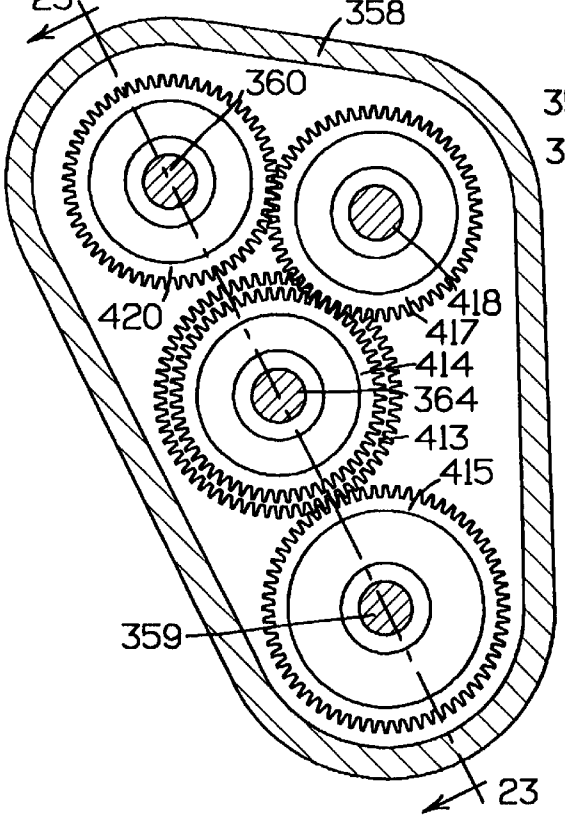
FIG. 22 is an elevational sectional view looking inwardly from inside an outer wall of a housing of a left gear unit of the carrier vehicle.
Figure 24:
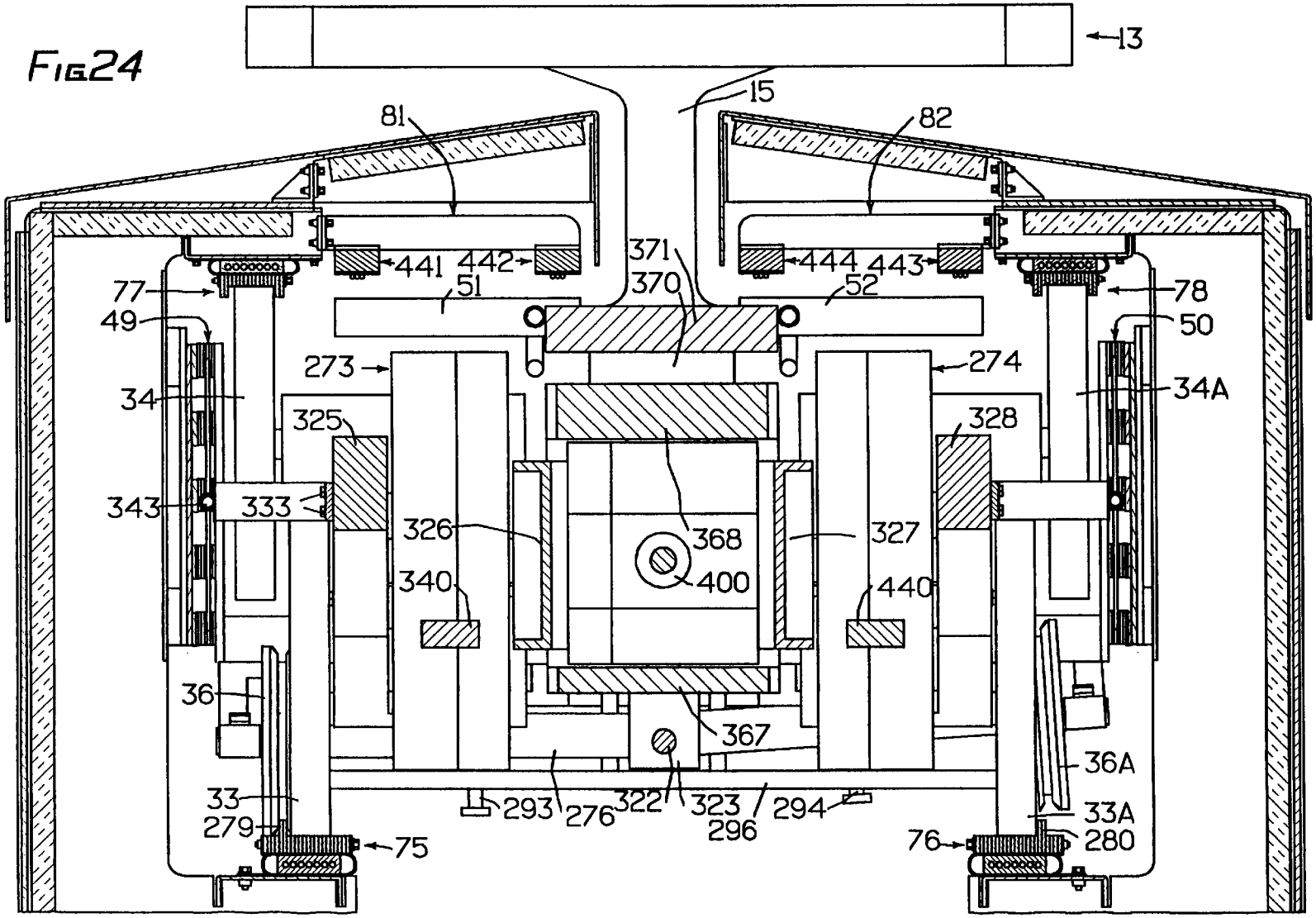
FIG. 24 is a cross-sectional view of the carrier vehicle taken along line 24—24 of FIG. 21.

Additional features of construction of the front bogie of carrier vehicle 10 and associated portions of the frame structure of the vehicle 10 are shown in FIGS. 19–24. FIG. 19 is a side elevational view of a front portion of the vehicle 10; FIG. 20 is a view like FIG. 19 but with the traction wheels 33 and 34, the contact shoe assembly 49 and other components removed or broken away; FIG. 21 is a elevational sectional view of the portion of the vehicle shown in FIGS. 19 and 20, taken along a central longitudinal axis; FIG. 22 is an elevational sectional view looking inwardly from inside an outer wall of a housing of the right bearing unit 274; FIG. 23 is a cross-sectional view, the left hand part being taken substantially along an inclined plane line 23—23 of FIG. 22 and the right hand part being taken along a vertical plane and showing parts of a differential gearing assembly used in driving drive shafts of both bearing units 273 and 274; and FIG. 24 is an elevational sectional view taken substantially along line 24—24 of FIG. 21, looking forwardly from a position behind the bearing units 273 and 274.

FIG. 19 more clearly shows the support of the turn and position control wheels 35 and 36 from the support part 313 at the left end of the turn control member 276. As shown, the support part 313 has portions 313A and 313B of the positioned above and below a portion of the control wheel support member 289, the shaft 312 being extended through such portions of part 313 and member 289.

A frame of the front bogie 31 includes the aforementioned transverse bar 282 which is secured by bolts to the forward ends of four transversely spaced frame members 325, 326, 327 and 328. The left gear unit 273 is supported between frame members 325 and 326 while the right gear unit 274 is supported between frame members 325 and 326. Another transverse bar 330 is disposed behind the gear units and is secured by bolts to each of the frame members 325–328. Portions of members 325–328 and bar 330 appear in the view of FIG. 16 looking rearwardly toward the front of the bogie. Members 325–328 are also shown in the view of FIG. 24, looking forwardly from a position behind the gear units 273 and 274. Bar 330 is also shown in the cross-sectional view of FIG. 21.

FIG. 19 shows the heads of four bolts 331 that secure the forward end of frame member 325 to the left end of bar 282, two of such bolts being also operative to secure a forward portion of a mounting bracket 332 of the contact shoe assembly 49 to the member 325. FIG. 19 also shows the heads of bolts 333 that secure a rearward portion of the mounting bracket 332 to the frame member 325 and the heads of three bolts 334 that secure the frame member 325 to the left end of the transverse bar 330. The frame member 328 is similarly secured to the opposite right end of the bar 330 and frame members 326 and 327 are also secured to the bar 330.

The traction control motor 42 is mounted on a lead screw drive unit 336 which is mounted on the underside of the bar 330. The motor 42 drives a worm of the unit 336 to rotate a worm gear and thereby a nut on a lead screw 337 to control vertical movement of member 339 engaged with one end of the spring 41, the opposite end of the spring 41 being engaged with a member 340 which projects rearwardly from the left gear unit 273. Bar 330 has opening through which the upper end of lead screw 337 extends. The traction control motor 42 thereby controls a torque applied about an axis midway between the axes of the upper and lower traction wheels 33 and 34 to control the traction forces between the wheels and the lower and upper tracks. A similar traction control arrangement is provided on the opposite right side of the front bogie 31.

An electrical control unit 342 is mounted on the outside of a rearwardly extending portion of the frame member 326 and is connected through conductors of a cable 343 to the five illustrated contact shoes of the contact shoe assembly 49, for supply of electrical power to the vehicle. Unit 342 is also connected through a cable 344 to the traction control motor 42, through a cable 345 to the traction motor 44, through a cable 346 to the brake unit 46, and through a cable 347 to the junction box 51 which contains inductive coupling devices for cooperation with the transmission line assemblies 81 along the guideway. Junction box 51 is connected through conductors in a conduit 348 to a similar junction box associated with the rear bogie 32 and it also has terminals connected to a cable in a passage of the forward post 15 for supply of electrical power through the connection 13 to passenger carrying cabins, automobile platforms or other loads supported on the forward post 15 and the rearward post 16. Control unit 342 is also connected through a cable 350 to a unit similar to unit 342 and located on the opposite right side of the bogie, mounted on the outside of the frame member 348.

FIG. 19 also shows the front aerodynamic fairing 69 that is secured to the base frame of the vehicle 10 through a pair of brackets 351 and 352 each secured by three bolts to the front upwardly extending part 300 of the base frame 272. Bracket 351 appears in FIGS. 19 and 200, bracket 352 in FIG. 21, and bolt holes in part 300 for the brackets are shown in FIG. 16. A central portion 69A of the fairing extends angularly upwardly and forwardly to an upper end portion 69B that is forwardly curved as shown in FIG. 21 and it has side portions 69C and 69D that are curved forwardly from left and right sides of the central portion. The outside of left side portion 69C appears in FIGS. 19 and 20 while the inside of right side portion 69D appears in FIG. 21. The fairing 69 acts as a scoop to channel air downwardly into the region between and below the lower tracks. The fairing 69 has slots through which the cam plate mounting brackets 297 and 298 extend. The cam plate 296. which is in the path of the downwardly moved air is preferably formed with a shape such as shown in FIG. 21 to minimize interference with down flow of air.

As shown in FIG. 20, the left bearing unit 273 includes bearings 353 and 354 which are mounted in outwardly projecting tubular portions 355 and 356 of an outer housing member 358 of the unit 273 and which journal shafts 359 and 360 for the lower and upper traction wheels 33 and 34 on the left side of the front bogie 31. Another outwardly projecting tubular portion 361 of the housing member 358 is journaled by a sleeve bearing 362 in a central portion of the left frame member 325 of the front bogie 31. Member 358 also supports a bearing 363 therewithin which journals a drive shaft 364. Drive shaft 364 is geared to the traction wheel shafts 359 and 360 through gears in the bearing unit 273. The drive motor 44 operates through a differential gearing assembly to drive shaft 364 and a similar shaft of the right gear unit 326.

The sleeve bearing 362 and a similar bearing for an inside housing member of the bearing unit 273 to allow the bearing unit to pivot about the axis of the shaft 364.

Preferably, the torque applied from the action of the spring 41 is large enough in relation to the weight of the vehicle 10 and any load it carries as to normally maintain the lower and upper wheels 33 and 34 in engagement with the lower and upper tracks. The bearing unit 273 then pivots only as may be necessary to accommodate any small variations that may normally occur in levels of either of the lower and upper tracks, but larger pivoting movements may occur in response to the application of abnormal vertical forces to the carrier vehicle 10 or when the vehicle moves through Y junctions.

To place limits on pivoting of the bearing unit 273, pins 365 and 366 project from the housing member 358 for engagement by the frame member 325 of the bogie. Pin 365 limits upward movement of the upper traction wheel 34 in Y junctions, where the upper tracks cannot cross under guideway slots and, where as has been noted, tracks such as tracks 243 and 244 of the Y junction 220 shown in FIGS. 11–13 are sloped upwardly to allow upper wheels to be gradually moved upwardly by traction control springs until reaching a limit position.

The frame structure of the carrier vehicle 10 is shown in part in FIG. 20 but are more clearly shown in FIG. 21 which also shows further features of construction of the front bogie. The base frame 272 includes a lower longitudinally extending part 367, the front part 300 that extends upwardly from the forward end of the lower part 367 and an upper part 368 that extends longitudinally and rearwardly from the upper end of the part 300. The upper part 368 supports forward and rearward blocks of resilient material that underlie forward and rearward portions of the frame 30, a forward block 370 being shown in FIG. 21. The frame 30 supports the forward and rearward posts 15 and 16 and it includes a longitudinally extending part 371 and forward and rearward downwardly extending parts that are resiliently secured to the front part 300 and a corresponding rear part of the base frame 272. As shown in FIG. 21, a forward downwardly extending part 372 of the frame 30 is secured to the forward base frame part through a bolt 373 that extends through an annular member 374 of resiliently deformable material, positioned in a cylindrical opening through the part 371. The upper end of the part 300 of the base frame 272 is secured to the forward end of the upper part 368 of the base frame 272 by six bolts including a center pair of bolts 375 that are shown in FIG. 21 and that are behind the part 317 of the base frame 30 and including two outer pairs of bolts that are shown in the front view of FIG. 16.

The parts 371 and 372 of the frame 30 and the post 15 are shown in FIG. 21 as being integral with each other, but it will be understood that they may be separate members that are secured together. As shown, the post 15 has a vertically extending passage 377 terminating at its lower end at transversely extending passage 378. A cable 380 extends from the junction box 51 and into the transversely extending passage 378 as shown in FIG. 20 and then, as is shown in FIG. 21, extends up through the vertical passage 377 for supplying power to and for communication with loads carried by the vehicle 10.

FIG. 21 also shows details of the universal joint 324 which includes a member 381 connected through a pin 382 to a rearward end portion 383 of the shaft 277 that is secured to the turn control member 278, the connection being such as to permit the member 381 to pivot relative to the shaft 277 about the axis of the pin 382. A spline connection is provided between the rearward end of member 381 and the forward end of the shaft 322 which connects to a similar universal joint of the rear bogie 32. The support bearing 323 for the shaft 322 is secured to the part 367 of the base frame 272.

The drive motor 44 is bolted to a plate 386 that extends between lower rearwardly extending portions of the frame members 326 and 327. Plate 386 carries a bearing 387 for a support roller 388 that rides on a lower flange 389 of a strut member 390 having an upper flange 391. Flanges 389 and 391 are secured to the lower and upper parts 367 and 368 of the base frame 272.

A central portion of the forward transverse frame bar 282 is bolted to a member 394 which forms part of an assembly that is secured between the frame members 326 and 327 by bolts 395 so as to form part of the frame of the bogie. The assembly of which member 394 is a part also forms a housing for differential gearing 396 operative to drive the drive shaft of the left bearing unit 273 and a drive shaft 397 of the right bearing unit 274. Such gearing includes a pinion 398 that is connected through a coupling 400 to a shaft of the motor 44 and that meshes with a drive gear that is not visible in FIG. 21 but which is connected to a case member 402. Case member 402 carries a pin 404 that journals two pinions 405 and 406 which mesh with a side gear 407 on the drive shaft 396 of the right bearing unit 274 and also with a side gear for the left bearing unit 273, not shown in FIG. 21.

To permit rotation of the bogie 31 about a vertical turn axis, a top pin 409 is provided that has an upper end extending into a hole in the lower surface of the upper part 368 of the base frame 272 and a lower end extending into a hole in the upper surface of the member 394. A bottom pin 410 has an upper end extending into a hole in the member 394 and a lower end extending into a hole in the upper surface of the lower part 367 of the base frame 272. A thrust washer 412 is disposed on the top pin 409 between the lower surface of frame part 369 and the upper surface of the member 394.

FIG. 22 is an elevational sectional view looking inwardly from inside an outer wall of the housing of the right gear unit. FIG. 23 is a sectional view, the left hand part being taken along an inclined plane of FIG. 22 along line 23—23, and the right hand part being taken along a vertical plane and showing parts of the differential gearing 396 used in driving the drive shaft 397 of the right gear unit 274 and the drive shaft 364 of the left gear unit 273. Drive shaft 364 carries gears 413 and 414, gear 413 being meshed with a gear 415 on the shaft 359 for the lower traction wheel 33 and gear 414 being meshed with a reversing gear 417 on a shaft 418, reversing gear 417 being meshed with a gear 420 on the shaft 690 for the upper wheel 34. The shaft 359 for the lower traction wheel 33 is thereby rotated in a direction opposite that of the drive shaft 364 while the shaft 360 for the upper traction wheel 34 is rotated in the same direction as the drive shaft 364 and the upper end of the upper wheel 34 moves in the same direction as the lower end of the lower wheel 33.

The left bearing unit 272 includes an inner housing member 422 that has a flange portion 422A which fits within an inwardly extending peripheral flange portion 358A of the outer housing member 358. The inner housing member 422 supports bearings 423 and 424 for the inner ends of the lower and upper wheel support shafts 359 and 360. An inwardly projecting portion 426 of the inner housing member 422 is journaled by a sleeve bearing 427 in an opening in a central portion of the frame member 326 of the front bogie 31. Portion 426 supports sleeve bearing 428 for an intermediate portion of the drive shaft 364. The bearings 353, 423 and 354, 424 for the lower and upper support wheel shafts 359 and 360 may preferably be roller bearings and spacer members as shown are provided within the housing of the unit 273, on the drive shaft 364 and on the lower and upper traction wheel shafts 359 and 360.

As shown in FIG. 23, the differential gearing 396 includes the side gear 407 on the drive shaft of the right bearing unit 274 and a side gear 430 on the drive shaft 364 of the left bearing unit 273, such side gears being in mesh with the pinions 405 and 406 that are on the pin 404 carried by the differential case member 402. A drive gear 432 drives the case member 402 and may be an integral part thereof as shown. Drive gear 432 is in mesh with the pinion 398 that is driven through the coupling 400 from the shaft of the drive motor 44.

A housing member 434 is secured against one side of the housing member 394 to form the housing for the differential gearing 396 and to form part of the frame structure of the bogie, the members 394 being secured between frame members 326 and 327 of the bogie by the bolts 395 (FIG. 21). Drive gear 432 and the case member 402 integral therewith have portions journaled by bearings 435 and 436 in the members 434 and 394.

The right bearing unit 274 has a construction which mirrors that of the left bearing unit and only a portion 437 of an inner housing member of the right bearing unit 274 is shown in FIG. 23. Portion 437 supports a sleeve bearing 438 for the shaft 397 and is journaled by a sleeve bearing 439 within a central portion of the inner frame member 327 on the right side of the bogie 31.

FIG. 24 is an elevational sectional view taken substantially along line 24—24 of FIG. 21, looking forwardly from a position behind the bearing units 273 and 274. FIG. 24 shows the position of the member 340 which is engaged by the lower end the traction control spring 41 for the left bearing unit 273. Member 340 projects rearwardly from the outer housing member 358 of the bearing unit 274. A similar member 440 as shown projects rearwardly from an outer housing member of the right bearing unit 274, for engagement by a spring of a traction control assembly for the right side which is similar to the assembly which has been described for the left side.

As shown in FIG. 24, the left side transmission line assembly 81 includes outer and inner portions 441 and 442 and the right side transmission line assembly 82 includes outer and inner longitudinally extending portions 443 and 444 in spaced relation, the spacing of the outer portions 441 and 443 from the center of the vehicle being greater than that of the inner portions 442 and 444.

Figures 25, 26:
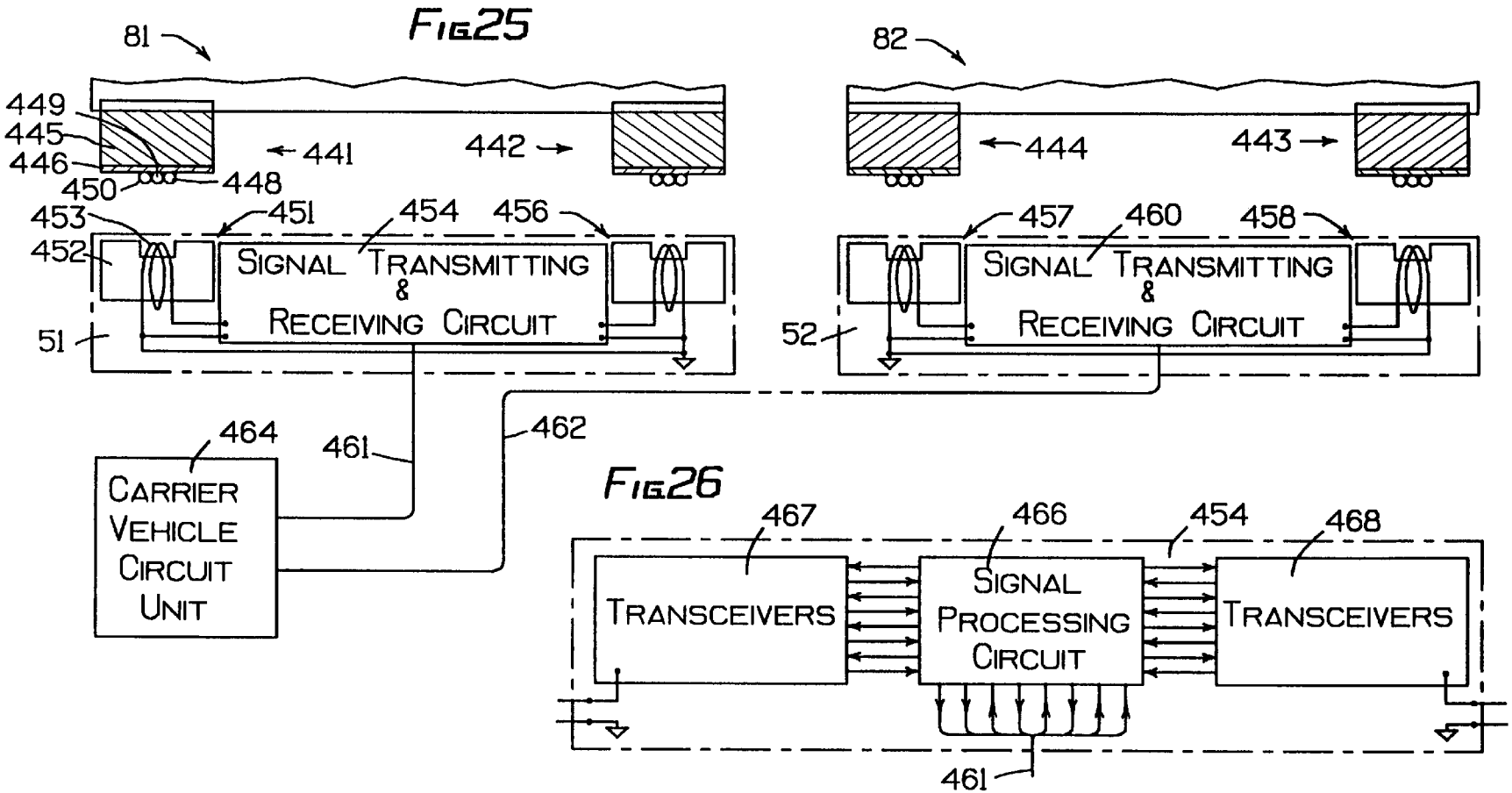
FIG. 25 is a view illustrating transmission line structures, inductive coupling devices and associated circuits.
FIG. 26 is a block diagram of a signal transmitting and receiving circuit of FIG. 25.
Figure 27:
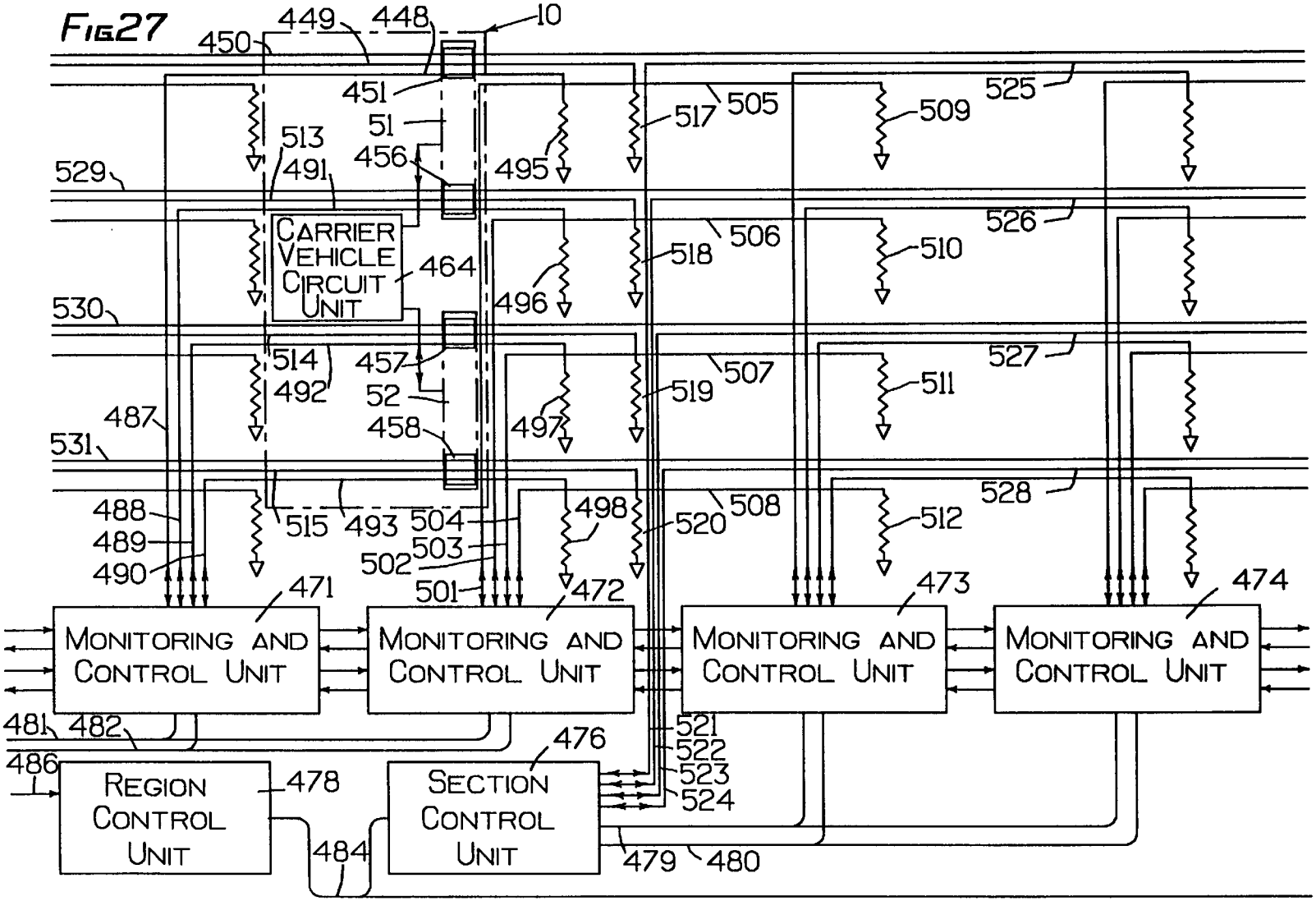
FIG. 27 is a diagrammatic plan view showing the inductive coupling devices of FIG. 25 coupled to a circuit unit of the carrier vehicle and providing a block diagram of connections of monitoring and control units to transmission line structures and to section and regional control units.

Carrier Vehicle-Guideway Signal Interchange System (FIGS. 25–27)

FIG. 25 shows the construction of the transmission line portions 441–444 and also diagrammatically shows the arrangement of the inductive coupling devices within the junction boxes 51 and 52 that cooperate with the portions 441–444 in wireless transmission of data between the carrier vehicle 10 and monitoring and control units along the guideway.

The portion 441 includes a member 446 of conductive material having on its underside a layer 447 of insulating material with conductors on the underside of the layer 447, three conductors 448, 449 and 450 being shown. The lengths of the conductors 448–450 may be and typically are different but each extends a substantial distance along the guideway and each cooperates with the member 445 and layer 446 and to provide a transmission line having a characteristic impedance determined by the diameter of the conductor and the thickness and dielectric constant of the layer 447.

Each conductor may be connected to a signal source and/or to a receiving circuit along the guideway. When the carrier vehicle 10 is within the guideway, each conductor may be inductively coupled to device 451 within the junction box 51 of the carrier vehicle in proximity to a portion of the conductor along its length. The illustrated device 451 includes a core 452 which is preferably of a low loss high permeability magnet material and which has ends in spaced facing relation to the transmission line portion 441 and on opposite sides of a vertical plane through the conductors 448–450. A coil 453 on the core 452 is connected to signal transmitting and receiving circuits 454.

The construction of each of the other transmission line portions 442–444 is like that of the portion 441. A second inductive coupling device 456 is provided within the junction box 51 in a position opposite the transmission line portion and is connected to the circuits 454. Similarly, devices 457 and 458 are disposed within the right side junction box 52 and are connected to signal transmitting and receiving circuits 460 therewithin. The portions of the junction boxes 51 and 52 that are opposite the devices 452, 456, 457 and 458 are either open or of a non-magnetic and low conductivity material but remaining portions are preferably of a high conductivity metal for shielding purposes.

The circuits 454 and 460 are connected through buses 461 and 462 to a carrier vehicle circuit unit 464, for application of signals to the circuit 464 to control vehicle speed and movements and for application of signals from vehicles to circuits along the guideway for control and monitoring of operations. Details of such signals are discussed hereinafter in connection with FIGS. 28 and 29. Because of the close spacing between the transmission line conductors and the inductive devices, energy transmission is obtained primarily through inductive coupling or transformer action rather than through radiation and is highly efficient. When a signal is applied to any one of the conductors, a corresponding signal is developed by the device in proximity thereto and applied to the circuits 454 or the circuits 460 to be amplified if necessary and otherwise processed by the circuits 454 or 460. When a signal is applied from one of the circuits 454 or 460 to an inductive device connected thereto, a corresponding signal is developed in each the conductors 448–450 and may be processed by circuits connected to the conductor.

FIG. 26 is a block diagram of the signal transmitting and receiving circuits 454, the circuits 460 having the same configuration. Circuits 454 include signal processing circuits 466 connected to eight transceivers in two groups 467 and 468, four being connected to the device 451 and four being connected to the device 456. The transceivers 467 and 468 operate transmit and receive at a number of frequencies to provide a number of channels for transmission of data in each direction, it being possible to use each transmission line conductor to send a signal at one frequency while receiving at a different frequency and to use a frequency or frequencies for each conductor that may be different from that or those used by each other conductor to provide a number of non-interfering signal channels. Time and code multiplexing, spread spectrum and other techniques may also be used to obtain multiple channels and to minimize interference.

In FIG. 27, the carrier vehicle 10 and the junction boxes 51 and 52 and inductive devices 451, 456, 457 and 458 are shown diagrammatically in broken lines in relation to transmission line conductors that include the conductors 448–450 and that extend along a portion of a guideway. The guideway may be divided into sections for monitoring and control purposes and the vehicle 10 may be assumed to be moving to the right and approaching the end of one section and the beginning of another section.

Four monitoring and control units 471, 472, 473 and 474, a section control unit 476 and a region control unit 478 are shown. Monitoring and control units 473 and 474 are connected through busses 479 and 480 to the section control unit 476 while monitoring and control units 471 and 472 are connected through busses 481 and 482 to a preceding section control unit that is not shown.

The section control unit 476 is additionally coupled to the region control unit 478 through a bus 484 which is coupled a number of other section control units like the unit 476 including a section control unit to which the monitoring and control units 471 and 472 are connected through the busses 481 and 482. The region control unit 478, in turn, is coupled to a central control unit, not shown, through a bus 486 which is coupled to other region control units in the system.

Reports of activity in the region assigned to each region control unit are transmitted to the central control unit, which maintains current data as to the location of each carrier vehicle and each body being transmitted, as well as a history of movements thereof, to facilitate efficient performance of traffic control, billing, maintenance and other functions.

The monitoring and control units 471–474 are assigned to portions of the guideway 492 which may be of various lengths. For example, along a straight length of guideway in open country, a portion to which one unit is assigned may have a length of 15 feet or more while in parts of the guideway where loading and unloading operations take place, a portion to which one unit is assigned may have a length of one foot or less.

The section control unit 476 is typically connected to a considerable number of monitoring and control units and is operative with respect to a long length of a guideway in open country or with respect to a relatively short length where switching and/or loading and unloading operations take place. In general, one section control unit is assigned to each portion of a guideway in which either a switching operation or a loading/unloading operation takes place. For each direction of travel through the portion of the system illustrated in FIGS. 1 and 2, one region control unit such as unit 478 is provided, each region control unit being coupled to approximately 12 section control units.

The conductor 448 of the transmission line portion 441 operates as a monitoring and control conductor and is connected to an input/output line 487 of the monitoring and control unit 471. Three other input/output lines 488, 489 and 490 of the unit 471 are connected to ends of three other monitoring and control conductors 491, 492 and 493 of the transmission line portions 442, 444 and 443. The other ends of the monitoring and control conductors 448, 491, 492 and 493 are connected to circuit ground through resistors 495, 496, 497 and 498 that may preferably have values equal to the characteristic impedances of the transmission lines formed by such conductors.

During the time that the devices 451, 456, 457 and 458 are moving along the length of the monitoring and control conductors 448, 491, 492 and 493, which may be fifteen feet for example, signals containing speed data may be transmitted from the input/output lines 487–490 and through such conductors to be received through the inductive devices 451, 456, 457 and 458 and applied to the carrier vehicle circuit unit 464. During the same time, but on a different carrier frequency, signals containing data as to the speed of the vehicle 10 may be transmitted in the opposite direction from the carrier vehicle circuit unit 464 and to the monitoring and control unit 471. Data that identifies the vehicle 10, data as to its route and/or other data may also be transmitted to the monitoring and control unit 471.

The monitoring and control unit 472 has four input/output lines 501–504 that are connected to another group of monitoring and control conductors 505–508 of the transmission line portions 441, 442, 444 and 443, such conductors being terminated by resistors 509–512. As the vehicle 10 moves to the right from the position shown in FIG. 27, the inductive coupling devices 451, 456, 457 and 458 move into proximity with portions of the monitoring and control conductors 505–508 but continue for a time to be in proximity to the conductors 448 and 491–493, an overlap being preferably provided as is shown diagrammatically. An overlap of one foot may be provided by using a conductors having a length of sixteen feet when, for example, the spacing distance of monitoring and control units is fifteen feet. This insures uninterrupted transmission of signals in both directions.

In a similar fashion and as is shown in part in FIG. 27, input/output lines of monitoring and control units 473 and 474 and other units along the guideway are connected to monitoring and control conductors that are like the group of conductors 448 and 491–493 and the group of conductors 505–508, all being terminated by resistors like resistors 495–498 and 509–512.

The conductor 449 of the transmission line portion 441 and similar conductors 513–515 of the transmission line portions 442, 444 and 443 are terminated by resistors 517–520. Such conductors operate as section conductors and are connected to input/output lines of a section control unit which is like the unit 476 but assigned to a preceding section of the guideway. The section control unit 476 has input/output lines 521–524 connected to additional section conductors at points close to the terminal ends of the section control conductors 449 and 513–515. An overlap may be provided, if desired. Section conductors 525–528 are terminated by resistors that are not shown but that are at the end of a section to which unit 476 is assigned. Such section conductors 449, 513–515 and 525–528 may be used for various purposes. As vehicles move through a section, they may continually send data to the corresponding section control unit which identifies the carrier vehicle, any body carried by the vehicle and the route to be followed by the vehicle through the system. The section conductors may also be used for transmitting control and other data to a carrier vehicle. When leaves one section to enter a new section, the control unit of the new section after receiving complete data from the vehicle, may assign abbreviated ID data to the vehicle and send it to the vehicle for use while moving through the section.

Conductor 450 of the transmission line portion 441 and similar conductors 529, 530 and 531 of the transmission line portions 442, 444 and 443 are central conductors connected to a central control unit, not shown, and may extend for a long distance, with repeated stations therealong if necessary. They may be used for various purposes including the transmission of signals containing control and warning data to a vehicle in an emergency and the transmission of signals containing calls for help or information from an occupant of cabin or automobile carried by a vehicle.

Figure 28:
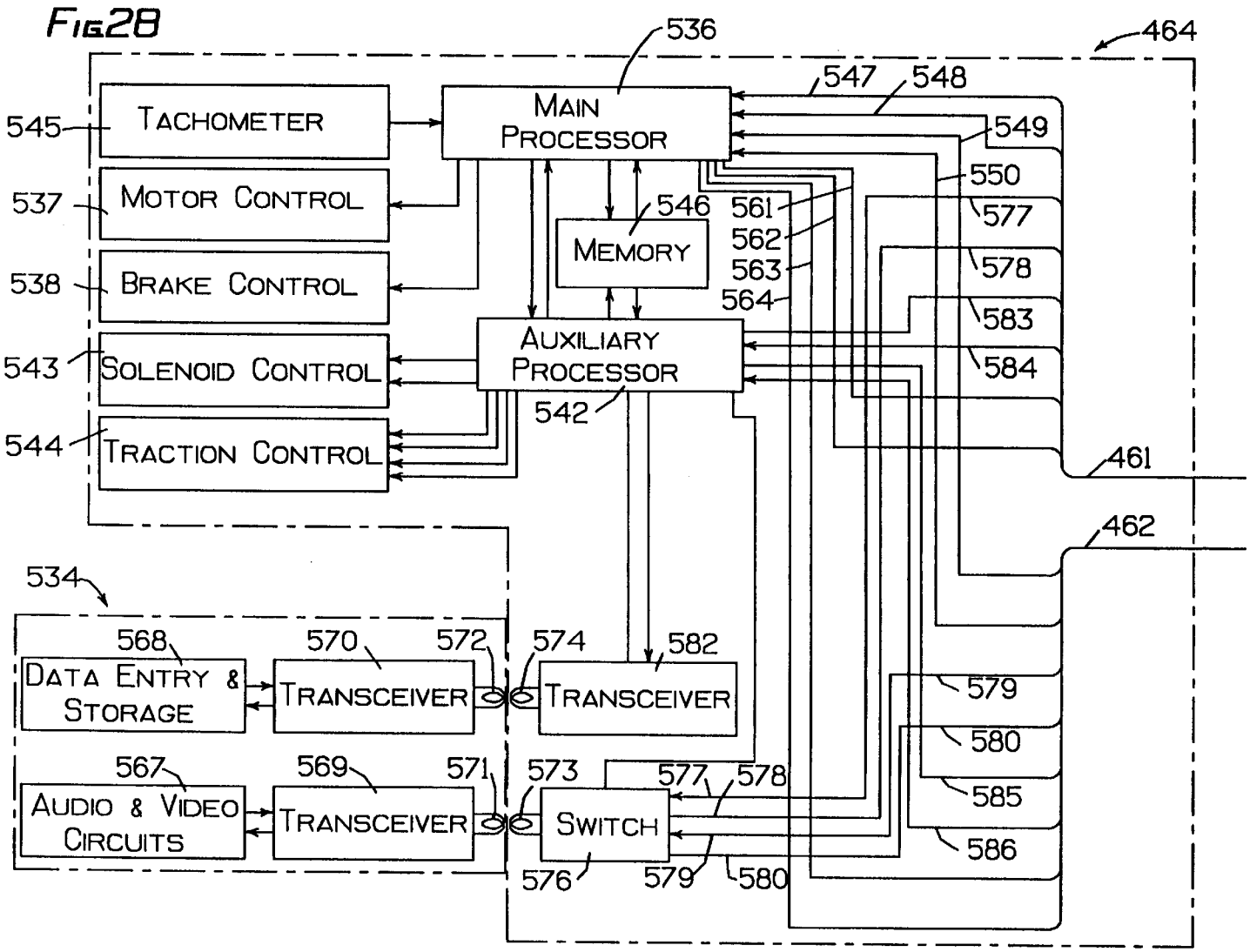
FIG. 28 is a schematic block diagram of a carrier vehicle circuit unit.

Carrier Vehicle Circuit (FIG. 28)

FIG. 28 is a block diagram of the carrier vehicle circuit unit 464 and of a circuit 534 of a body carried by the carrier vehicle 10. A main processor 536 is connected to a motor control circuit 537 and a brake control circuit 538 for control of the drive motor 44 and brake 46 of the front bogie 31 and a corresponding drive motor and brake of the rear bogie 32. An auxiliary processor 542 is connected to a solenoid control circuit 543 and a traction control circuit 544 for control of the switching control solenoids 283 and 284 and traction control motor 42 and 42A of the front bogie 31 and corresponding switching control solenoids and traction control motors of the rear bogie 32. The main and auxiliary processors 536 and 542 are interconnected for interchange of signals and are connected to a common memory circuit 546 that may be accessed by either processor for storage and retrieval of data.

The main processor 536 receives speed data from a tachometer 545 and has input ports connected to lines 547–550 of the bus 461 for receiving data developed by the left and right side signal transmitting and receiving circuits 454 and 460. Such data include messages that are developed by monitoring and control units and that include speed command data to be used by the vehicles in controlling the speeds of movement thereof. Such messages are transmitted serially in the form of signals modulated by digital data, being transmitted through monitoring and control conductors of the guideway from monitoring and control units such as units 471–474 shown in FIG. 27. In response to such signals, the circuits 454 and 460 develop corresponding data that are sent through lines 547–550 to the main processor 536 which then processes such data by comparing speed command data with carrier vehicle speed data developed by the tachometer 545 to send appropriate control data to the motor and brake control circuits 537 and 538.

The main processor 536 also repetitively develops a message for transmission to monitoring and control units such as units 471–474 as the carrier vehicle 10 moves therealong. Each message includes digital data that correspond to the speed of movement of the carrier vehicle and digital "ID" data that identify the carrier vehicle. To transmit such data, the main processor 536 has output ports connected to lines 561 and 562 of bus 461 and to lines 563 and 564 of the bus 562 for sending data to the left and right side signal transmitting and receiving circuits 454 and 460 which develop and transmit signals to repetitively and serially transmit digital data through monitoring and control conductors to monitoring and control units such as the units 471–474 shown in FIG. 27. Each monitoring and control unit processes such data in a manner as hereinafter discussed to develop data including the aforementioned control data for transmission to passing vehicles.

For maximum reliability, it is desirable that monitoring and control units receive at least several complete messages during the time interval in which a carrier vehicle traveling at maximum speed passes through the length of the guideway which is assigned to one of the monitoring and control units. It is thus desirable to use a bit rate of serial transmission of the digital data which is as high as possible without sacrificing reliability and it is also desirable to minimize the length of the message. As hereinafter described, each section unit assigns identification data to each carrier vehicle entering the guideway section monitored by the unit for temporary use while the carrier vehicle moves through the section, and such temporary ID data are abbreviated in relation to complete identification data which distinguishes the carrier vehicle from all other carrier vehicles in the transportation system.

In sending messages to carrier vehicles, different communication channels, operative at different carrier frequencies, for example, are used by adjacent monitoring and control units. A channel designated as a #1 channel may be used in transmitting signals from monitoring and control units 471 and 473 while a #2 channel may be used in transmitting signals from monitoring and control units 472 and 474. Each of the signal transmitting and receiving circuits 454 and 460 develops output data from both channels and applies such data through lines 547 and 548 or lines 549 and 550 that are connected to separate input ports of the main processor 536. With an overlap of conductors as aforementioned, data are received from one channel before data are no longer received by the other and information is provided to the carrier vehicle as to the location of the overlapping conductor portions. The data applied to the motor control circuit 537 are such that there is no attempt to abruptly accelerate or decelerate the vehicle in response a difference, which may sometimes be quite large, between new speed command data received from one channel and old speed command data received from the other. Instead, speed is changed at a rate which is a function of both the magnitude of the difference and the speed of travel of the vehicle.

The circuit 534 that is on a body carried by the vehicle 10 may include audio and video circuits 567 and a data entry and storage circuit 568 which are coupled through transceivers 569 and 570 to coils 571 and 572 that are inductively coupled to coils 573 and 574 when the body which carries the circuit 534 is secured to the carrier vehicle. Other interfaces may be used including direct connections and optical couplings.

The auxiliary processor 542 is connected through a control line 575 to a switch circuit 576 which couples the coil 573 to either a pair of lines 577 and 578 of the bus 461 for the left side of the vehicle or a pair of lines 579 and 580 of the bus 462 for the right side of the vehicle. The coil 574 is connected through a transceiver 582 to the auxiliary processor 542. The auxiliary processor has output and input ports connected to lines 583 and 584 of the left side bus 461 and output and input ports connected to lines 585 and 586 of the right side bus 462.

The audio and video circuits 567 are usable for receiving radio and television communications on the body that includes the circuit 534 which may be a passenger carrying body, for example. Telephone communications and fax communications may also be accommodated.

Through the data entry and storage circuit 568, data are transmitted to the auxiliary processor which include body ID data distinguishing the body that carries the circuit 534 from other bodies of the transportation system and route data identifying the route to be followed by the vehicle 10 in moving through the system. A passenger on a passenger carrying body may enter data to change the route data to stop at a previously unscheduled stop, for example. Communications may also be transmitted from the auxiliary processor 542 to the data entry and storage circuitry, which may operate a digital display or an audible signalling device.

The auxiliary processor 542 stores data obtained from the data entry and storage circuit 568 in the memory 546 which can be accessed by the processor 542 and sent to section control units such as unit 476 through section the signal transmitting and receiving circuits 454 and 460 and through section conductors such as the conductors 449 and 513–515 or 525–528.

Output ports of the auxiliary processor 542 are coupled to solenoid control circuit 543 for control of the solenoids 283 and 284 of the front bogie 31 of the carrier vehicle 10 and similar solenoids of the rear bogie 32 to control steering of the carrier vehicle 32. When the direction of steering is changed, the switch 576 is also operated to a corresponding position to appropriately couple either the lines 577 and 578 or the lines 579 and 580 to the transceiver 569 on the body that carries the circuit 534.

The auxiliary processor 542 also has output ports connected to the traction control circuit 544 for control of the traction control motors 42 and 42A of the front bogie 31 and corresponding traction control motors of the rear bogie 32.

Figure 29:
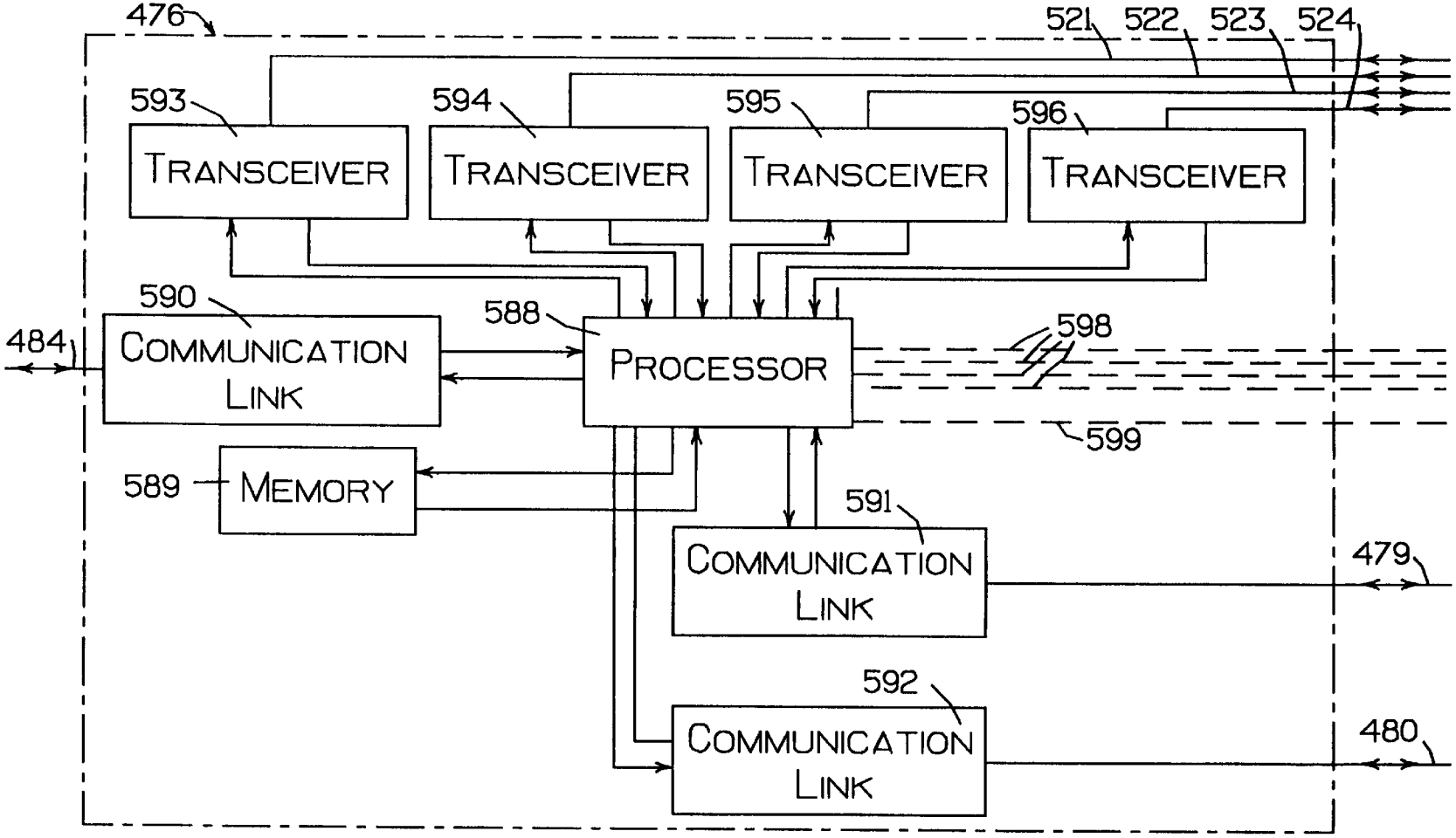
FIG. 29 is a schematic block diagram of the section control unit shown in block form in FIG. 27.

Section Control Circuit (FIG. 29)

FIG. 29 is a block diagram of circuitry of the section control unit 476 which includes a processor 588 connected to a memory 589 and coupled through a communication link 590 and the bus 484 to the region control unit 478. Processor 588 is also connected through communication links 591 and 594 and the buses 479 and 480 to the monitoring and control units of the section being controlled, including the units 473 and 474. In addition, the processor 588 is coupled through transceivers 593–596 to the lines 521–524 that are connected to the section conductors 525–528.

The circuit of the section control unit 476 as shown in FIG. 29 may be used in control of a special weighing section in which a vehicle may be weighed and as indicated by dashed lines 598, the processor 588 may optionally be connected to strain gauges as hereinafter described that are part of a weighing circuit of the weighing section. Another dashed line 599 may also be used in connection with the weighing operation.

Figure 30:
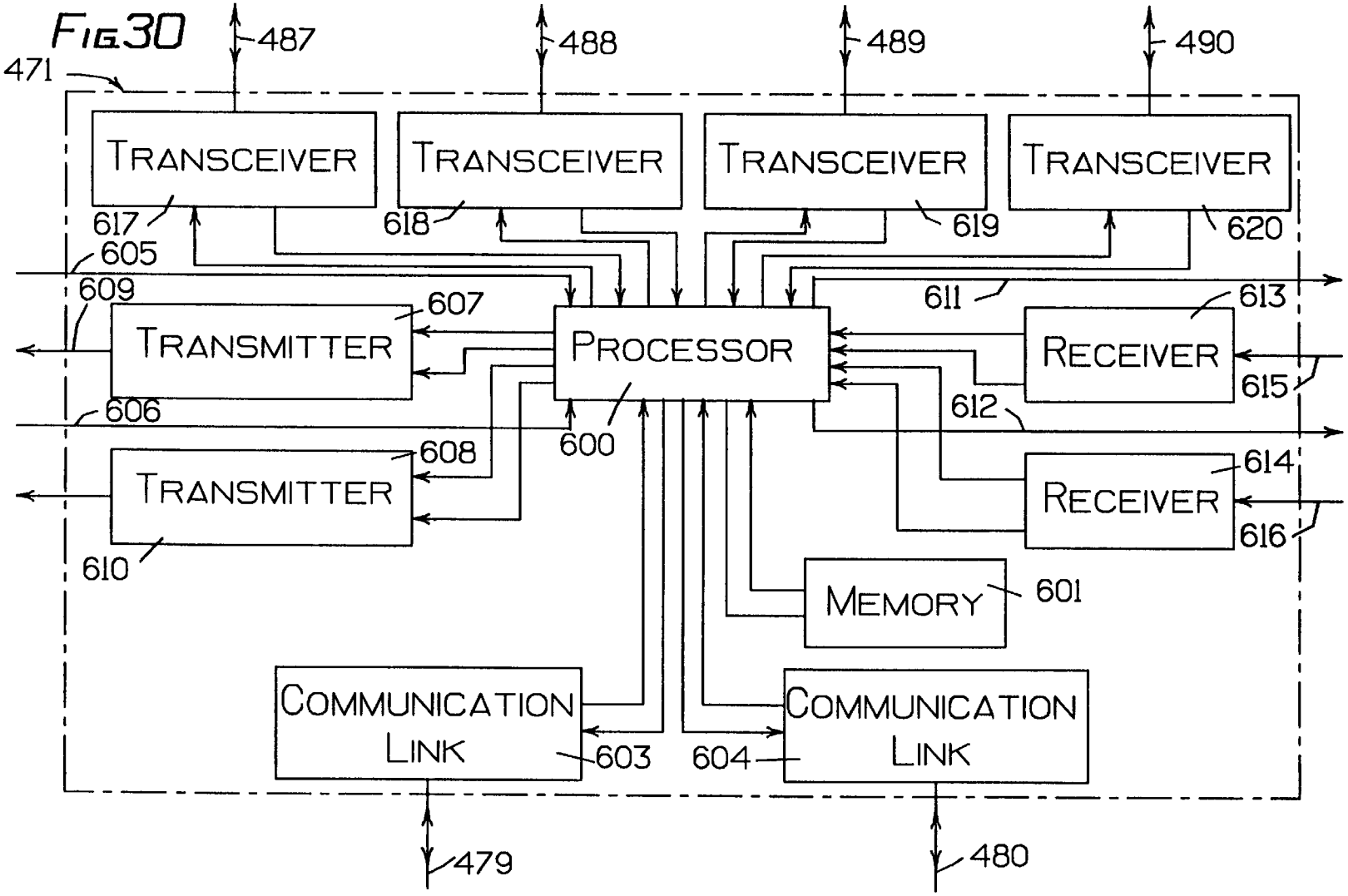
FIG. 30 is a schematic block diagram of one of the monitoring and control units shown in FIG. 27.

Monitoring & Control Unit Circuit (FIG. 30)

FIG. 30 is a block diagram of a circuit of the monitoring and control unit 471 which is the same as other monitor and control units. The unit 471 includes a processor 600 connected to a memory 601 and coupled through communication links 603 and 604 and the busses 479 and 480 to the section control unit 476. The processor 600 has input ports connected through lines 605 and 606 to a monitoring and control unit which precedes or is behind the monitoring and control unit 471 and has output ports connected to transmitters 607 and 608 to transmit data through lines 609 and 610 to the preceding monitoring and control circuit. Output ports of the processor are connected through lines 611 and 612 to the subsequent monitoring and control unit 472 that is ahead of the unit 471 in the illustrated arrangement, and input ports are connected to outputs of receivers 613 and 614 that have inputs connected through lines 615 and 616 to the subsequent monitoring and control unit 472. Additional input and output ports of the processor 600 are connected through transceivers 617–620 and through the input/output lines 487–488 to the monitoring and control conductors 448 and 491–493.

The transmitters 607 and 608 and receivers 613 and 614 operate in transmitting and receiving serial data and each may be equivalent to one-half of a conventional UART, for example. More direct couplings may be used instead of serial transmitters and receivers, particularly when the distance between monitoring and control units is small as is the case in sections used for loading and unloading of vehicles.

Figure 31:
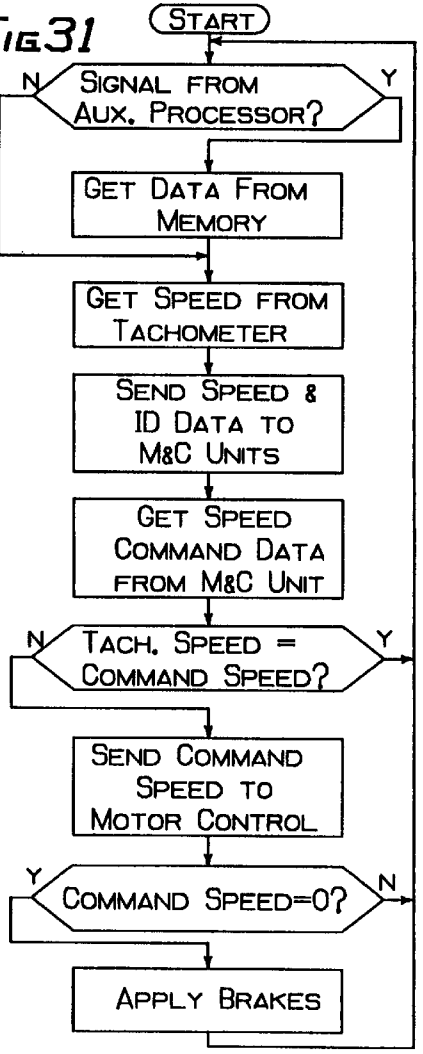
FIG. 31 is a flow diagram illustrating the operation of circuitry of the carrier vehicle.

Operation of Carrier Vehicle Unit (FIG. 31)

FIG. 31 is a flow chart illustrating the operation of the main processor 536 of the circuit unit 464 of the carrier vehicle 10. At start, the processor checks for a signal from the auxiliary processor 542 which is applied when new data are available such as new temporary ID data to be used by the carrier vehicle 10 in continually sending data to monitoring and control units along the guideway.

After getting any new data which is available, data corresponding to the speed of the vehicle is obtained from the tachometer 545 and then speed and ID data are transmitted through lines 561 and 562 and/or lines 563 and 564. Usually, all lines are used in transmitting redundant data which are compared by the monitoring and control units to detect possible errors and malfunctioning of equipment.

Next, speed command data are obtained from the nearest of the monitoring and control units along the guideway. Such data are compared with data obtained from the tachometer 545. If there is a difference or also if the command speed is zero, the command speed data are sent to the motor control circuit 537 to correct the speed of the vehicle and if the command speed is zero, a signal is sent to the brake control circuit 538 to operate the brake 46 of the front bogie and the corresponding brake of the rear bogie.

Figure 32:
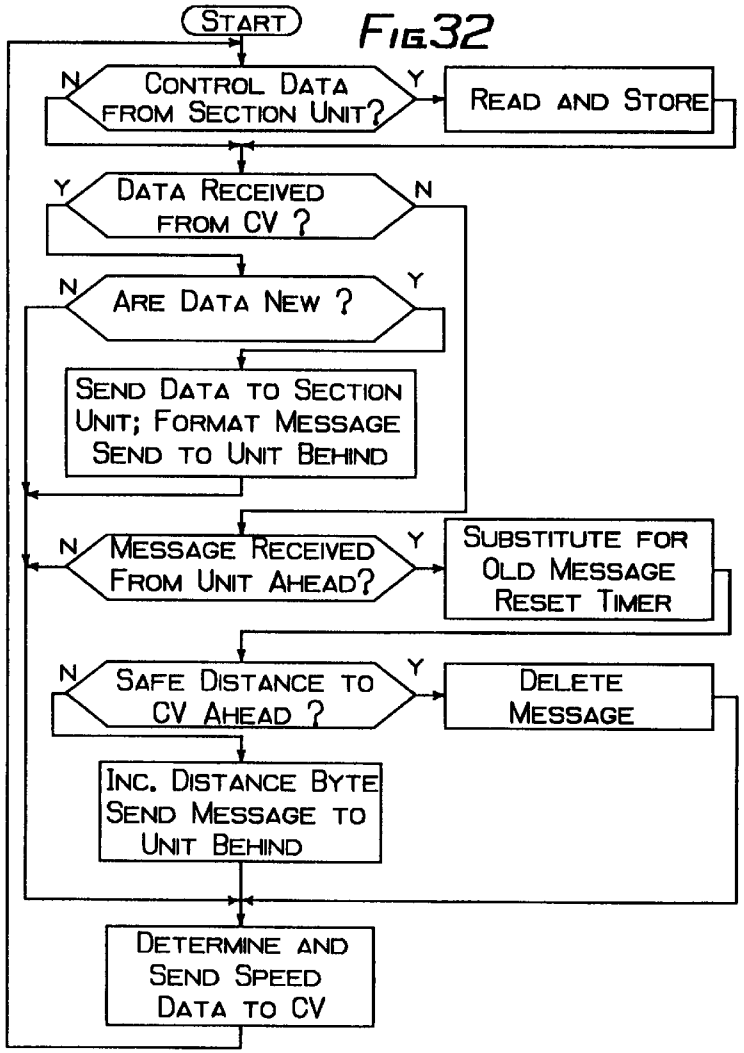
FIG. 32 is a flow diagram illustrating the operation of circuitry of a monitoring and control unit.

Operation of Monitoring & Control Unit (FIG. 32)

FIG. 32 is a flow diagram illustrating the operation of the processor 600 of the monitoring and control unit 471. First, the processor obtains and stores any new control data which may be available from a section control unit such as unit 476 for the section in which the vehicle is located. Such data may include new maximum speed data which may dictate a lower speed of operation along a guideway when, for example, weather conditions are such that operation at high speeds is unsafe.

Next a check is made for new data from a passing carrier vehicle. If new data are obtained, a report thereof is sent to the section unit and then messages are formatted and sent to the unit behind using the transmitters 607 and 608 and lines 609 and 610. Each transmitted message includes speed data which may be in the form a single 8-bit byte of data, but is preferably in the form of two 8-bit bytes of data for greater accuracy. Each message also includes data which will be referred to as the distance byte and which is initially set at zero, or some other certain value, in the originating monitoring and control unit. The message is passed along serially in a rearward direction along the guideway and the distance byte is incremented each time the message is passed so that the distance byte identifies the originating unit. If, for example, the effective spacing between units is 15 feet and the byte which originally had a zero value has been incremented in one unit increments to five, the receiving unit is supplied with data indicating that the distance to the originating unit is the product of five plus one and fifteen or 90 feet. Preferably, any delays in passing the message along are insubstantial, but any substantial delays can be taken into account by a receiving unit.

As shown in the flow diagram, when a message is received, it is substituted for any old message that may exist and a timer which is placed in a reset condition. Then a determination is made as to whether, for the purpose of determining whether to pass on the message, there is a safe distance ahead to the carrier vehicle which was just detected to originate the message. The distance to the originating unit is determined as discussed above. Whether or not it is safe to avoid passing on the message depends upon the value of the speed data in the message. If the speed data shows that the detected carrier vehicle is travelling at a high speed, there may be no need to pass the message on even though the distance is relatively short. On the other hand, if the detected carrier vehicle is travelling at a low speed or is stopped, the distance must be quite large before it is safe to not pass the message. Accordingly, the safe value of the distance byte increases in inverse relation to the speed indicated by the speed data.

If it is determined that the message should be passed on, it is sent to the unit behind after incrementing the distance byte.

Finally, the processor 600 of the monitoring and control unit 471 determines command speed data and sends it to any carrier vehicle that may be passing by the unit 471. The command speed data are determined either from maximum speed data or from data in a message from a unit ahead including data corresponding to the distance to and speed of a carrier vehicle ahead. When determined from data in a message, the command speed data will require a decreased speed when the vehicle is too close to the vehicle ahead and will require an increase in speed when the speed when the vehicle is too far behind the vehicle ahead, unless the speed is already at a speed set by the maximum speed data which may either have a default value or a value determined from data received from a section control unit.

The distance to a unit which has detected a carrier vehicle ahead is determined from the distance byte of a pending message in the manner as discussed above but does not indicate the distance to the vehicle which may have moved since the message was originated and received. To more accurately determine the distance to the vehicle a distance is added equal to the product of the speed of the vehicle and the elapsed time indicated by the aforementioned timer which was reset at the time when the pending message was originally received.

The command speed data are increased as a function of the maximum speed data, as a function of the speed of the vehicle ahead and as a function of the distance to the vehicle ahead, to obtain a certain following distance for each speed of the vehicle ahead. It is also dependent upon the capabilities of the carrier vehicle, including the responsiveness and reliability of its drive components and control circuitry and braking distances which can be safely and reliably obtained with all vehicles of the system. As examples of the considerations that are involved, if the maximum speed is 150 feet per second and the speed of the vehicle ahead is also 150 feet per second and the distance to the vehicle is 150 feet, a command speed of 150 feet per second might be quite safe. However, if the distance to the vehicle ahead is only 75 feet, it may be desirable that the command speed be reduced to less than 150 feet per second to slow down any passing carrier vehicle and increase its distance to the vehicle ahead. If the speed of the vehicle ahead is very low or if the vehicle ahead is stopped, it may not be safe to send a command speed equal to the maximum speed until the distance to the vehicle ahead is quite large and substantially greater than a braking distance which can be safely obtained with the vehicle.

Figure 33:
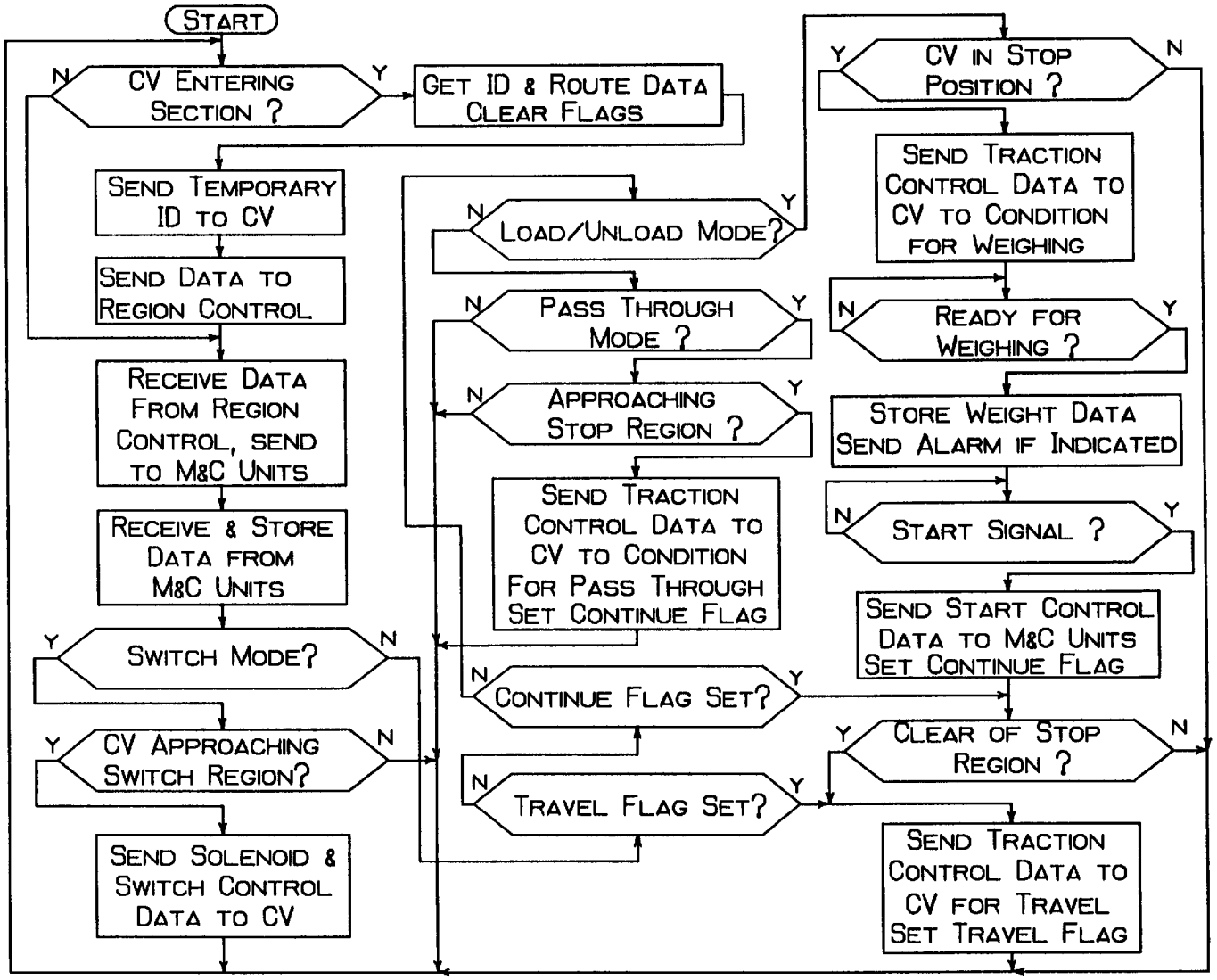
FIG. 33 is a flow diagram illustrating the operation of a section unit.

Operation of Section Control Unit (FIG. 33)

FIG. 33 is a flow diagram illustrating the operation of the processor 588 of the section control unit 476. The flow diagram as shown is for a general purpose processor for section units capable of four different modes of operation, including a standard mode in which no switching or loading/unloading operations may take place and a switch mode of operation in which the monitored and controlled section of the guideway controlled has a switch region in which the direction of travel of the vehicle may be selectively changed. It is also capable of two additional modes of operation for a section of a guideway constructed for loading/unloading operations. One of such additional modes is a load/unload mode for performance of such loading/unloading operations and the other being a "pass through" mode a vehicle passes through such a section but in which no loading/unloading operations take place therein.

The operation of the processor 588 of the section control unit 476 starts with a determination of whether a carrier vehicle (CV) is entering a section, performed by monitoring data transmitted from the first monitoring and control unit of the section, for example by data transmitted through the bus 479 or 480 and from the unit 473 in FIG. 27. When such data are detected, control data are transmitted to the auxiliary processor 542 of the carrier vehicle through the transceivers 593–596, lines 521–524, section conductors 525–528 of the guideway, devices 451 and 456–458, circuits 454 and 460 and bus lines 583 and 585. The auxiliary processor 995 responds by using lines 584 and 586, circuits 454 and 460, devices 451 and 456–458, conductors 525–528, lines 521–524 and transceivers 593–596 to send complete identification data for the carrier vehicle and for any body which may be carried by the vehicle, also route data defining the route which the vehicle is programmed to follow through the system.

Then certain flags are cleared and the same channels are used to send abbreviated ID data, usually not more than a single 8-bit byte of data, to the carrier vehicle to temporarily identify the vehicle while it is passing through the section to which the unit 476 is assigned. The auxiliary processor 542 then sends a signal to the main processor 536 to signal the existence of new temporary ID data in the memory 546. It is noted that the use of temporary ID data is desirable in guideway sections in which a number of vehicles may be present at the same time. However, the use of such data may not be required as to many sections such as loading/unloading sections and some switching section which have a short length such that no more than one vehicle will normally be in the section at the same time.

After sending the temporary ID to the carrier vehicle, data are sent to the region control unit 478 through the communication link 590 and bus 484 and control data may be received back through the same channel to be sent to the monitoring and control units through communication links 591 and 592 and buses 479 and 480 which may then be used in transmitting data to the section control unit 476 to be stored in the memory 589.

As shown in the flow diagram, a series of test may then be made to determine modes of operation and the condition of certain flags and if the results of all such tests are negative, the operation of the processor 588 returns to the start point. This is what may be described as the "normal" operation for sections of the guideway in which no switching or loading/unload operations are to take place. For such sections, the mode and flag tests and related operations are unnecessary and may be eliminated. Similarly, the switch mode test and related operations may be eliminated for a section designed for only loading/unloading operations and the loading/unloading, pass through and flag tests may be eliminated for a section designed for switching operations.

With respect to switching operations, a switch mode test may be made to determine whether any switching operation is necessary, determined from the route data obtained from the carrier vehicle and data obtained from the vehicle as to the condition of the guide wheel assemblies. If a switching operation is necessary, solenoid and switch control data are sent to the carrier vehicle, after first obtaining a positive response to a test to determine whether the carrier vehicle is approaching a switch region at which the vehicle is to be switched to from one path to another. Such a test is made from monitoring the data received from the monitoring and control units along the section and which show the positions of vehicles moving along the section. It is noted that in a section containing only a single switch, no test is necessary and the solenoid and switch control data may simply be sent to the carrier vehicle to effect energization of the proper solenoids and switching of the switch 576 to the proper condition.

Figures 34, 35, 36:
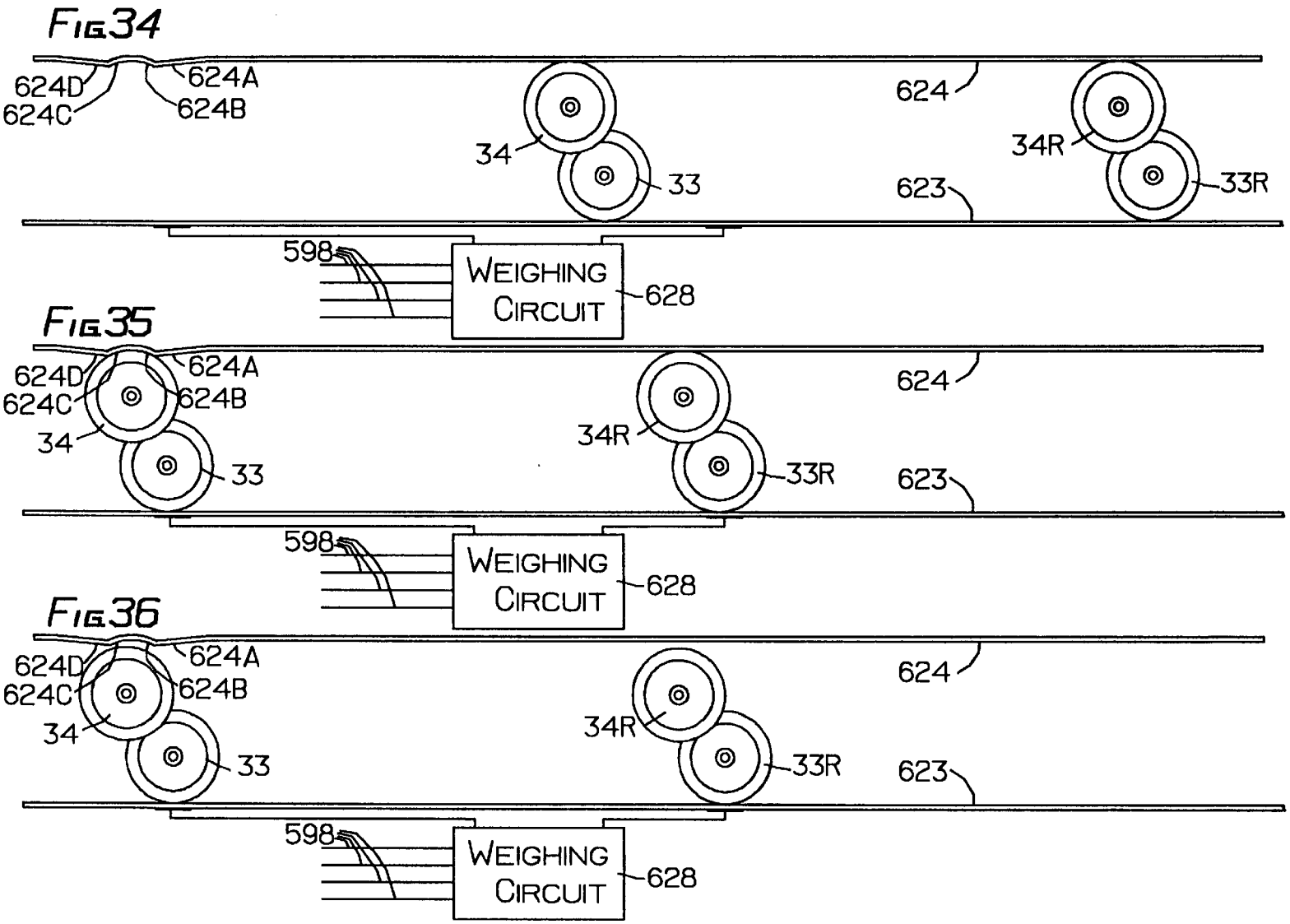
FIGS. 34–36 depict the positions of wheel structures of a carrier vehicle during loading/unloading operations in a region at which a body may be transferred between a transfer vehicle and the pads of a carrier vehicle positioned thereat or at which a passenger-carrying body is in a passenger loading/unloading position.

Weighing Operations (FIGS. 34–36)

The loading/unloading and pass through modes of operation of FIG. 33 may be best understood by first considering FIGS. 34, 35 and 36 which depict the positions of wheel structures of a carrier vehicle during loading/unloading operations in a region in which a body may be transferred between a transfer vehicle and the pads of a carrier vehicle positioned thereat or such as a region where passenger-carrying body is located for pick-up and discharge of passengers.

In FIG. 34, the left side wheels 33 and 34 of the front bogie and corresponding left side wheels 33R and 34R of the rear bogie are shown in normal positions relative to lower and upper tracks 623 and 624 of the illustrated section as the vehicle approaches a loading/unloading position. In FIG. 35, the wheels are shown in positions reached in the loading/unloading position of the vehicle. In FIG. 36, the wheels are shown in positions in which they are when the vehicle is ready to move out of the loading/unloading position, such positions being the same as they are when the vehicle moves through the loading/unloading position during a pass through mode of operation.

As shown the lower track 623 is level while the upper track 624 has a pair of downwardly extending portions along its length to provide a downwardly sloped surface portion 624A, followed by an upwardly sloped surface portion 624B, followed by another downwardly sloped surface portion 624C and finally by another upwardly sloped surface portion 624D. The spring 41 of the front bogie 31 functions to exert a force urging the support for the wheels 33 and 34 in a clockwise direction about a horizontal axis midway between the axes of the wheels, normally overcoming the gravitational forces acting on the vehicle and urging the upper wheel 34 into engagement with the lower surface of the upper track 624. A similar spring performs similar functions with respect to the wheels 33R and 34R of the rear bogie. When the wheels 33 and 34 of the front bogie approach the position of FIG. 35 and the upper wheel 34 engages the surface portion 624A to be camned downwardly, the wheel support is rotated in a clockwise direction to compress the spring 41 and to develop a certain braking force on the vehicle. However, when the upper wheel 34 reaches the surface portion 624B, an opposite action takes place to develop a forward thrust moving the wheels to the position of FIG. 35. The vehicle is then accurately positioned for loading/unloading operations.

FIG. 36 shows the wheels in a position to permit weighing of the vehicle. After reaching the position of FIG. 35, the traction control motors 42 and 42A of the front bogie and corresponding motors of the rear bogie are energized in a direction to reduce the forces of the springs acting on the wheel supports, allowing rotation of the wheel supports in directions such as to allow the upper wheels to move downwardly out of engagement with the upper tracks. With reference to FIG. 20, the pin 366 limits rotation in a counter-clockwise direction of the bearing unit 273 which supports the wheels 33 and 34.

When the wheels 33, 34, 33A and 34A and those on the left side of the vehicle are in positions as shown in FIG. 36, the forces acting on the lower tracks are determined solely by the weight of the vehicle. To measure such forces, strain gauges 625 and 626 are attached to the undersides of the lower track 623 under the wheels 33 and 33R and similar strain gauges are attached to the undersides of the lower track on the other side of the guideway. All of such strain gauges are connected to a weighing circuit 628 arranged to develop digital data on lines 630 to be applied to the processor of a section control unit for the loading/unloading section. The lines 598 indicated in dashed form in FIG. 29 and in full lines in FIGS. 34–36 may be used for this purpose. After proper calibration, the weight and weight distribution of the vehicle are determined, and are used in making certain that the weight of the vehicle is not excessive and that the weight distribution is safe. The weight data are also used in controlling acceleration of the vehicle to enter a main line guideway portion.

In addition, the weight data are used in adjusting the forces applied by the springs during travel in accordance with the weight and weight distribution of the vehicle. When the vehicle is heavily loaded, maintaining the upper wheels in pressure engagement with the upper track requires that the springs exert high forces which are excessive in the case of an unloaded or lightly loaded vehicle, imposing unnecessary stresses and unnecessarily high loads on bearings. The weight data are therefore used in setting the forces applied by the respective springs during travel of the vehicle, in accordance with the weight and weight distribution data developed by the weighing circuit 628.

In moving forwardly out of the loading/unloading position, the wheels are maintained in the positions as shown in FIG. 36 until the wheels of the rear bogie are clear of the surfaces 624A–624D. Then the traction control motors are energized in a direction to increase the forces of the springs acting on the wheel supports to values determined by the weight data and to obtain a condition for continued travel.

It is noted that when the upper tracks have configurations as shown, moving a vehicle at substantial speeds through the loading/unloading region will produce shocks and stresses of the upper tracks and of the wheel supports. To avoid this problem, the wheels are lowered to positions during an initial portion of a pass through mode of operation and are raised to the travel position through operation of the traction motors only after the wheels of the rear bogie are ahead of the downwardly projecting portions of the upper tracks.

Referring again to the flow diagram of FIG. 33, if the route data requires a stop at the load/unload position, the section control unit for the loading/unloading section after receiving data from region control will initially send data the monitoring and control units such that the vehicle will be decelerated to reach zero velocity at the load/unload position. The lengths of the monitoring and control conductors are quite short in the load/unload section, six inches for example, to permit the of the vehicle to be gradually and accurately reduced and to reach zero shortly before reaching a position in which the upper wheel 34 of the forward bogie engages the surface 624B of the upper track.

As shown in the flow diagram of FIG. 33, if the test for the load/unload mode is positive, a test is made to determine whether the vehicle has reached the stop position, the test being made through examination of data from the monitoring and control unit which monitors a guideway conductor at the load/unload position.

When the vehicle reaches the stop position, traction control data are sent by the processor 588 to the carrier vehicle, through communication channels including transceivers 593–596 as aforementioned, to control the traction motors and to place the wheels in positions as shown in FIG. 36. Then weight data obtained through lines 598 from the weighing circuit 628 are stored and also examined to send an alarm if the data indicate that either the total weight or the weight distribution is unacceptable.

The processor for the load/unload section then waits for a start signal which may come from a control system for a loading/unloading facility 15 and through the region control unit 478 or which may be applied to a processor such as the processor 588 through a line 599 as indicated in dashed form in FIG. 29. When the start signal is received, data are sent to certain monitoring and control units of the load/unload section and guideway conductors forwardly therefrom for acceleration of the vehicle forwardly out of the load/unload position. A continue flag is then set.

After determining that the vehicle is clear of the stop or load/unload region, i.e. after the wheels of the rear bogie pass under the downwardly projecting portions of the upper tracks, traction control data are sent to the carrier vehicle to energize the traction control motors in a direction to increase the forces of the springs acting on the wheel supports to values determined by stored weight data and to obtain a condition for high speed travel. When the traction control data are received in the vehicle, they are preferably stored in the memory 546 by the auxiliary processor 542 to be available for subsequent pass through operations and also for maintenance, monitoring or other operations.

In the pass through mode, when the stop region is approached, for example when the wheels are in positions as shown in FIG. 34, traction control data are sent to the carrier vehicle to energize the traction control motor in a direction to decrease the forces applied by the springs and to place the wheels in positions as shown in FIG. 36 well before the upper wheels of the front bogie are below the surface portion 624A of the right upper track and a corresponding surface portion of the left upper track. A continue flag is then set and in subsequent operations a test of the continue flag results in the aforementioned test to determine whether the vehicle is clear of the stop region. It is noted that in the pass through mode, the traction control data which are sent to the traction control motors are obtained from data previously stored in the memory 546 of the vehicle circuit unit 464.

Merge Operations (FIGS. 37–41)

Figures 37, 38:
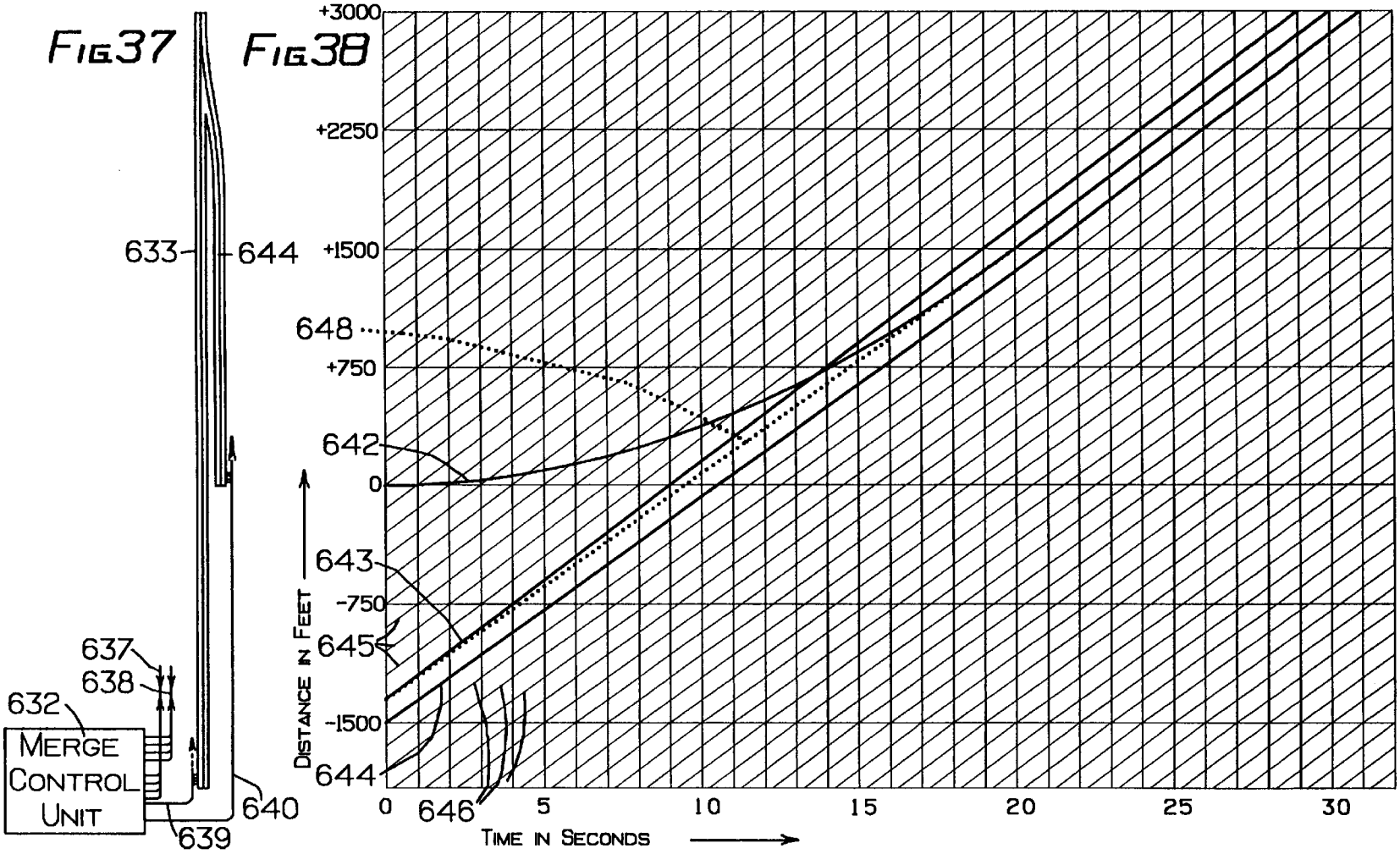
FIG. 37 diagrammatically illustrates a merge control unit which monitors and controls operations including merge operations along a main line guideway and a branch line guideway.
FIG. 38 is a graph provided to explain merging operations at relatively high speeds and shows the acceleration of a stopped vehicle on a branch line guideway of FIG. 37 to enter the main line guideway.

FIG. 37 diagrammatically illustrates a merge control unit 632 which monitors and controls operations including merge operations along a main line guideway 633 and a branch line guideway 634. FIG. 38 is a graph provided to explain merging operations at relatively high speeds and shows the acceleration of a stopped vehicle on the branch line guideway to enter the main line guideway at a speed of 150 feet per second and after travelling a distance of on the order of one half of a mile. Although the unit 632 will be described in controlling a high speed operation, it is also usable in low speed operations, as in controlling relatively slow movements of vehicles into and out of guideways used for temporary storage of vehicles.

The unit 632 is a specially programmed section control unit which has a circuit similar to the circuit of the section control unit 476 shown in block form in FIG. 29. It has eight input/output lines in two groups of four lines each, one group being in a bus 637 connected to section conductors on the left side of the main guideway and the other being in a bus 638 connected to section conductors on the right side of the branch guideway 634. The unit 632 is also connected through buses 639 and 640 to monitoring and control units along the branch and main line guideways 633 and 634.

Figure 39:
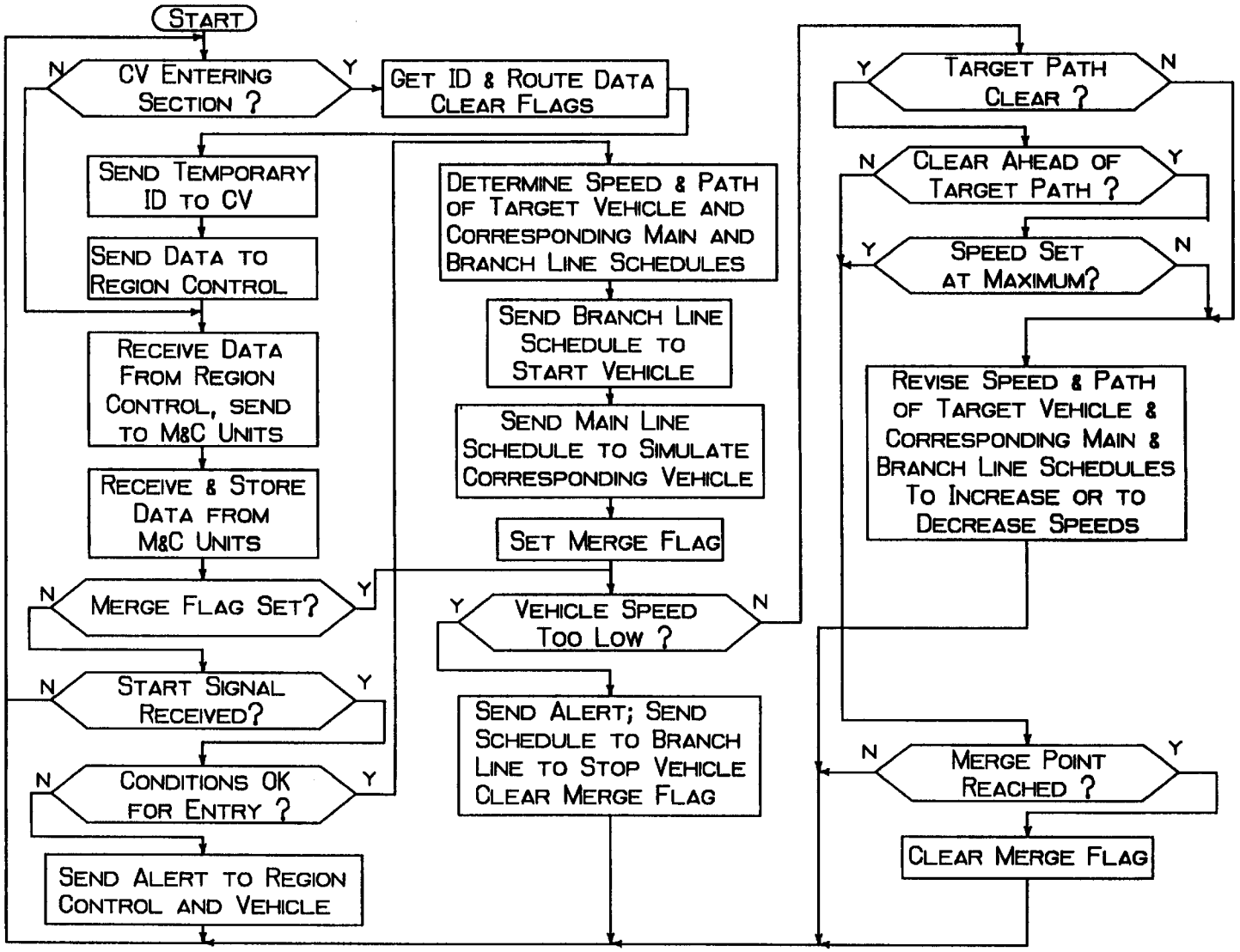
FIG. 39 is a flow diagram illustrating the operation of the merge control unit of FIG. 37.
Figure 40:
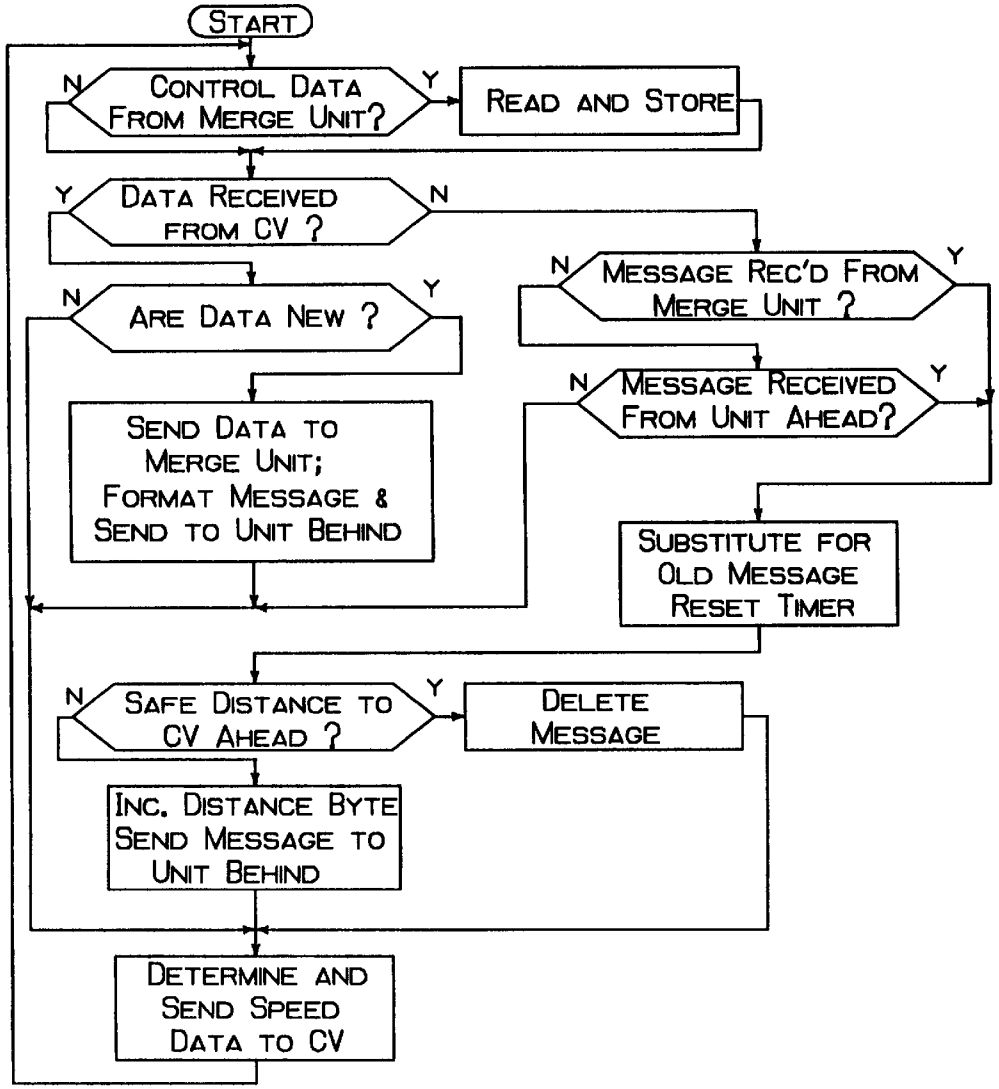
FIG. 40 is a flow diagram illustrating the operation of a monitoring and control unit for the main line guideway of the merge section shown in FIG. 37.
Figure 41:
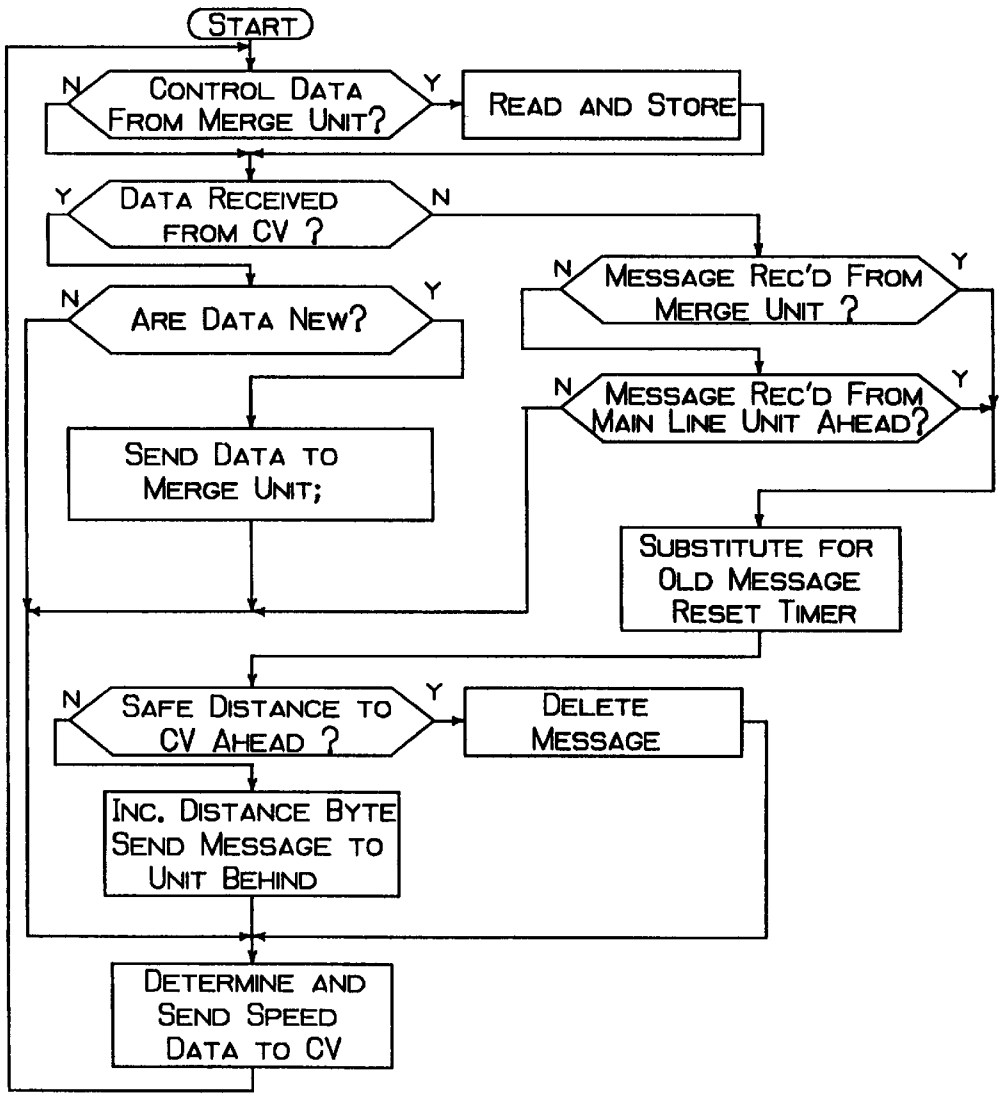
FIG. 41 is a flow diagram illustrating the operation of a monitoring and control unit for a branch line guideway of the merge section shown in FIG. 37.

The flow diagram of FIG. 39 illustrates the operation of the merge control unit 632; the flow diagram of FIG. 40 illustrates the operation of monitoring and control units of the main line guideway 633 and the flow diagram of FIG. 41 illustrates the operation of monitoring and control units of the branch line guideway 634.

In the graph of FIG. 38, a heavier line 642 shows the movement of a vehicle that is on the branch line guideway 634 and that in 20 seconds is accelerated from a speed of zero at 7.5 feet per second per second to reach a speed of 150 feet per second after travelling 1500 feet and to then travel at a constant speed of 150 feet per second while moving from the branch line guideway 634 onto the main line guideway 633. Such movement is obtained by scheduling signals to monitoring and control units along the branch line guideway 634 to cause each of such units to apply a certain command speed signal to a passing vehicle. For example, in obtaining a constant acceleration of 7.5 feet per second, each monitoring and control unit applies a command speed signal to obtain a speed equal to the square root of the product of twice the acceleration (15) and the distance of the unit from the start position. Thus at a distance of 90 feet, the speed may be the square root of 15 times 90, or 36.74 feet per second. At a distance of 900 feet, the speed may be 116.19 feet per second.

Another heavier line 643 shows the movement of a vehicle on the main line guideway which travels at 150 feet per second and which overtakes the entering vehicle of line 642 to be 150 feet ahead of the vehicle of line 642 when the vehicle of line 642 enters the main line guideway 633.

A third heavier line 644 shows the movement of a vehicle on the main line guideway 633 which at zero time is traveling at 150 feet per second and which is behind the vehicle of line 643 at a following distance of 150 feet. To permit entry of the branch line vehicle of line 642, the vehicle of line 644 moves at a speed of 142.5 feet per second for 20 seconds to then be at a following distance of 150 feet per second behind the entering vehicle of line 642, after which the vehicle of line 644 moves at a speed of 150 feet per second.

A series of light lines 645 show vehicles on the main line guideway 633 which are ahead of the vehicle of line 643 and which move at 150 feet per second with constant distances of 150 feet therebetween.

Another series of light lines 646 show vehicles on the main line guideway 633 which are behind the vehicle of line 643 and which from time zero to the 20 second time move at constant speeds 142.5 feet per second, rather than 150 feet per second, to gradually increase the following distance behind the vehicle of line 643 from 150 feet to 300 feet and to place the vehicle of line 644 at 150 feet behind the entering vehicle of line 642.

The message-passing operations as described above in connection with FIG. 32 are used in obtaining the following distances of 150 feet per second. To obtain the gradually increasing following distance of the main line guideway vehicle of line 644 relative to the main line guideway vehicle of line 643, appropriate speed commands may be applied directly to units along the main line guideway but the scheduling of such signals is relatively complicated since the movement of the vehicle of line 643 must be taken into account. Preferably, however, the scheduling on the main line guideway is performed by creating a "phantom" vehicle and making use the message-passing operations of monitoring and control units as described above in connection with FIG. 32. In the message passing operation, the detection of a signal from a vehicle results in the format and sending of a message to a unit behind, each unit responding to messages from units ahead to develop command speed signals for passing vehicles and to automatically operate each vehicle at a speed not greater than that of the vehicle ahead and at a certain following distance which may be proportional to the speed of the vehicle ahead.

To control the vehicle of line 644 and temporarily operate it at the reduced speed of 142.5 feet per second, a phantom vehicle indicated by dotted line 648 is created by the merge control unit 632 which schedules signals to monitoring and control units along the main line guideway 633 to simulate a vehicle ahead of the vehicle of line 644. The scheduling of phantom vehicle control signals is such that in response to detection of the vehicle of line 643 at time T0 by a certain monitoring and control unit, the units ahead of that unit are caused to sequentially develop signals in a timed relation corresponding to the times at which such units ahead would develop signals if a vehicle moved at a reduced speed, such as the 142.5 feet per second speed of the example, along the main line guideway 633.

The merge control unit 632 accommodates conditions of operation other than the condition depicted in FIG. 38 in which vehicles are moving uniformly at the relatively high speed of 150 feet per second. The vehicles may be commanded to move at a substantially lower speed such as 75 feet per second or less when weather conditions are difficult or in urban environments space or other factors dictate a lower speed. Also, although every effort may be made to avoid problems, it must be recognized that at times which may be highly inappropriate, vehicles may not move as fast as commanded or may stall.

FIG. 39 is a flow diagram showing the operation of the merge control unit 632 which performs the operations shown in the graph of FIG. 38 and which also accommodates other conditions of operations. As shown in FIG. 39, initial operations are performed which are like those of the section unit 476 as depicted in FIG. 33. Then a test is made for a set condition of a merge flag which is set after setting up for merge operations. If the merge flag is not set, a test is made for a start signal which may be applied after a vehicle has arrived and is at a stop position at the entrance end of the branch line guideway 634. If a start signal is then received, a check is made to see if conditions for entry are satisfactory. This check includes a check of all monitoring and control units along both the main line and branch line guideways, to determine among other things whether there are vehicles on the main line guideway 633 which are stalled or moving too slowly and which would interfere with entrance of the waiting vehicle on the branch line guideway 634. If conditions are not satisfactory, alerts are sent to region control and also to any occupants of the vehicle to inform them about the situation.

If conditions for entry are satisfactory, a determination is made as to the speed and path of a target vehicle on the main line guideway 633 which may be a vehicle such as the vehicle of line 643 moving at a high speed. The schedules such as discussed above are then determined, the branch line schedule being sent to monitoring and control units of the branch line guideway 634 to start acceleration of the waiting vehicle and the main line schedule being sent to the monitoring and control units of the main line guideway to simulate a vehicle such as the vehicle of dotted line 648 simulating the entering vehicle.

The target vehicle may be a vehicle moving at a slower speed. The path of a vehicle such as that of line 643 then starts at zero time at a position closer to the reference zero position of the entering vehicle, the scheduled speed values sent to monitoring and control units of the branch line guideway 634 may be reduced in proportion to speed and the main line guideway scheduling is also changed as appropriate to reflect the difference in starting position and speed of the target vehicle.

If traffic is lighter and there are spacing distances greater than the minimum following distance between vehicles moving on the main guideway at the time of the start signal, a target vehicle may be selected which is at the forward end of such a spacing distance. If traffic is very light and there are no spacing distances, a target vehicle is assumed to be moving at the maximum speed which is allowable.

After sending appropriate schedules, a merge flag is set. The next operation, which may also occur after a positive response to a test for a set condition of the merge flag, is a test to determine whether the speed of the entering vehicle is too low, an occurrence which however unlikely could cause problems. If the speed is too low, a signal is sent to monitoring and control units of the branch line guideway to bring the vehicle to a stop and appropriate alerts are sent, the merge flag being then cleared.

If the speed of the entering vehicle is satisfactory, a check is made determine whether the target path is clear. The target path is clear if there is no vehicle on the main line within a safe following distance behind a vehicle such as the vehicle of line 643 of FIG. 38, or behind a vehicle on an assumed and imaginary target line equivalent to the line 648. If the target path is not clear, the branch and main line schedules are revised to decrease speeds and the target path is changed. The target path might not be clear if, for example, the vehicle of line 643 has slowed down and its path has crossed the line 643 as shown.

If the target path is clear, a further check is made to determine whether the main line is clear for a certain distance ahead of the target path and whether the set speed is at a maximum. It the path is clear ahead and the set speed is not at a maximum, speed and path of the target vehicle and the branch and main line schedules are changed as appropriate.

If the target path is clear but the main line guideway is not clear ahead of the target path or if the speed has been set at a maximum, a check is made to determine whether the merge point has been reached, in which case the merge flag is cleared.

FIG. 40 is a flow diagram for a monitoring and control unit of the main line guideway 633, which differs from that of FIG. 32 in that it provides for receipt of a message from the merge unit, such as a message as aforementioned, used in simulating the existence on the main line guideway 633 of a vehicle corresponding to an entering vehicle on the branch line guideway 634. It also differs from that of FIG. 32 in specifying the receipt and sending of data from and to the merge unit. In other respects the operation is the same as depicted in FIG. 32, the unit being operative with respect to all vehicles moving on the main line guideway 1031.

FIG. 41 is a flow diagram for a monitoring and control unit for the branch line guideway 632, which is similar to that of FIG. 32 as well as that of FIG. 40. It differs from both in that there are no format and send operations for the reason that only one vehicle is in the branch line guideway 634 at one time. The unit will receive messages either from the merge unit or from a unit ahead, a feature which is not used in the system as it has been described but which gives greater capabilities for controlling the operation of the unit.

Vehicle-Load Interconnect (FIGS. 42–46)

Figure 42:
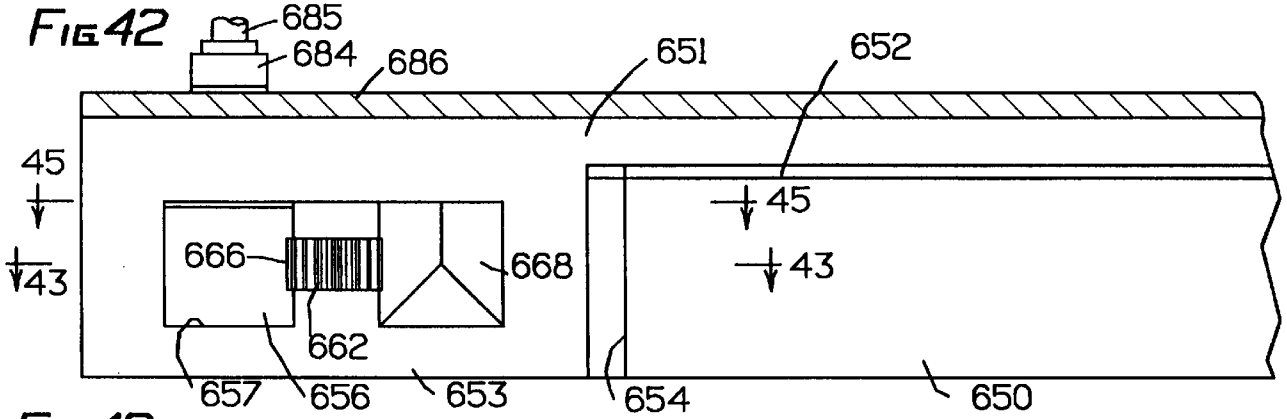
FIG. 42 is a front elevational view of a connection arrangement.

FIG. 42 is an elevational view looking forwardly at a left portion of the front connection 13. The connection 13 as illustrated connects the automobile platform 11 to the upper end of the forward post 15 of the vehicle 10 but may be used for connection to passenger cabins, freight containers or other types of loads.

The connection 13 includes a pad 650 secured to the upper end of the post 15 and a connector 651 which is secured to the platform 11. A major portion of the connector 651 overlies the pad 650 and a layer of resilient material 652 is preferably carried by the under surface of the connector 651 for engagement with an upper surface of the pad of substantial area. Both the pad 650 and the connector 651 have generally rectangular shapes but the connector 651 has a portion 653 that extends downwardly from a left rearward corner thereof and into a notch 654 in formed in the left rearward corner of the pad 650, a similar construction being provided at the right rearward corners of the connector 651 and pad 650.

Figure 43:
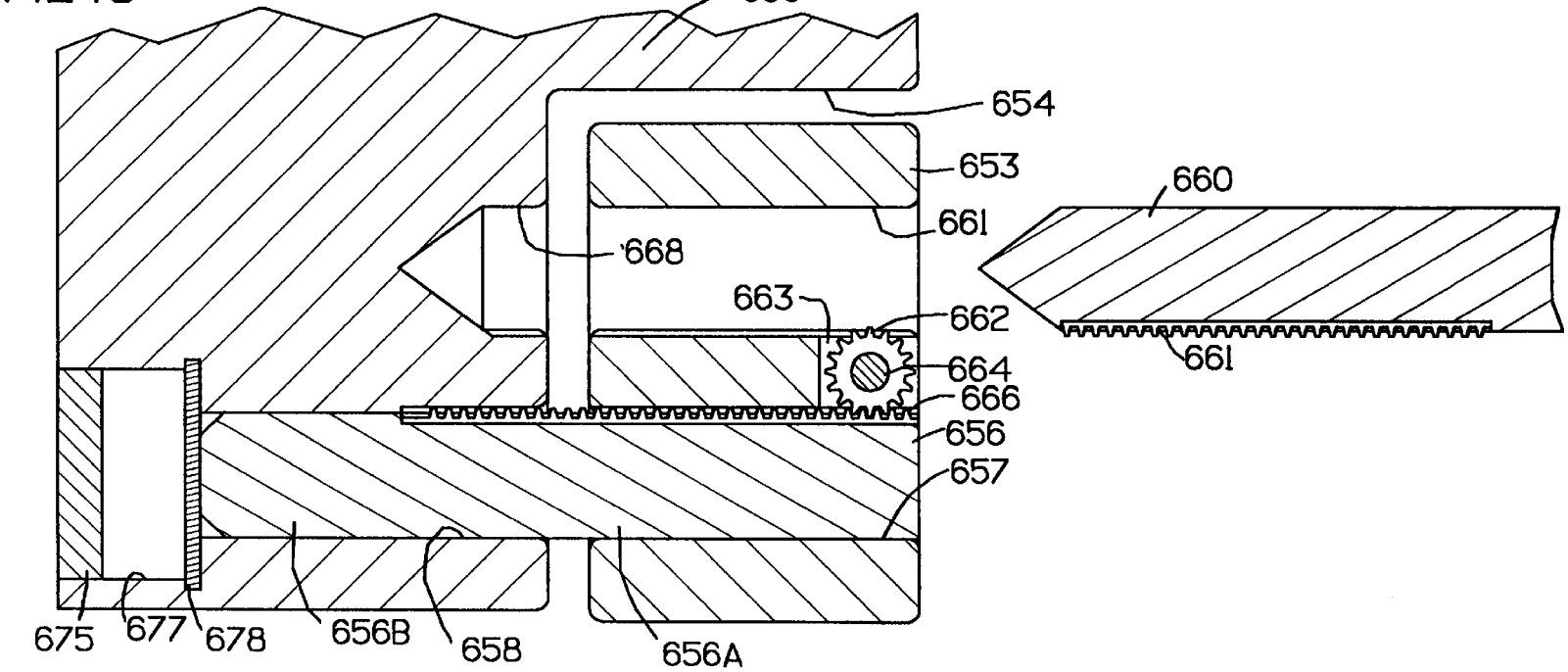
FIG. 43 is a sectional view taken along line 43—43 of FIG. 42.

A locking element 656 is movable horizontally to a position as shown in the sectional view of FIG. 43 in which a rearward portion 654A is in an opening 657 in the depending portion 653 of the connector 651 and in which a forward portion 656B thereof is in an opening 658 in the pad 650. In this condition, the connector 651 is securely locked to the pad 650.

Release of the connector 651 from the pad 650 is effected by means of a prong 660 of the forward prong structure 27 of the transfer vehicle 24 shown in FIG. 1. The prong 660 is moved forwardly to move a pointed forward end 660A thereof into an opening 661 of the depending portion 653 of the connector 651. As the prong 660 continues its forward movement, teeth of rack 661 on one side thereof move into meshing engagement with the teeth a pinion 662 which is disposed in an opening 663 between the openings 657 and 661. Pinion 662 is supported on a shaft 664 for rotation about a vertical axis and its teeth continuously mesh with teeth of rack 666 on one side of the locking element 656.

Figure 44:
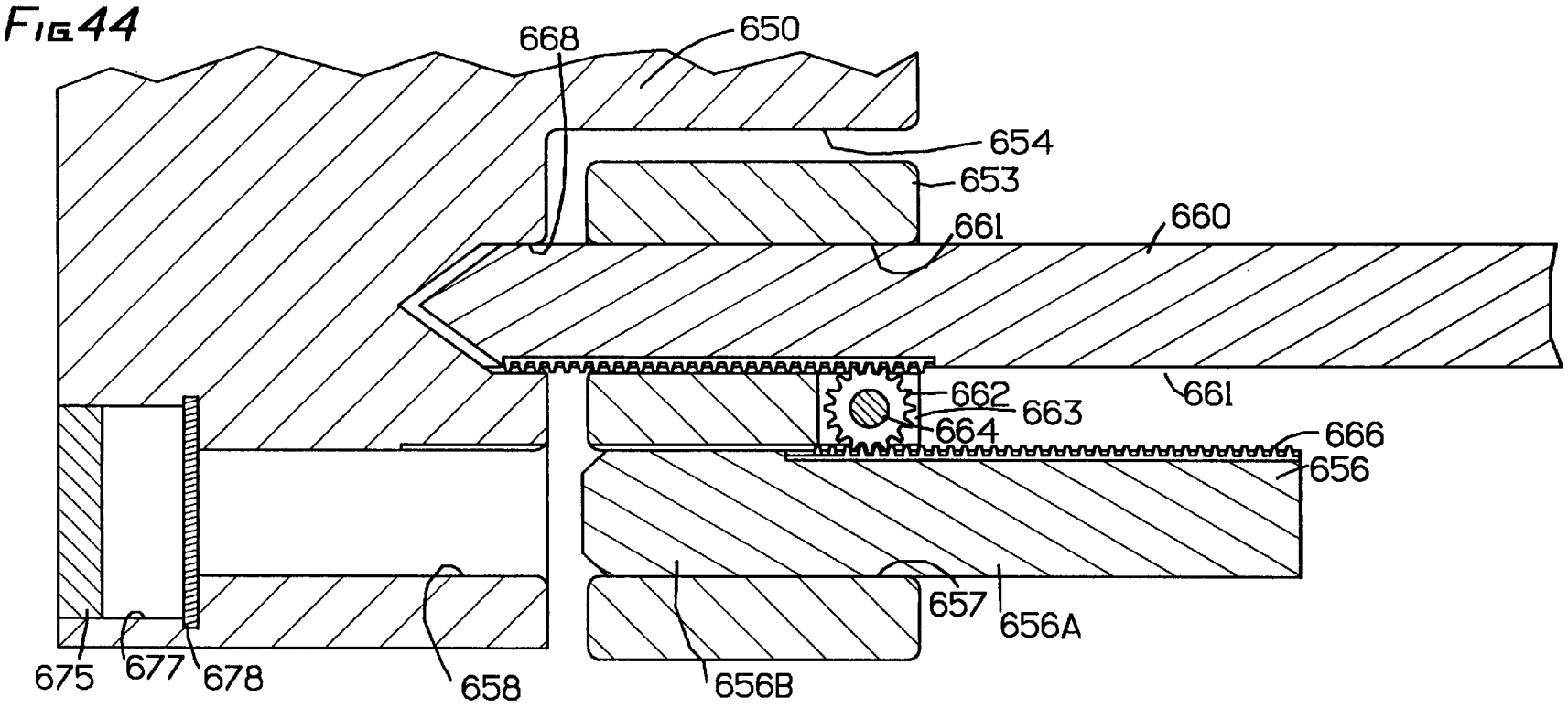
FIG. 44 is a view similar to FIG. 43, illustrating parts in different positions.

When the prong 660 is moved forwardly to a position as shown in FIG. 44, the locking element is moved rearwardly 656 to be completely out of the opening 658 in the pad 650. At the same time, the prong 660 extends completely through the opening 661 in the depending portion of the connector 651. Prong 660 is then in a position to allow it and three other similar prongs of the forward and rearward prong structures to be moved upwardly to lift the connector 651 off of the pad 650. A pointed end of prong 660 then extends into an opening 668 in the pad 650 but the opening 668 extends to an upper surface of the pad 650, so that the pad then offers no interference with upward movement of the prong 660.

To install a load on a carrier vehicle, the operation is reversed. An automobile platform or other load is carried by the prong structures 27 and 28 of the transfer vehicle 24 to be positioned over a carrier vehicle. The prong structures 27 and 28 are then lowered to place the prong 660 and the connector 651 in the positions as shown in FIG. 44. The prong 660 is then moved rearwardly and, through the rack 661, pinion 662 and rack 666, the locking element 656 is moved forwardly to the position shown in FIG. 43 to be left in a locked position.

Figure 45:
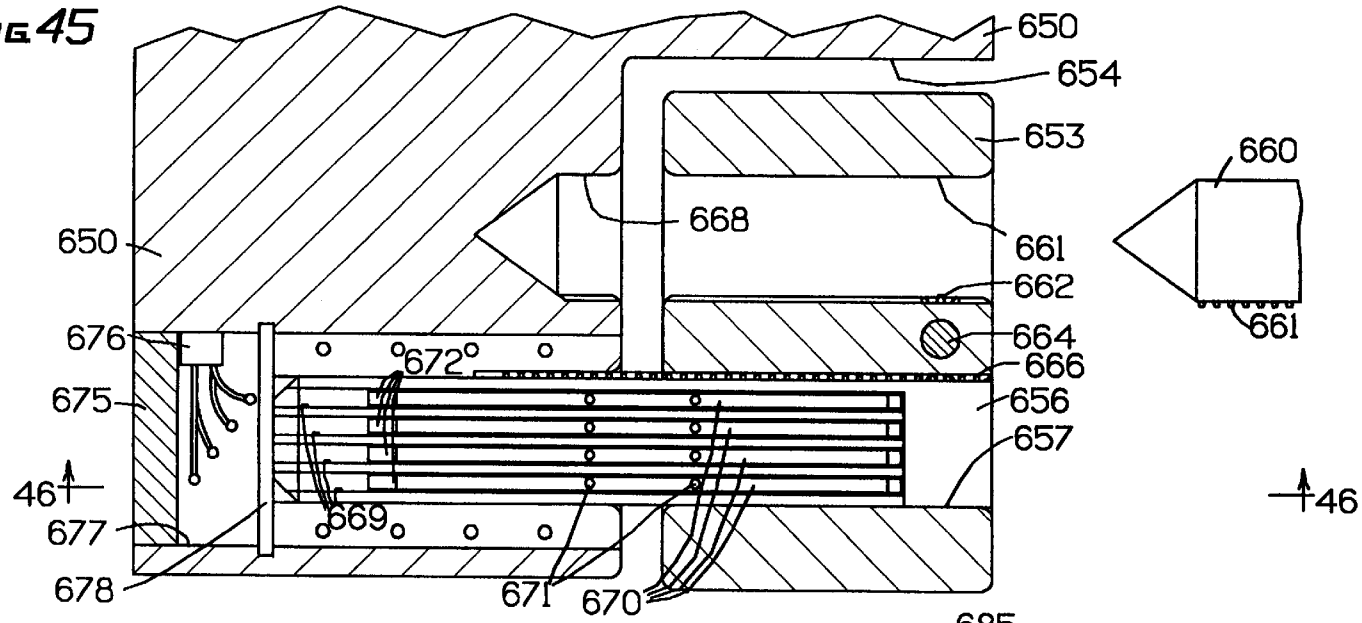
FIG. 45 is a sectional view taken along line 45—45 of FIG. 42.

Important features relate to the effecting of electrical connections through the association of the pad 650 and the connector 651. The sectional view of FIG. 45 provides a top plan view of the locking element 656 which has a generally square cross-sectional shape and which has four grooves 669 in its upper surface that extend longitudinally in spaced parallel relation. Four contacts 670 in the form of strips of an electrically conductive spring metal have central portions secured by rivets 671 to members 672 of a thin insulating material that are preferably adhesively secured in the grooves 669. The members 672 are generally U-shaped in cross-section with bight portions at the bottoms of the grooves and side portions extending upwardly to edges that are flush with adjacent upper surface portions of the locking element 656.

Figure 46:
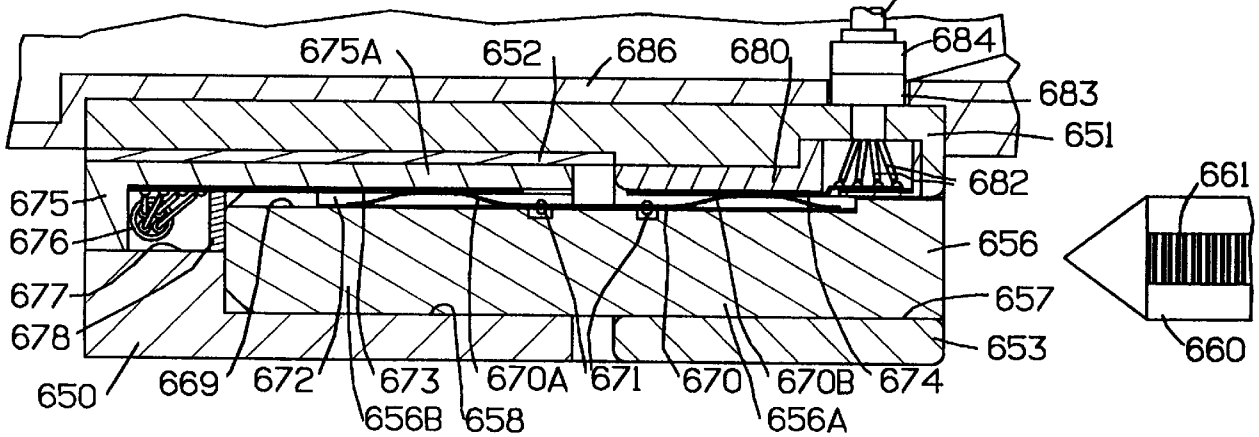
FIG. 46 is a sectional view taken along line 46—46 of FIG. 45.

As shown in FIG. 46, end portions 670A and 670B of the contacts 670 are bowed upwardly. In the locking position of element 656 as shown, contacts 670 function as bridging contacts. Portions 670A and 670B thereof are in pressure contact with contact strips 673 carried by the pad 650 and contact strip 674 carried by the connector 651.

Strips 673 are supported on a thin layer of insulating material on a lower surface of a rearwardly extending part of an insert member 675. The strips 673 are soldered or otherwise connected to the ends of four wires of a cable 676 that is mounted in a passage of the pad terminating at an opening 677 of the pad 650. A member 678 of insulating material is secured in the pad 650 in a position between opening 677 and an upper end portion of the opening 658. After connecting the contact strips 673 to the wires of the cable 676, the insert member 675 is mounted in the opening 677 and screws are used to securely fasten edge portions of the rearwardly extending part 675A of member 675 to the pad 650.

Strips 674 are similarly supported by an insert member 680 that is secured in an opening in the connector 681 after connecting the strips 674 to wires 682 that extend from an electrical connector device 683 mounted on the connector 651. A second electrical connector device 684 connects contacts of the device 683 to conductors of a cable 685 for supply of electrical power to the load to which connector 651 is secured. The connector 651 is shown mounted under a frame member 686 of the platform that may the extend rearwardly to be in a protective relationship to rearward portions 670B of the contacts 670 when the connector 651 is disconnected from the pad 650.

An arrangement is thus provided that is relatively simple in construction and operation while being highly reliable, using the locking element 656 in performing electrical connection functions as well as in performing its mechanical connection functions. When the connector is disconnected from the pad, contacts carried by both can be protected with minimum exposure to the elements. Those on the pad 650 are within the opening 658 and adjacent an upper downwardly facing surface thereof. Those carried by the locking element 656 are on its upper surface may be readily protected by a surface such as a downwardly facing surface of a rearward extension of the frame member 686.

Figure 47:
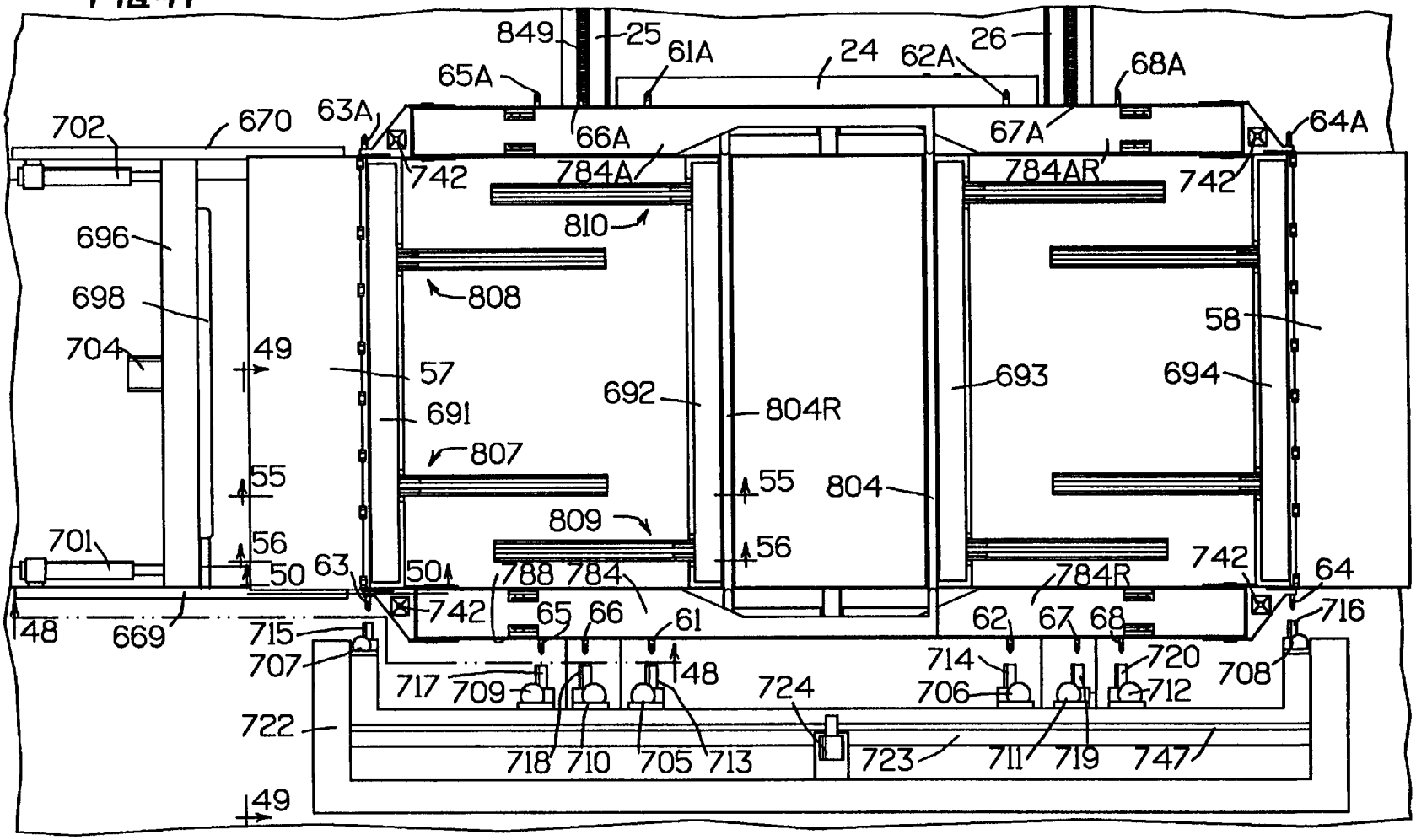
FIG. 47 is a top plan view of an automobile platform and associated apparatus.

Automobile Platform Loading and Unloading (FIGS. 47-)

FIG. 47 is a top plan view of the platform 11, shown at a loading station and in a folded condition after delivery from a platform storage region. In the folded condition, the cage structures 55 and 56, the end flaps 57 and 58, and wheel chocks are all in lowered positions. The platform as shown includes one pair of chocks 691 and 692 for the front wheels and a second pair of chocks 693 and 694 for the rear wheels. Each of the chocks 691–694 is in the form of a bar which extends across the platform, each pair being engageable with two opposite wheels or, in the case of a three wheel automobile, with a single front or rear wheel.

A stop wall 696 is provided to the left of the platform 11 as shown, having a relatively soft resilient face 697 for engagement by a front bumper of an automobile. An entrance gate is provided that is not shown in FIG. 47 but that is to the right of the platform 11 as shown, being opened to allow an automobile to be driven in a forward direction from right to left until a front bumper thereof engages the resilient face 698 of the stop wall 696. The front or forward end of the platform as illustrated is thus assumed in the following discussion to be the end that is to the left. However, the platform as shown is symmetrical in construction and would be the same if rotated 180 degrees about a vertical axis. Control elements 61A–68A are provided that are connected to the control elements 61–68 and that project from the side opposite that from which elements 61–68 project.

The stop wall 696 is supported from a pair of support members 699 and 700 through a pair of spring and shock absorber units 701 and 702 that are capable of absorbing a substantial amount of energy from impact by an automobile bumper without damage to thereto. A gear motor 704 is operative to control movement of support members 699 and 700 toward or way from the platform. Before opening of the entrance gate, the gear motor 704 may be used to place the stop wall in a position that is appropriate for a particular automobile awaiting entry. Also, the cage structures 55 and 56 are elevated to positions appropriate for a particular automobile awaiting entry, or they may fully elevated and then moved down to a proper position after entry of an automobile onto the platform 11.

When the entrance gate is opened, the driver of the automobile will see and hear requests to move ahead slowly until the front bumper of his or her automobile touches the stop wall 696, a condition which is sensed and followed by requests to place the transmission in a park condition and to apply the parking brakes. The stop wall 696 is then moved away from the front bumper of the automobile. Also, the automobile is then securely fastened to the platform by lifting the front and rear flaps 57 and 58 to positions such as shown in FIG. 1 and by moving the chock bars 691 and 692 rearwardly and forwardly into engagement with forward and rearward portions of the front tire of the automobile and by moving the chock bars 693 and 694 into a similar relationship to the rear tires of the automobile.

Actuators are provided that include actuators 705 and 706 for the control elements 61 and 62 for the cage structures 57 and 58, actuators 707 and 708 for the control elements 63 and 64 for the front and rear flaps 57 and 58, actuators 709 and 710 for control elements 65 and 66 for the front wheel chocks 691 and 692 and actuators 711 and 712 for the control element 67 and 68 for the rear wheel chocks 693 and 694. Each of the control elements has an end portion of hexagonal shape and the actuators 705–712 include sockets 713–718 of hexagonal shape and stepper or servo motors of a commercially available type, operative to drive the sockets 713–718 under digital control.

The actuators 707–712 are supported from a frame 722 that is supported from a fixed frame 723 for movement toward and away from the platform 11 under control of a control motor 724. After the platform 11 is placed in the position shown, the control motor 724 is energized to move the frame 723 toward the platform and to engage the sockets 713–720 with the control elements. Initially, the actuators 705 and 706 are energized to lift the cage structures 55 and 56. Then, after an automobile has been driven onto the platform 11, the actuators 707–712 are energized to lift the end flaps 57 and 58 and to move the wheel chocks 691–694 toward tires of the automobile until certain limit torques have been applied in engaging the flaps and wheel chocks with bumpers and tires of the automobile.

After the automobile is moved onto the platform securely locked to the platform at the loading station shown in FIG. 47, the transfer vehicle 24, shown in FIG. 47 in a position underlying the platform 11, may be used to lift the platform 11 with the automobile thereon and then move it to a position as shown in FIG. 1 at which it can be locked to the carrier vehicle.

For unloading an automobile from a platform 11, an unloading station is provided that is similar to the loading station shown in FIG. 47, differing therefrom in that an exit gate is provided to the left of the platform position as shown in FIG. 47, assuming that the automobile is delivered by a transfer vehicle such as vehicle 24 in an orientation for driving off to the left. Upon delivery, actuating sockets are moved into engagement with the respective control elements and are then rotated until certain limit torques have been applied in lowering the end flaps 57 and 58 to lowered stop positions and in moving the wheel chocks 691–694 to retracted positions in which they are at the floor level of the platform 11. Then the exit gates are opened and requests are made to the driver of the automobile to drive away. After the automobile is driven off the platform 11, the actuating sockets for the cage structures 55 and 56 are rotated, first one and then the other, until certain limit torques have been applied in moving the structures to fully lowered positions. The platform is then in a folded condition, ready to be picked up and transferred to a storage location in a manner as hereinafter described.

Figure 48:
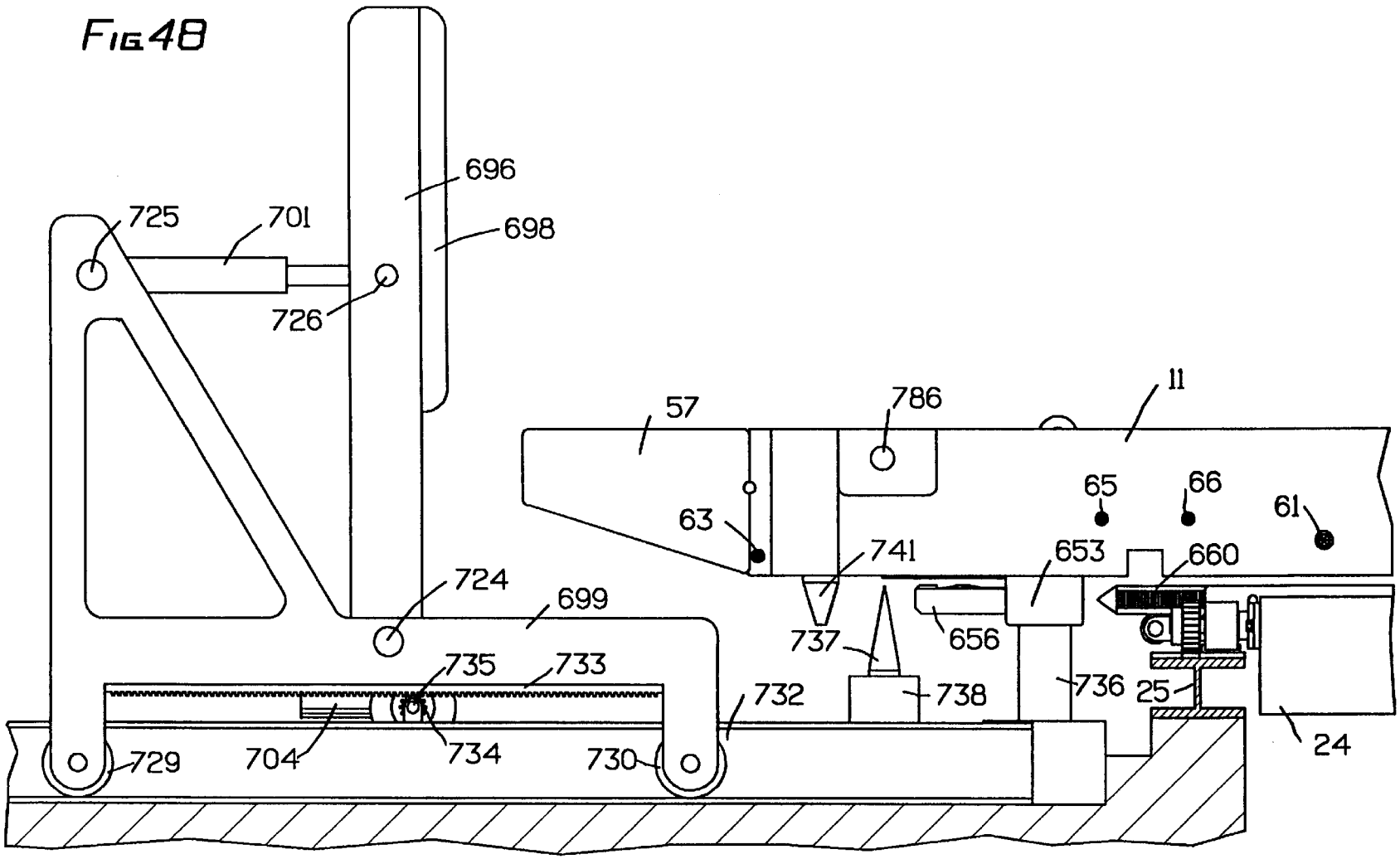
FIG. 48 is a sectional view taken along line 48—48 of FIG. 47.

FIG. 48 is a sectional view taken along line 48—48 of FIG. 47. At one end of the stop wall assembly, pins 725 and 726 connect the spring and shock absorber unit 701 to an upper portion of the member 699 and to the stop wall 696, and a pin 727 connects a lower end of the stop wall 696 to a lower portion of the member 699 which journals rollers 729 and 730 movable along a stationary frame member 732. The member 699 carries a rack 733 that is meshed with a pinion 734 on a shaft 735 driven from the gear motor 704 through a suitable reduction gearing. A similar arrangement is provided at the opposite end of the stop wall assembly, a pinion thereof and the pinion 734 being both driven from the gear motor 704.

FIG. 48 also shows the depending portion 653 of the connector 651 and the locking element 656. In the position as shown, the platform 11 is supported on four support posts including a post 736 that underlies the depending portion 653 and three other posts that underlie the three other depending portions of connectors of the platform 11.

FIG. 48 also shows a positioning device formed by an upper pointed end of an armature 737 of a solenoid 738, shown in a lowered position. When a platform such as platform 11 is lowered toward the position shown, the solenoid 738 is energized to move the armature 737 upwardly to a position in which the pointed end thereof may enter a circular opening in a lower wall portion of the platform 11. After the platform is lowered, the armature 738 is moved down to the position shown to allow subsequent transfer by the transfer vehicle 24. A similar device is provided for positioning the opposite end of the platform. Together, the two devices insure accurate positioning of the connectors of the platforms relative to the prong 660 and the three other prongs of the transfer vehicle.

FIG. 48 additionally shows one of four pointed depending elements 741 that are provided on four corner portions of the platform and that enter openings 742 in provided in upper wall portions of the platform 11, as shown in FIG. 47. Such elements 741 and openings 742 cooperate in placing and holding platforms in properly stacked relation.

Figure 49:
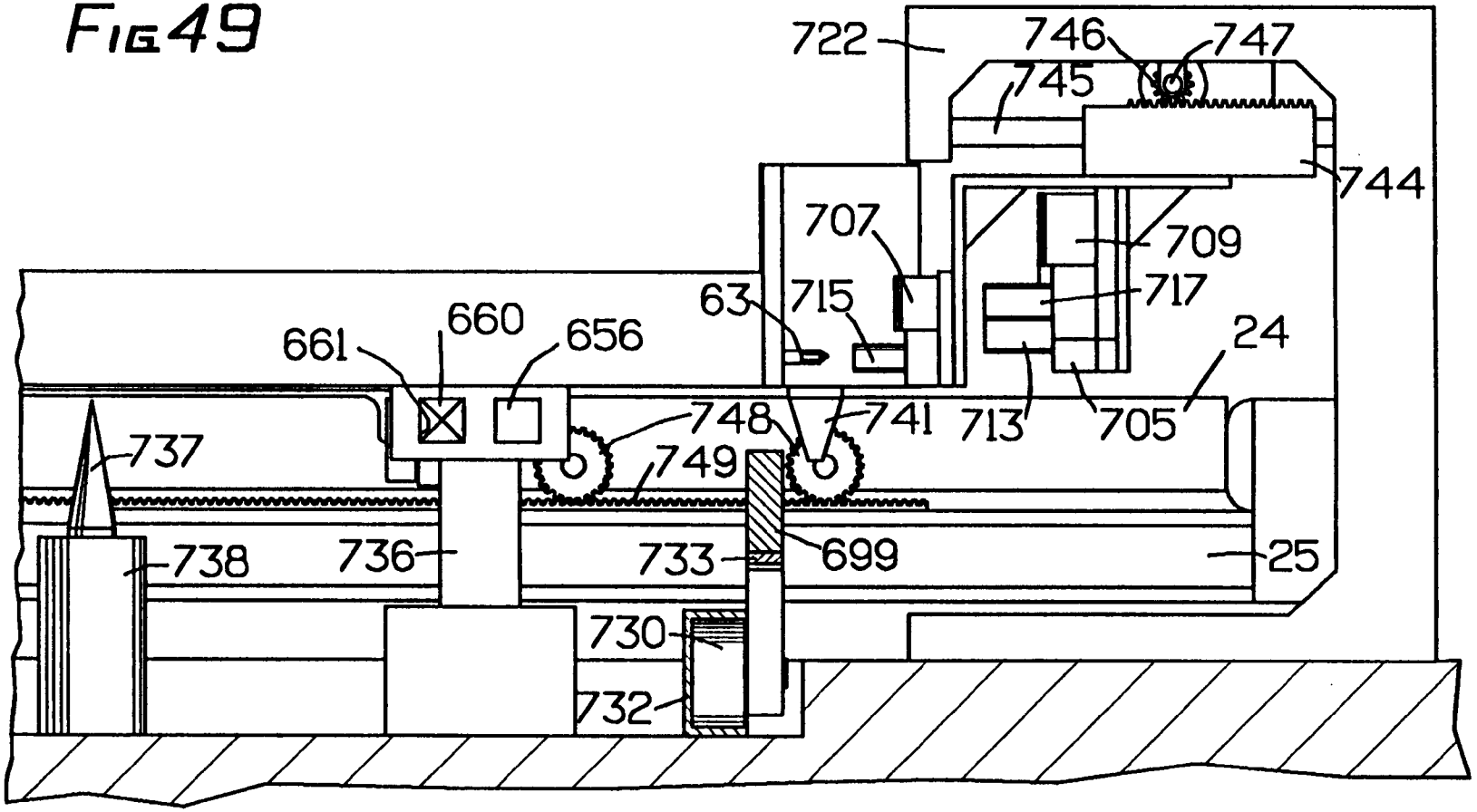
FIG. 49 is a sectional view taken along line 49—49 of FIG. 47.

FIG. 49 is a view taken along line 49—49 of FIG. 47. The frame 720 that supports the actuators 705–712 is supported at opposite ends on members 744 that are slidable on support shafts 745 carried by the stationary frame 721. Racks formed on the upper sides of the members mesh with pinions 746 on the opposite ends of a shaft 747. The shaft 747 is driven from the control motor 722, shown in FIG. 47. FIG. 49 also shows one of two pairs of pinion gears 748 that are provided on one side of the transfer vehicle and that are meshed with a rack 749 on the beam structure 25. Another two pairs of such gears are provided on the opposite side of the transfer vehicle and all are driven from a common drive motor carried by the vehicle to move the vehicle along the beam structures 25 and 26. The gears do not support the vehicle, support being provided by rollers secured to the gears and riding on a support surface alongside the rack 49, the rollers having diameters equal to the pitch diameters of the gears. The gears of each pair are spaced apart a distance greater than the width of the gaps in the beam structures 25 and 26. As described in connection with FIG. 1 such gaps are aligned with the slot provided between the top walls 21 and 22, so as to permit movement of the carrier vehicle 10 into and through the transfer section when the transfer vehicle 24 is out of the way.

Figures 50, 51, 52:
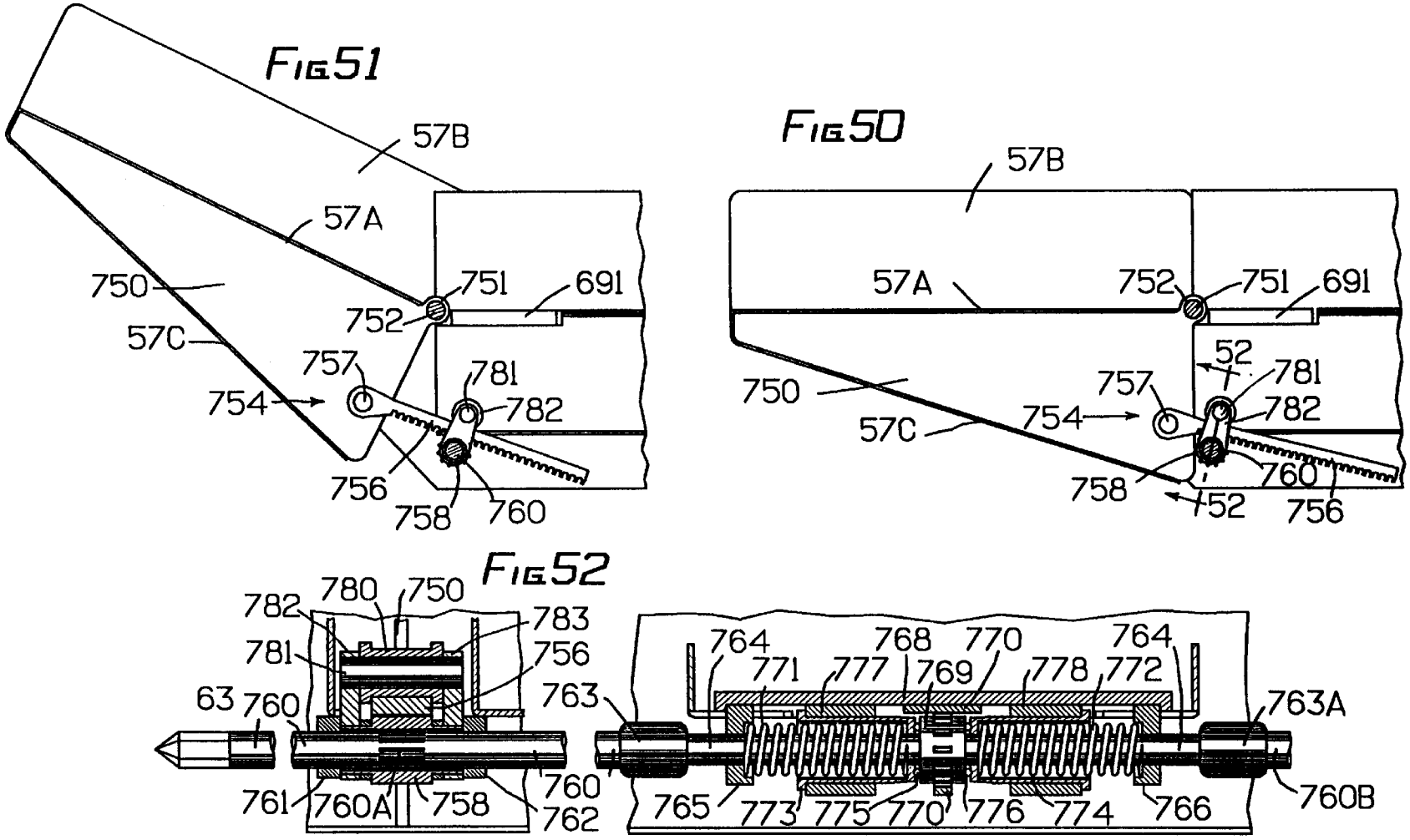
FIG. 50 is a sectional view taken along line 50—50 of FIG. 47.
FIG. 51 is a view like FIG. 50 but shown parts in a different condition.
FIG. 52 is a sectional view on an enlarged scale illustrating a braking mechanism.

End Flap Actuation (FIGS. 50–52)

FIG. 50 is a sectional view taken generally along a line 50—50 of FIG. 47, showing the front end flap 57 in a lowered position; FIG. 51 is a view similar to FIG. 50, showing the front end flap 57 in an elevated position; and FIG. 52 is a sectional view on an enlarged scale, taken generally along line 52—52 of FIG. 50.

The flap 57 includes a floor plate portion 57A, a pair of side plate portions 57B, a bottom plate portion 57C and a series of transversely spaced support plates 750 between the floor and bottom plate portions 57A and 57C. The support plates 750 are secured to hinge elements 751 through which hinge pins 752 extend to hinge the flap 57 to the platform 11.

Two rack and pinion assemblies are provided for actuating the flap 57, disposed at position spaced inwardly from opposite sides of the flap 57. One assembly 754 includes a rack member 756 having a bifurcated end portion connected by a pin 757 to one of the support plates 753. A toothed portion of rack member 756 is meshed with a pinion member 758 that is disposed on an operating shaft 760 and that has internal splines receiving a splined portion 760A of shaft 760 to provide a rotational coupling while allowing axial movement of the operating shaft for the purpose releasing a brake assembly when rotation of the shaft is to be effected.

Shaft 760 is journaled by bearings 761 and 762 that are secured to frame members of the platform. One end of shaft 760 is pointed and has a hexagonal shape to provide the control element 63. The other end is connected by a coupling element 763 to a shaft 764 that is journaled by a pair of bearing members 765 and 766 supported from a centrally located frame member 768 of the platform 11. A lock or brake member 769 is secured to the shaft 764 and has external splines that in a neutral position of the shaft 764 are meshed with internal splines of a stationary brake member 770 secured to the frame member 768.

When the socket 715 of the actuator 707 is moved toward the platform 11, it engages the control element 63 of the shaft 760 to move it to the right and to thereby move shaft 764 and the brake member 769 to a position in which the external splines of member 769 do not mesh with the internal splines of the stationary brake member 770, thereby allowing the actuating socket 715 to be rotated to effect rotation of the shaft 764, the shaft 760 and the pinion 756. An opposite end of the shaft 764 is connected through a coupling 763A to a shaft 760B that has a spline connection to a pinion of a second rack and pinion assembly line the assembly 754 and that has an end portion forming a control element 63A at an opposite side of the platform, shown in FIG. 47. An actuating socket may be moved toward the platform to engage the control element 63A and to thereby move shaft 760B and shaft 764 to the left as viewed in FIG. 52 and to release the brake.

A pair of compression springs 771 and 772 urge the brake member 769 to the illustrated neutral position at which the shafts are locked against rotation. Springs 771 and 772 operate between the bearing members 763 and 764 and walls of two cup members 773 and 774 that press against opposite sides of member 769 through two ball bearing assemblies 775 and 776. The cup members 773 and 774 are slidably supported within supports 777 and 778 and have rim flanges that engage the supports 777 and 778 to limit movement of member 773 to the right and of member 774 to the left.

To maintain meshing engagement of the pinion member 758 with the rack member 756, a flanged roller 780 is engaged with the upper surface of the rack member 756 and is journaled on a shaft 781 that has opposite ends secured to a pair of arms 782 and 783 that are journaled on opposite end portions of the pinion member 758.

Figure 53:
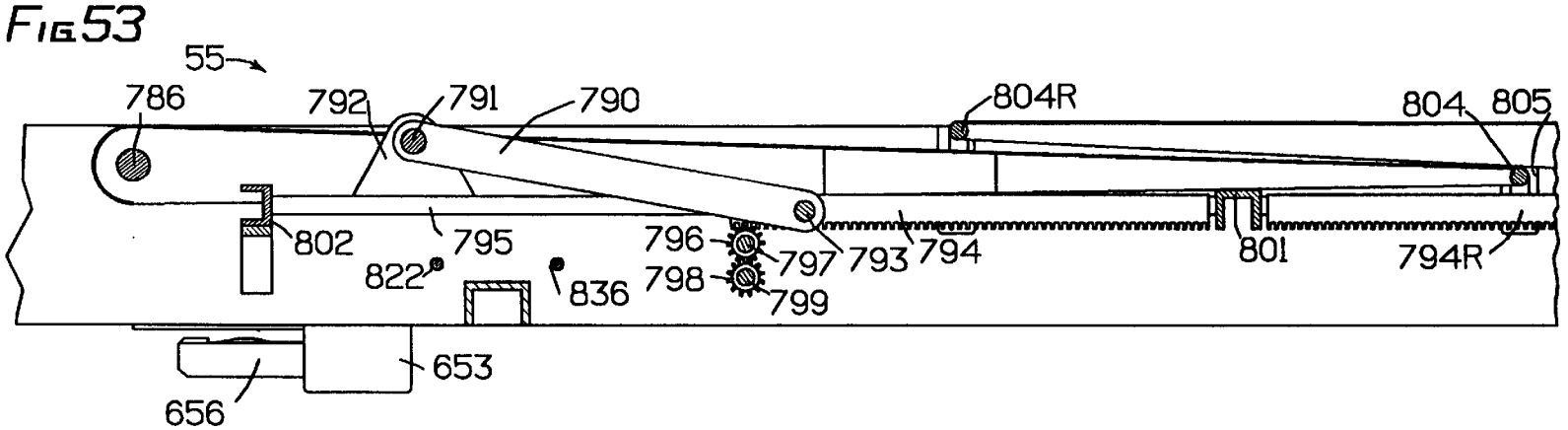
FIGS. 53 and 54 are sectional views illustrating the operation of cage structures.
Figure 54:
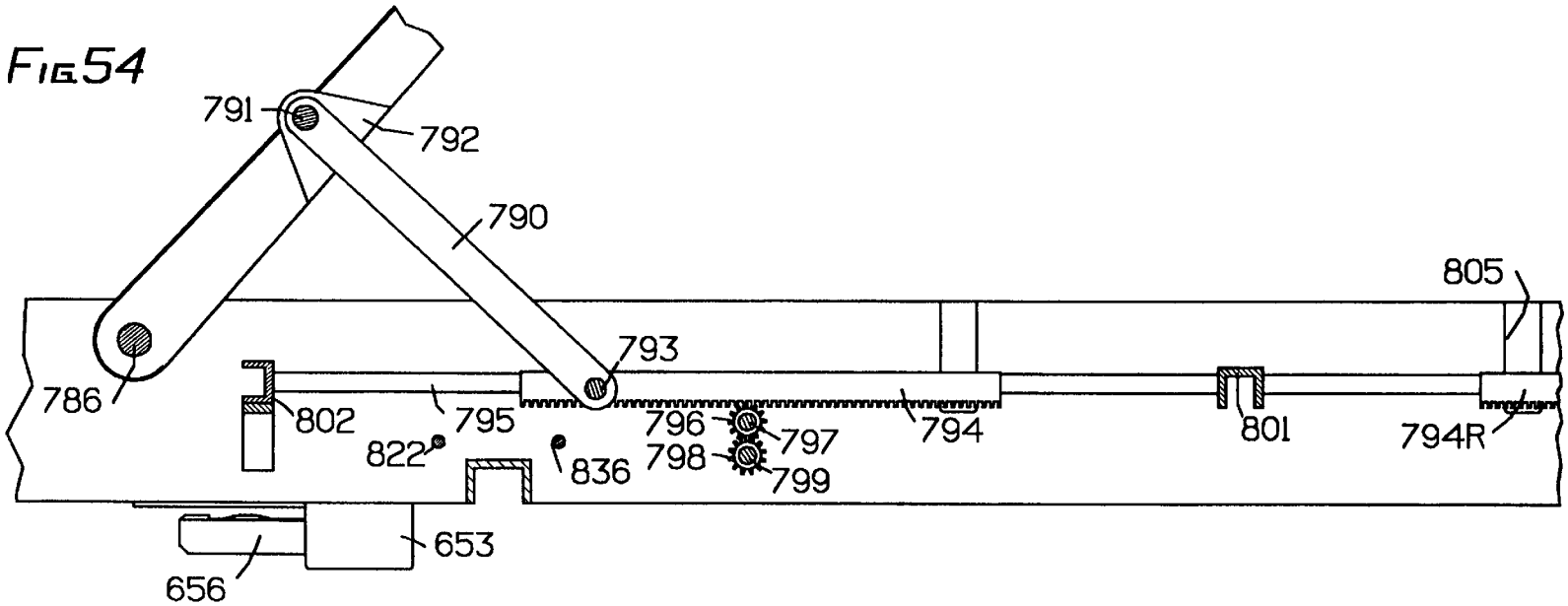

Cage Structure Actuation (FIGS. 53 & 54)

FIG. 53 is a sectional view taken substantially along line 53—53 of FIG. 47 and showing portions of the cage structures 55 and 56 in lowered positions, FIG. 54 being a similar view showing portions of the cage structures 55 and 56 in partially elevated positions. The front cage structure 55 includes a left side arm 784 on its left side that has an inverted U-shaped cross-sectional configuration, including a top wall portion 784A and a pair of side wall portions 784B only one of which appears in FIGS. 53 and 54. One end of the left side arm 784 is supported on a shaft 786 that is supported between an inner side wall 787 of the platform 11 and an outer side wall 788 shown in FIG. 47. One end of a link 790 is connected through a pin 791 to a pair of reinforcing plates 792 secured to side wall portions 784B at an intermediate point along the arm 784. An opposite end of the link 790 is connected through a pin 793 to a rack member 794 that is slidable along a supporting shaft 795 and that has teeth meshed with teeth of a pinion 796 on a shaft 797. A second pinion 798 in mesh with the pinion 796 and is secured on a shaft 799 that has one end with a pointed hexagonal shape to form the control element 61. The opposite end of the shaft 799 is coupled to one end of a shaft of a brake assembly that is not shown, but which is similar to that which includes members 769 and 770 as shown in FIG. 52, differing therefrom in being of a larger size to be capable of handling higher torques. The opposite end of the shaft of the brake assembly is connected to one end of a shaft the opposite end of which forms a control element 61A on the right side of the platform as shown in FIG. 47.

The pinion 796 is supported against movement in an axial direction and the pinion 798 is secured to the shaft 799, the two pinions having axial lengths such that they are maintained in rotational interengagement while allowing axial movement of the shaft 799 in either direction.

The support shaft 795 for the rack member is secured at opposite ends to pair of support members 801 and 802 that are secured to frame members of the platform 11. The arm 784 is lowered by moving the rack member 794 toward the support member 801 as shown in FIG. 53 and is raised by moving the rack member 794 toward the support member 802 as shown in FIG. 54.

The free end of the left side arm 784 is connected to one end of a transversely extending member 804 that forms a top portion of the front cage structure when elevated but that in the lowered position of FIG. 53 is disposed in a recess 805 formed in inner side wall and floor portions of the platform 11. The opposite end of the member 804 is secured to a right side arm 784A shown in FIG. 47 which has a configuration mirroring that of arm 784 and which is similarly supported.

The rear cage structure 56 includes arms 784R and 784AR and a transversely extending member 804R and it is operated by an actuating mechanism that includes a rack member 794R corresponding to the arms 784 and 784A and members 804 and 794 of the front cage structure. It also includes shafts that are like those of the front cage structure and that provide the control element 62 and a control element 62A, corresponding to elements 61 and 61A. Its construction and operation are substantially identical to those of the front cage structure 55.

Wheel Chock Actuation (FIGS. 55–62)

Figure 55:
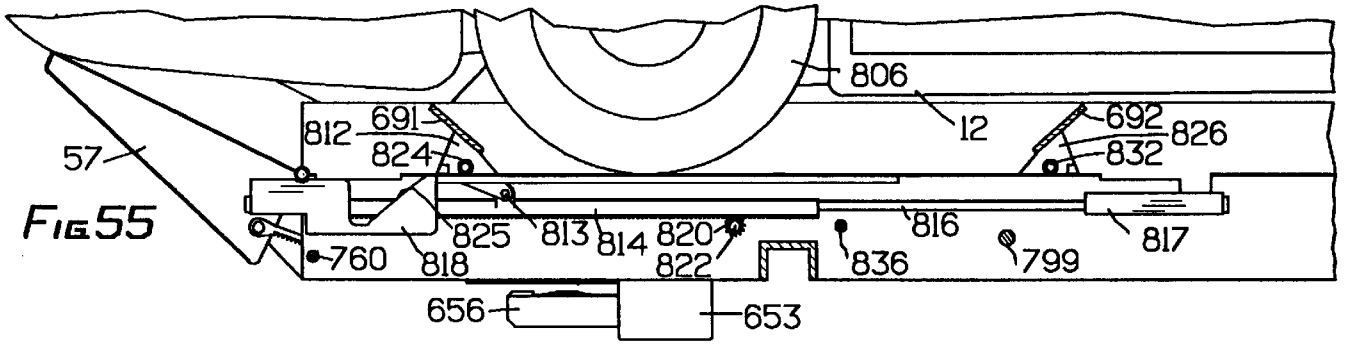
FIG. 55 is a sectional view taken along line 55—55 of FIG. 47.
Figure 56:
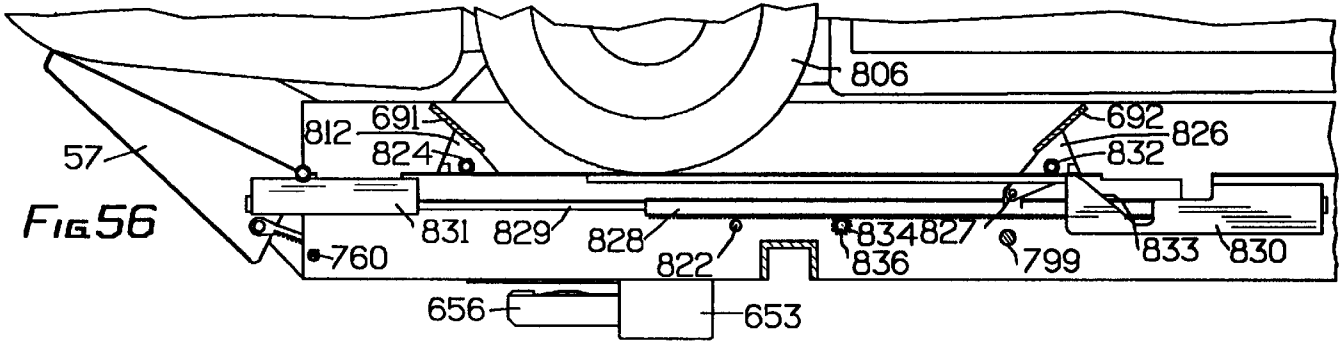
FIG. 56 is a sectional view taken along line 56—56 of FIG. 47.
Figure 57:
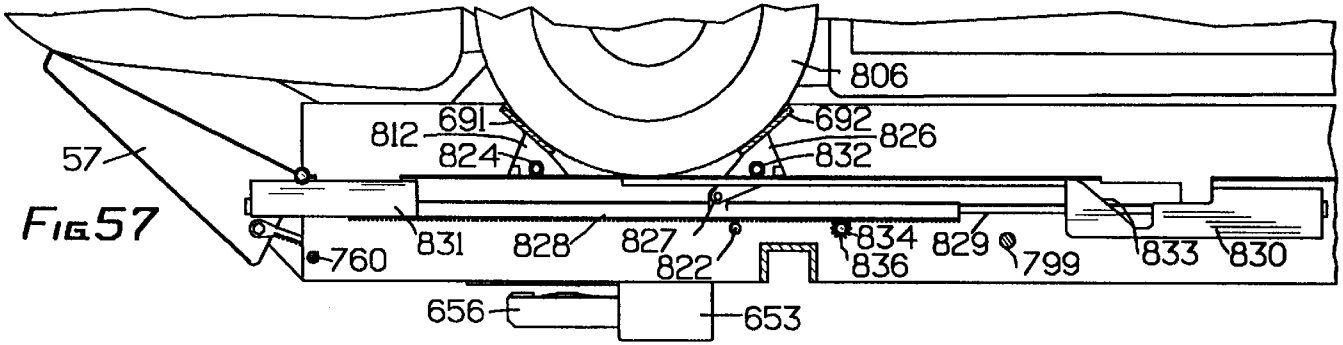
FIG. 57 is a view like FIG. 56 illustrating parts in a different condition.

FIGS. 55 and 56 are sectional views taken substantially along lines 55—55 and 56—56 of FIG. 47 but both illustrating a condition in which the automobile 12 in on the platform 11, in which the front end flap 57 has been raised into engagement with a front bumper of the automobile 12 and in which the wheel chocks 691 and 692 have been raised out of retracted positions to be moved toward front tires 806 of the automobile 12. FIG. 55 shows details of an actuating mechanism for the wheel chock 691 while FIG. 56 shows details of an actuating mechanism for the wheel chock 692. FIG. 57 is a view similar to FIG. 56 but showing a condition in which the wheel chocks 691 and 692 have been moved to operative positions in engagement with the front tires 806 of the automobile 12.

In FIG. 47, reference numerals 807 and 808 generally indicate a pair of transversely spaced supporting and operating mechanisms for the wheel chock 691 and reference numerals 809 and 810 generally indicate a pair of operating mechanisms for the wheel chock 692 that are transversely spaced from each other and from the mechanisms 807 and 808 for the wheel chocks 691. The support and operating mechanism 807 for the chock 691 is shown in FIG. 55. It includes a plate 812 that is secured to the chock 691 and that is pivotally connected through a pin 813 to a rack member 814 that is supported on a shaft 816 for slidable movement therealong. Rearward and forward ends of the shaft 816 axe supported by support structures 817 and 818.

The rack member 814 has teeth meshed with a pinion 820 that is secured to a shaft 822 that has one end with a pointed hexagonal shape to form the control element 65 shown in FIG. 47. The opposite end of the shaft 822 is coupled to one end of a shaft of a brake assembly that is not shown, but which is similar to that which includes members 769 and 770 as shown in FIG. 52. The opposite end of the shaft of the brake assembly is connected to one end of a shaft that supports and drives a pinion of the mechanism 808 and that has an opposite end forming a control element 65A on the right side of the platform as shown in FIG. 47.

A support roller 824 is secured to the support plate 812 for the chock 812. When the rack member 814 is moved to the left from the position shown in FIG. 55, the support roller 824 moves down an inclined surface 825 of the support structure 818, the rack member 814 being placed in a retracted position when the roller reaches the bottom end of the inclined surface 825. When with the chock 691 in the retracted position the rack member 814 is moved to the right as the roller 824 moves up the inclined surface 825 to place the chock 691 at an angle as shown in FIG. 55, in position to move rearwardly toward an operative position in engagement with the tire 806.

The operating mechanism 809 for the chock 692 is similar to the operating mechanism 807 for the chock 691. It includes a chock support plate 826 corresponding to plate 812 connected through a pin 827 to a rack member 828 that corresponds to rack member 814 and that slides on a shaft 829 having ends supported by rearward and forward support structures 830 and 831. It also includes a roller 832 on the plate 826 that corresponds to roller 824 and that is movable on an inclined surface 833 of the support structure 830. A pinion 834 has teeth in continuous mesh with teeth of the rack member and is secured a shaft 836 having a pointed end of hexagonal shape forming the control element 66. Like shaft 822 Df the assembly 807, shaft 836 of the assembly 809 is coupled to a shaft of a brake assembly, the shaft of the brake assembly being coupled to a shaft that operates the other assembly 810 for the chock 692 and that has a end forming the control element 66A.

When rack member 814 of the assembly 807 is moved rearwardly and rack member 828 of the assembly 809 is moved forwardly, the chocks 691 and 692 are moved rearwardly and forwardly into operative engagement with front and rear portions of the front tires 806, as shown in FIG. 57, to hold the automobile 12 against movement relative to the platform 11. The chocks 693 and 694 for the rear wheels of the automobile are supported and operated by mechanisms that are substantially identical to those for the chocks 691 and 692 and that are therefore not described in detail.

FIGS. 58–63 provide further details as to the construction of the mechanism 809 that are also applicable to the mechanisms 807 and 808 for the chock 691 and the other mechanism 808 for the chock 692 as well as to the mechanisms for the chocks 693 and 694.

Figure 58:
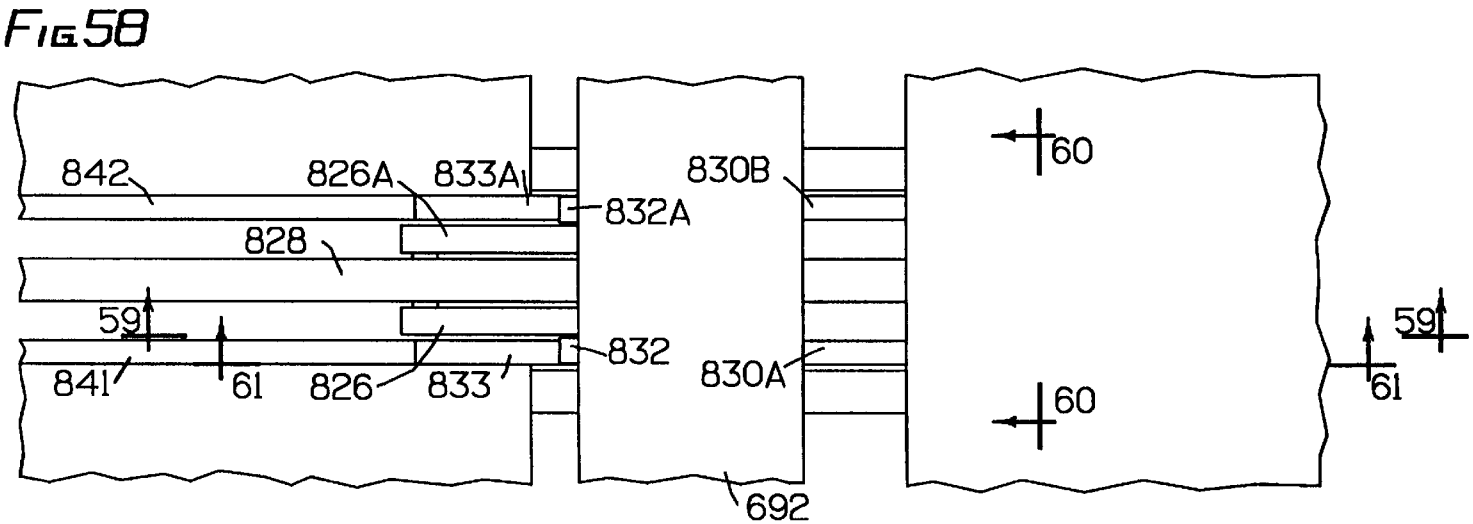
FIG. 58 is a top plan view of a portion of the automobile platform of FIG. 47 on a greatly enlarged scale.

FIG. 58 is a top plan view showing portions of transversely spaced wall portions 830A and 830B of the support structure that provide the inclined surface 833 and also a second inclined surface 833A of identical form. A second support plate 826A is provided which is like the plate 826 shown in FIGS. 55–57 and in spaced relation thereto and which supports a second roller 832A that is like roller 832. The shaft 829 and the rack member 828 thereon are disposed between plates 826 and 826A and the chock support plates 826 and 826A with the rollers 832 and 832A thereon are disposed between the walls 830A and 830B.

Figure 59:
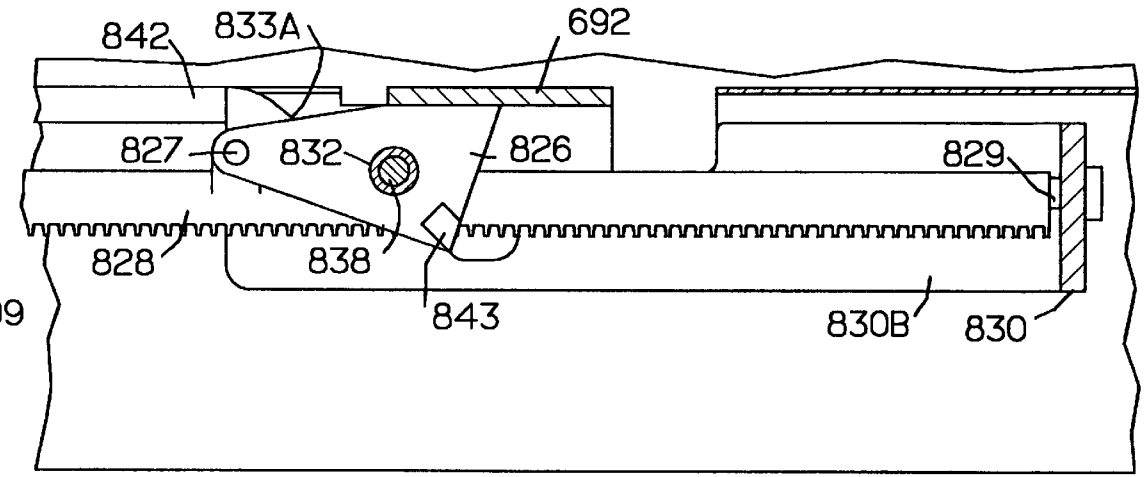
FIGS. 59, 60 and 61 are sectional view taken along lines 59—59, 60—60 and 61—61 of FIG. 58.
Figure 61:
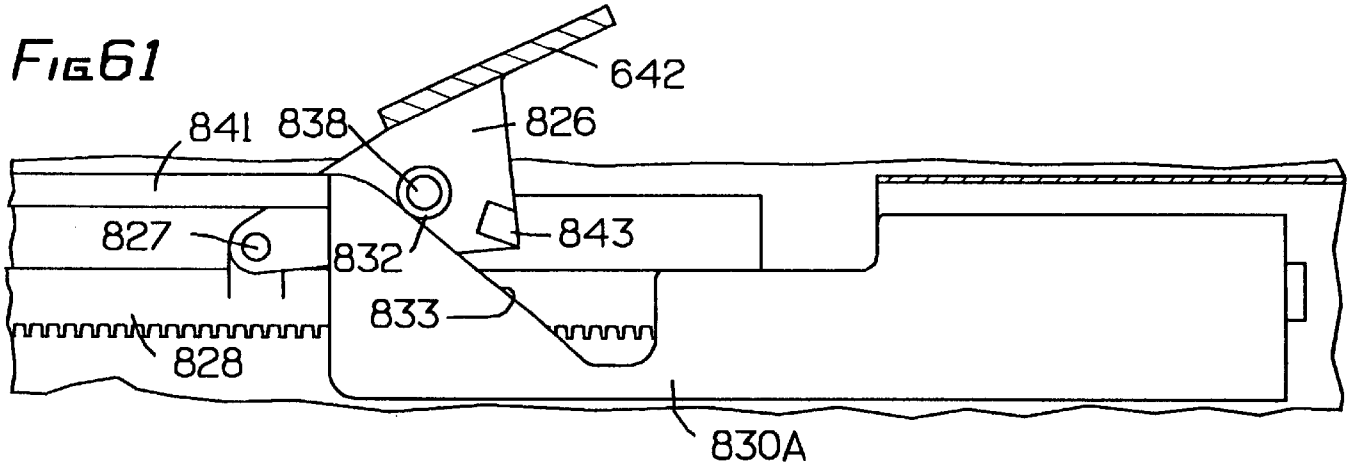
Figure 62:
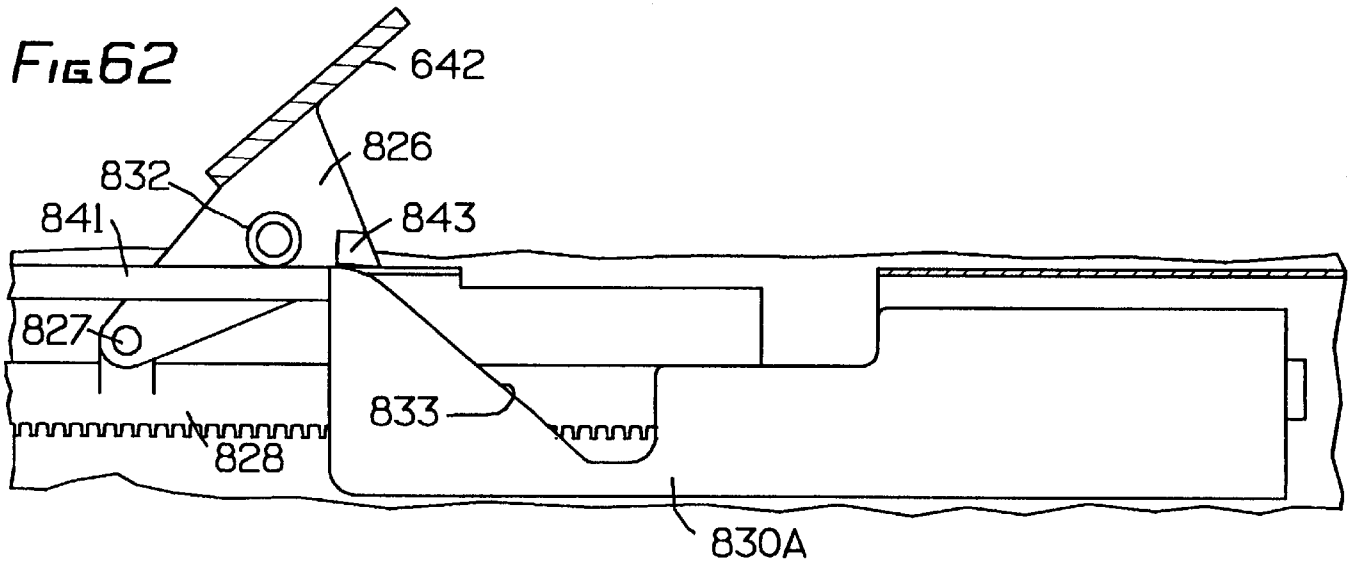
FIG. 62 is a view similar to FIG. 61 illustrating parts in a different condition.
Figure 63:
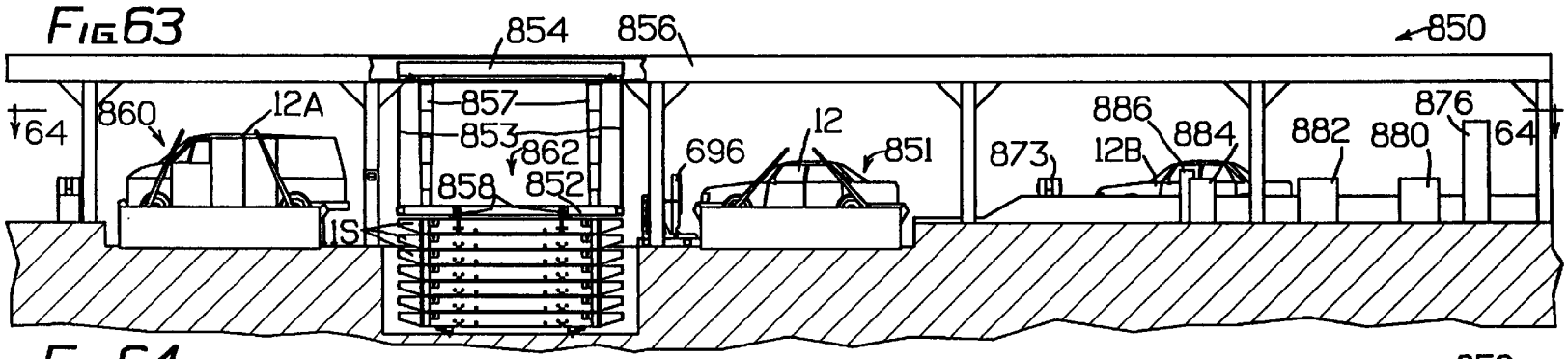
FIG. 63 is a side elevational view of a automobile loading and unloading facility.

As is shown in FIG. 59 and also in FIGS. 61–63, the roller 832 is journaled on a shaft 838 secured to plate 826. Roller 832 is journaled on a similar shaft that is secured to plate 826A.

Figure 60:
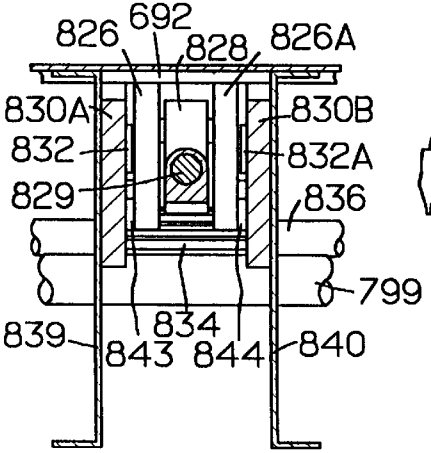

FIG. 60 shows the pinion 834 that is secured to the shaft 836 and that has an axial length sufficient to remain in continuous mesh with the teeth of the rack member 828 during axial movement of the shaft 836 when releasing the brake assembly and allowing operation of the chock assemblies. FIG. 60 also shows frame members 839 and 840 to which the walls 830A and 830B of the support structure 830 are secured.

FIGS. 61 and 62 show the movement of the chock 692 as the rollers 832 and 832A move up the inclined surfaces 833 and 833A. As shown in FIG. 63, after the roller 832 reaches the top of the inclined surface 833, it rides on a member 841 that is secured along an upper portion of the frame member 839 of the platform 11. The roller 832A rides on a similar member 842 that is secured along the upper portion of the frame member 840. A pair of cleats 833 and 834 are provided on the chock support plates 826 and 826A. The position of the cleats 833 and 834 is such that they are spaced a short distance from the support members 841 and 842 when the chock 692 is being moved toward the tire of an automobile. However, after the chock 692 is engaged by a tire, the force applied by the tire may be such as to slightly rotate the chock about the points of engagement of the rollers 832 and 832A with the members 841 and 842 to engage the cleats 843 and 834 with the members 841 and 842. The cleats 843 and 834 may then carry major portions of the applied forces, minimizing stresses applied to other components.

Automobile Load/Unload Facility (FIGS. 63–66)

Figure 64:
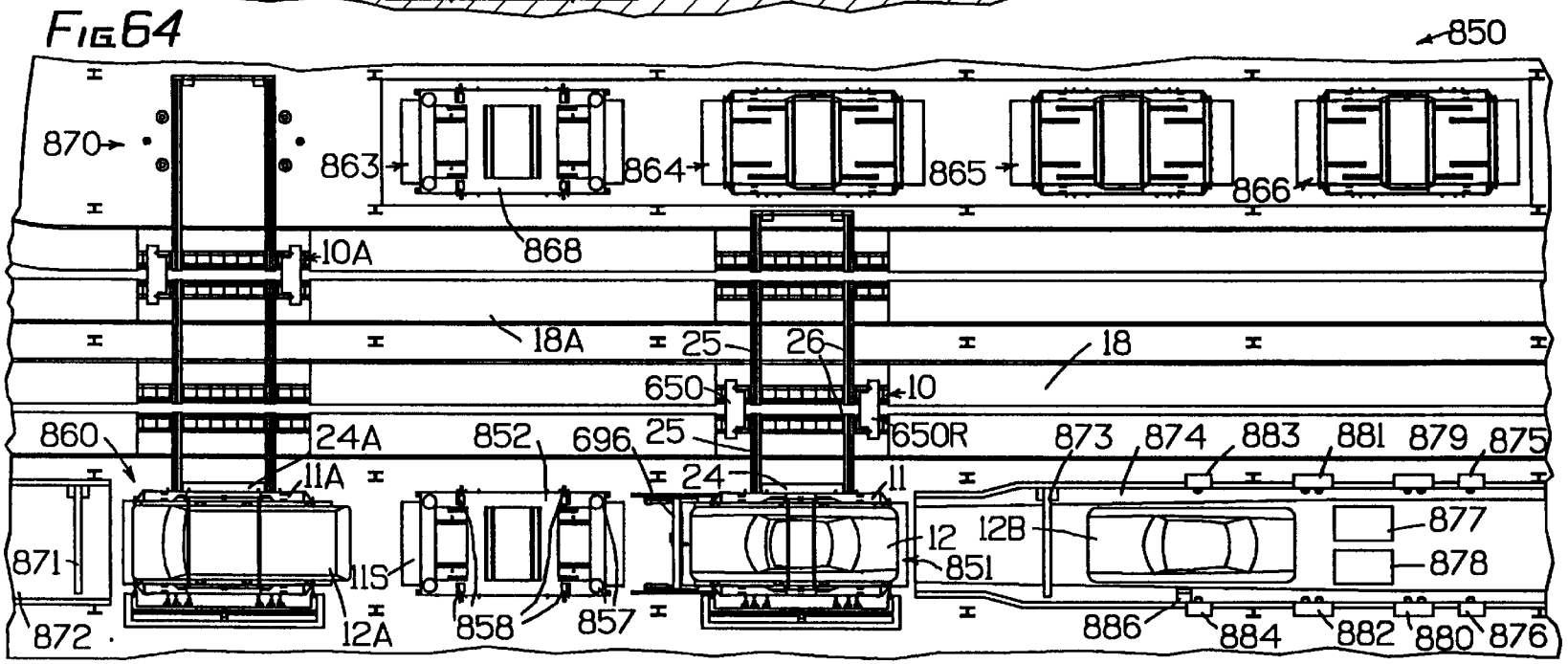
FIG. 64 is a sectional view taken along line 64—64 of FIG. 63 and providing a plan view of equipment in the facility.

FIG. 63 is a side elevational view of an automobile load/unload facility generally indicated by reference numeral 850, showing the facility without side walls that are preferably provided. FIG. 64 is a sectional view taken substantially along line 64—64 of FIG. 63.

The automobile 12 is shown on the platform 11 at the loading position of FIG. 47, indicated by reference numeral 851 in FIGS. 63 and 64, while the carrier vehicle 10 is positioned in a transfer section of the guideway 18. The front pad 650 of vehicle 10 and a corresponding rear pad 650R thereof are positioned ahead and behind the beam structures 25 and 26.

After the automobile 12 is securely locked to the platform 11, the transfer vehicle 24 is operative to lift the platform a short distance and to then move to the transfer section of guideway 18 in a position between the front and rear pads 650 and 650R of the vehicle 10. Then the transfer vehicle 24 lowers the platform 11 and the prong structures 27 and 28 are then operative to securely lock the front and rear pads 650 and 650R to connectors such as the connector 651, in the manner as shown in FIGS. 42–46.

The transfer vehicle 24 is then moved back to the loading position after which the carrier vehicle 10 is operative to move the platform 11 and the automobile 12 carried thereby in a forward direction along the guideway 18, to the left as viewed in FIGS. 63 and 64 and toward the desired destination.

To then move another platform to the loading position, platform transfer apparatus is provided including a platform transfer frame 852 that is supported through four cables 853 from a platform frame carrier 854. The carrier 854 is supported on motor-driven wheels for controllable movement along an overhead structure 856 and is connected to the transfer frame 852 through four telescoping guide assemblies 857 that limit horizontal movements of the transfer frame 852 relative to the carrier 854. Four solenoid operated latching devices 858 are carried by the platform transfer frame 852 and are arranged to latch onto a platform at one position and then hold the platform to the frame 852 while the frame 852 moves to another position at which the platform latching devices 858 are operated to release the platform.

The transfer frame carrier 854 is controllably movable along the overhead structure 856 between positions including a position over the loading position 851, a position over an unloading position 860 and a position as shown over a platform storage position 862. A platform 11A is shown at the unloading position with an automobile 12A of a van type thereon. The platform 11A may be assumed to have just been transferred by a transfer vehicle 24A from a carrier vehicle 10A in a transfer section of a guideway 18A. Guideway 18A is used primarily for incoming vehicles and may be referred to herein as the incoming guideway while guideway 18 may be referred to as the outgoing guideway. However, it is possible to use either guideway for either or both purposes such as when servicing of one of the guideways may be required.

A plurality of platforms 11S may be stacked at the storage position 862, in folded conditions as shown in FIG. 63 and the transfer frame 852 may be used in transferring platforms from the storage position 862 to the loading position 851 or to the storage position 862 from the unloading position, as conditions may require.

During the time that an automobile is being driven onto an empty platform at the loading position 851, the transfer frame 852 may be operative to latch onto and lift the top platform from the storage position to an elevated level that is above the highest possible level of the cage structures 55 and 56 and to then hold the platform at the elevated level over the unloading position 851 until movement of an automobile carrying platform out of the unloading position. The transfer frame may then rapidly lower the platform to the loading position, then release the platform, then move up to an elevated level, then move back to a position over the storage position 862, then move down to again latch onto the top platform and move it to an elevated position over the loading position 851. A rapid loading procedure is thus provided in which any delay due to transfer of platforms to the loading position 851 is minimized.

The rapid loading procedure is particularly desirable during rush hour or other periods in which the demand for travel in an outgoing direction is at a peak. At times when the demand for travel in an incoming direction is at a peak, a rapid unloading procedure may be used in which the transfer frame after delivering a platform to the storage position is rapidly moved in an empty condition to a position at an elevated level over the unloading position 860, ready to move down and pick up and remove a folded platform to clear the unloading position for arrival of another vehicle.

As shown, four additional platform storage positions 863–866 are provided along a far side of the guideway 18A and a transfer frame 868 is provided for transfer of platforms between such positions and a platform transfer position 870. A platform frame carrier like the carrier 854 is movable along a structure like structure 856 above the positions 863–866 and 870. The transfer vehicle 24A is usable to transfer a folded platform or a plurality of folded platforms from one to the other of four positions, the positions 860 and 870 and the two possible positions of carrier vehicles in the transfer sections of guideways 18 and 18A between positions 860 and 870. Movements of platforms may thus be effected within the facility 850 or on carrier vehicles between the facility 850 and other facilities. Such movements may be effected to obtain the most efficient use of the system.

As further shown in FIGS. 63 and 64, an exit gate 871 is provided to control movement of automobiles from a platform at the unloading position and onto a exit driveway 872. An entrance gate 873 is provided between an entrance driveway 874 and the loading position 851, an automobile 12B being shown waiting on the entrance guideway 874.

Sensing devices are provided along the entrance driveway 874 for determining arrival and dimensions of a vehicle. A pair of structures 875 and 876 are located on opposite sides of the driveway 874 and include pairs of light sources and photo sensors that are spaced vertically and that extend to a height sufficient for generation of data as the approximate height of a passing automobile.

Pressure sensing assemblies 877 and 878 are provided that include sensors which detect downward pressures on a series of members that extend transversely with respect to the direction of travel and that are spaced short distances from one another in the direction of travel. Another pair of structures 879 and 880 are located behind the pressure sending assemblies 877 and 878, a third pair of structures 881 and 882 are located ahead of the pressure sensing assemblies 877 and 878 and a fourth pair of structures 883 and 884 are located still further ahead of the pressure sensing assemblies 877 and 878, each of such pairs of structures including pairs of light source and photo sensing devices so located as to detect the times when front and rear bumpers of automobile pass certain points.

Signals from the sensors of the pressure sensing assemblies 877 and 878 are correlated with each other and with signals from the devices of the structures 879–884 to develop data as to the overall length of an automobile and the distances from front and rear bumpers to front and rear wheels. Data as to the weight of an automobile are also developed from the pressure sensing devices of the assemblies 877 and 878. Such data are used to determine whether the automobile is acceptable for transport by the system and are also used for accurately locating the position of the stop wall 696 in order that the wheels of the automobile be properly positioned relative to the wheel chocks 691–694.

Each user of the system is preferably issued a compact and light weight communication device that is not shown but that can be carried in a pocket or purse and each user is also given a personal identification number that may be memorized and kept secret. The device is like a cordless phone in having key pad, microphone and earphone components and is usable at any time the user is in a station of the system or in a automobile or cabin being carried by a carrier vehicle. It is for use mostly for entry into the system, for signalling a destination and for obtaining instructions and information from a central operator of the system.

However, the device is very important in that it can be used to send an emergency signal to a central operator of the system, by entering "911" for example, and then talking directly with the operator. The device will then transmit data such that the operator will immediately have information as to a user's location and, if the user is in a station, will be able to see what is happening through a closed circuit TV system as well as being able to hear what is picked up by the device. The operator can then communicate with security personnel in the vicinity and with police, ambulance or other services, as may be necessary. If a user becomes ill or is threatened in any way while in a car or cabin being carried by a carrier vehicle, the operator may cause the vehicle to stop at a particular station and make requests to an ambulance service or the police to be at that station.

If desired, of course, the system may so operate as to permit use without the communication device and without the security and advantages it provides. As shown, apparatus 886 is provided alongside a waiting position behind the entrance gate 873 for use of a regular or specially issued credit card and for use of coins or bills to effect payment.

Figure 65:
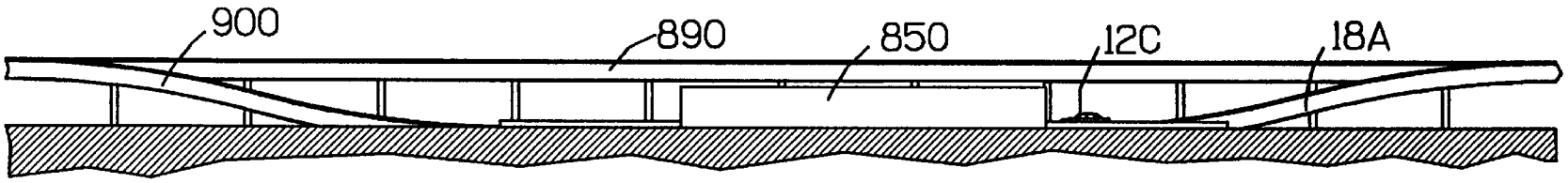
FIGS. 65 and 66 are side elevational and plan views showing the facility of FIGS. 63 and 64 located along a roadway and showing guideways connected thereto.
Figure 66:
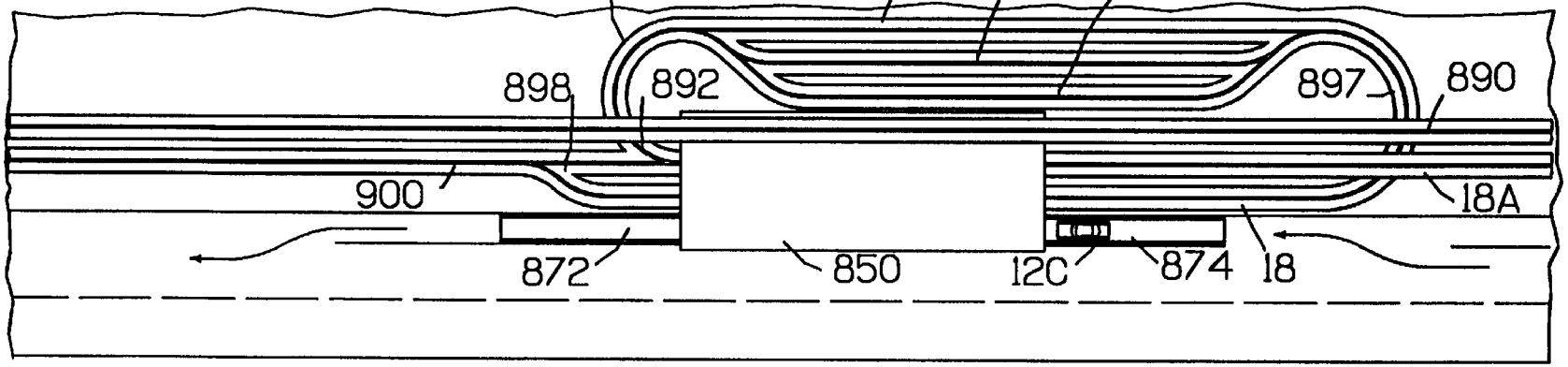

FIGS. 65 and 66 are side elevational and plan views showing the facility of FIGS. 850 located along a roadway and showing guideways connected thereto. The directions of movement of automobiles from an adjacent roadway into the entrance driveway 874 and from the exit guideway to the roadway are indicated by arrows.

Incoming carrier vehicles enter along the guideway 18A which is a branch line guideway on which the vehicles travel after exiting from a branch line exit of a Y junction in an elevated main line guideway 890. The Y junction, which is not shown in FIGS. 65 and 66, is at a substantial distance from the facility 850, sufficient to allow the vehicle to safely reduce its speed, go down an inclined portion of the guideway 18A such as shown in FIG. 65 and enter the facility 850 at a slow speed, coming to a stop within the facility 850 at the transfer section at which vehicle 10A is shown in FIG. 64.

After an automobile carrying platform is transferred from a carrier vehicle to the unloading position 860 of FIGS. 63 and 64, the empty carrier vehicle normally exits along the right portion of a Y junction 892 and moves through a semi-circular guideway section 893 to a guideway of a vehicle storage region that includes three parallel guideway sections 894–896.

Empty carrier vehicles move from the storage region and through a semi-circular guideway portion 897 to the guideway 18. The number of stored empty carrier vehicles is normally such that a queue of vehicles extends to the transfer section in the facility 850, a vehicle at the end of the queue being ready to move a short distance to enter the transfer section as a loaded vehicle moves out of the section. FIG. 64, the vehicle 10 shows the vehicle 10 at the transfer section of guideway 18, ready to have the platform 11 with automobile 12 thereon transferred to its pads 650 and 650R. After such transfer, the vehicle 10 may then move out through the guideway 18 and move to one entrance of a section 898 that has an exit to a guideway 900, a second entrance being from a left portion of the Y junction 892 and that has an exit to a guideway 900. As shown in FIG. 65, guideway 900 is inclined upwardly to the level of the main line guideway 890. It joins the main line guideway 890 in a junction that is not shown but that is at a substantial distance from the facility 850, sufficient to allow the carrier vehicle 10 to accelerate to a speed that will not substantially slow down vehicles travelling on the main guideway 890.

It will be understood that modifications and variations may be effected without departing from the spirit and scope of the novel concepts of this invention.

What is claimed is:

1. A transportation system, comprising: a plurality of carrier vehicles, a guideway for guiding said carrier vehicles for movement therealong and having stop positions therealong, drive means for moving said carrier vehicles along said guideway between said stop positions therealong, characterized in that said guideway includes a pair of side wall portions and a pair of upper wall portions extending inwardly from upper ends of said side wall portions and to ends in transversely spaced relation to define a slot, and characterized in the provision of front and rear support posts projecting upwardly from each of said carrier vehicles and through said slot for supporting bodies of various types above said guideway, transfer means for moving said bodies between transfer positions in proximity to certain of said stop positions and holding positions that are located alongside said guideway at a substantial distance from said transfer positions, connection means operable in connect conditions thereof to securely interconnect any of said bodies of various types and said front and rear support posts of carrier vehicles positioned at said transfer positions and operable in disconnect conditions thereof to allow said transfer means to move said bodies between said transfer positions and said holding positions, wireless signal transmission means including stationary elements supported at protected positions below said top wall portions of said guideway and movable elements supported by said carrier vehicles and inductively coupled to said stationary elements during movement of said carrier vehicles within said guideway, monitoring and control means along said guideway for applying control signals to said stationary elements, and control circuit means on said carrier vehicles coupled to said movable elements for receiving said control signals and for controlling said drive means to effect automated movement of each of said carrier vehicles from one of said stop positions to another of said stop positions.

2. A transportation system as defined in claim 1, means associated with said connection means for effecting electrical connections between electrical circuit means in said bodies and electrical circuit means in said carrier vehicles.

3. A transportation system as defined in claim 1, said connection means including connectors on said bodies, support pad means on said carrier vehicles, and releasable locking means for effecting a secure locking interengagement between said connectors and said support pad means to securely connect any said one of said bodies and one of said carrier vehicles, and said transfer means including support elements movable horizontally between first positions in supporting relation to said connectors and second positions clear of said supporting relation to said connectors, and said releasable locking means including locking elements operable to released positions when said support elements of said transfer means are moved to said first positions and operable to locked positions when said support elements of said transfer means are moved to said second positions.

4. A transportation system as defined in claim 3, said locking elements being movable horizontally in directions parallel to the directions of movement of said support elements of said transfer means, and means associated with said support elements for interengaging said locking elements and moving said locking elements from said released positions to said locked positions when said support elements are moved from said first positions thereof to said second positions thereof.

5. A transportation system as defined in claim 4, toothed pinions journaled by said connectors, said locking elements being supported by said connectors and having toothed rack portions therealong that are meshed with said toothed pinions, and said support elements having toothed rack portions that are moved into mesh with said pinions during an initial portion of movement of said support elements from said first positions thereof toward said second positions thereof and to thereafter cause said pinions to move said locking elements from said locked positions to said released conditions upon movement of said support elements to said second positions thereof, said pinions being operative to move said locking elements back to said locked positions thereof when said support elements are moved back from said second positions thereof to said first positions thereof.

6. A transportation system as defined in claim 3, first electrical contact means carried by said support pad means, second electrical contact means carried by said connectors, and third electrical contact means carried by said locking elements for connecting said first and second electrical contact means when said locking elements are moved to said locked positions thereof.

7. A transportation system as defined in claim 1, wherein one of said bodies includes data entry and storage means, signal processor means in one of said carrier vehicles, and signal transmitting means operative when said connection means is operative between said one of said carrier vehicles and said one of said bodies for transmitting signals between said signal processor means and said data entry and storage means.

8. A transportation system as defined in claim 1, wherein said guideway includes Y junctions, said movable elements including elements on left and right sides of each of said carrier vehicles, and said stationary elements including stationary elements along left and right sides of said guideway for inductive coupling to said left and right movable elements during movement of said carrier vehicles through said Y junctions and along all other portions of said guideway.

9. A transportation system as defined in claim 1, said guideway including a bottom wall portion positioned a substantial distance below a path of movement of said vehicles in said guideway to provide a region of substantial cross-sectional area above said bottom wall portion and below said path of movement of said vehicles in said guideway, and aerodynamic fairing means on said vehicles including front and rear fairing means defining front and rear surfaces that extend for nearly the full width of said path of movement and that have upper and lower ends positioned close to upper and lower and lower extents of said path of movement, said front surface extending angularly downwardly and rearwardly from said upper end thereof to said lower end thereof for directing air downwardly from said path ahead of said vehicle and into said region and said rear surface extending angularly upwardly and rearwardly from said lower end thereof to said upper end thereof to direct air upwardly from said region and into said path behind said vehicle.

10. A transportation system as defined in claim 1, said carrier vehicles including wheel means, and said guideway including a plurality of sections disposed in end-to-end relationship, each of said guideway sections including a frame structure, a pair of tracks extending therealong for engagement by said wheel means to support one of said vehicle means as it moves along said guideway section, intermediate support means supported by said frame structure for underlying said tracks, resilient means along said intermediate support means for supporting said tracks therefrom, said intermediate support means and said resilient means cooperating with said tracks to provide an optimum path of movement of carrier vehicles so long as the ends of each section are accurately supported in certain positions, adjustable support means for supporting said guideway sections, each of said adjustable support means being arranged for support of one end of said frame structure of one of said guideway sections and one end of said frame structure of an adjacent one of said guideway sections from a support column which is supported from underlying earth and being adjustable to compensate for movements away from said certain positions due to instabilities in the underlying earth.

11. A transportation system as defined in claim 10, said adjustable support means including first and second operating means for independently adjusting the vertical positions of opposite sides of supported ends of said adjacent guideway sections, and a third operating means for simultaneously adjusting the horizontal positions said opposite sides of said supported ends.

12. A transportation system as defined in claim 10, said resilient means having a resiliency that varies along each guideway section to have a greater resiliency at the ends of each section than at the center of each section and to compensate for deflections of said frame and said intermediate support means due to the weight of a passing carrier vehicle and any load thereon.

13. A transportation system as defined in claim 1, said guideway including track means on the insides of said side wall portions and below said inwardly extending upper wall portions, each of said carrier vehicles including a main frame supporting said front and rear posts, and front and rear bogies including front and rear bogie frames connected to said main frame for pivotal movements about front and rear vertical turn axes and including wheel means journaled on said bogie frames and engageable with said track means of said guideway.

14. A transportation system as defined in claim 13, said drive means including electric motor means carried by each of said bogies, and differential gearing means coupling each of said electric motor means to said wheel means.

15. A transportation system as defined in claim 13, said wheel means including front and rear pairs of lower wheels and front and rear pairs of upper wheels, and said track means including a pair of lower tracks for underlying and supporting said lower wheels and a pair of upper tracks for engagement by said upper wheels to restrict rocking movements of said carrier vehicles.

16. A transportation system as defined in claim 15, said upper tracks being contoured at special stop positions along said guideway to interengage with said upper wheels and facilitate accurate stopping of said carrier vehicles at said special stop positions.

17. A transportation system as defined in claim 15, said upper wheels being engageable with downwardly facing surfaces of said upper tracks, bearing means supported from said front and rear bogie frames and operative for journaling said front and rear pairs of lower and upper wheels, and spring means operative between said front and rear bogie frames and said bearing means for urging said upper wheels into pressure engagement with said downwardly facing surfaces of said upper tracks.

18. A transportation system as defined in claim 17, said drive means including electric motor means on each of said front and rear bogie frames, and gearing means coupling each of said electric motor means to said pairs of lower and upper wheels and operative for rotating said lower and upper wheels in opposite rotational directions.

19. A transportation system as defined in claim 17, electrically controllable traction adjustment means for adjusting said spring means to control said pressure engagement between said upper wheels and said downwardly facing surfaces of said upper tracks, said traction adjustment means being controllable as a function of weights carried by said bogies.

20. A transportation system as defined in claim 17, said bearing means including left and right bearing units pivotally supported on said front and rear bogie frames for movement about a horizontal pivot axis, each of said bearing units being operative to journal said lower and upper wheels for rotation about horizontal axes that are spaced from each other in the direction of travel of said carrier vehicle and that are spaced downwardly and upwardly from said pivot axis, said spring means being operative to independently apply forces between said bearing units and said bogie frames.

21. A transportation system as defined in claim 17, said carrier vehicles including means for limiting upward movement of said upper wheels, said guideway including a plurality of Y junctions each including an entrance and first and second exits, each lower track of said pair of lower tracks providing two continuous support surfaces extending from said entrance to said first and second exits, a first one of said pair of upper tracks providing a first surface extending continuously from said entrance to said first exit and a second surface extending from said entrance to said second exit with a gap therein corresponding to said slot in said guideway, a second one of said pair of upper tracks providing a first surface extending continuously from said entrance to said second exit and a second surface extending from said entrance to said first exit with a gap therein corresponding to said slot in said guideway, said second surfaces of said first and second upper tracks being inclined upwardly in approaching said gaps therein and being inclined downwardly following said gaps therein to allow said upper wheels to gradually move upwardly in approaching said gaps gradually move downwardly following said gaps.

22. A transportation system as defined in claim 13, said wheel means including a front pair of left and right wheels journaled for rotation about a horizontal axis by said front bogie frame and a rear pair of left and right wheels journaled for rotation about a horizontal axis by said rear bogie frame, and turn control means cooperating with said guideway means to control the angular positions of said front and rear bogie frames about said vertical turn axes when moving along straight and curved guideway paths.

23. A transportation system as defined in claim 22, said guideway including left and right guide means extending along left and right sides thereof, and said turn control means including left and right turn control portions carried by said front and rear bogie frames at positions spaced forwardly and rearwardly from said front and rear vertical turn axes for cooperative engagement with said guide means to control the angular positions of said bogie frames about said vertical turn axes.

24. A transportation system as defined in claim 23, said turn control portions being pivotal about vertical axes, and said turn control means including cam and cam follower means acting between said turn control portions and said main frame to control rotation of said bogie frames about said vertical turn axes and to maintain said horizontal axes of said front and rear pairs of wheels in parallel relation while moving along straight guideway paths and in intersecting relation at a common vertical turn axis while moving along curved guideway paths.

25. A transportation system as defined in claim 23, said guideway including a Y junction having an entrance and left and right exits, said turn control means having a first condition of operation in which said left portions of said turn control means are engaged with said left guide means in moving from said entrance to said left exit and having a second condition of operation in which said right portions of said turn control means are engaged with said right guide means in moving from said entrance to said right exit, and switching means for selecting between said first and second conditions of operation.

26. A transportation system as defined in claim 25, said front and rear bogies including front and rear members supporting said forwardly and rearwardly positioned left and right portions of said turn control means, each of front and rear members being pivotal about a horizontal axis that is midway between said left and right portions supported thereby and that extends in a generally longitudinally extending direction.

27. A transportation system as defined in claim 25, said left and right guide means being in the form of left and right rib means extending along said pair of tracks on the outside thereof and projecting upwardly from the level of said tracks for engagement with said left and right portions of said turn control means.

28. A transportation system as defined in claim 25, said front and rear pairs of left and right wheels being positioned on the inside of said left and right rib means, said turn control means including left and right position control wheels on said front and rear bogies, said left position control wheels being movable in said first condition of operation to active positions opposite said left wheels of said bogies and on the outside of said left rib means, and said right position control wheels being movable in said second condition of operation to active positions opposite said right wheels of said bogies and on the outside of said right rib means.

29. A transportation system as defined in claim 1, said stationary elements and said monitoring and control means connected thereto being assigned to contiguous portions of said guideway along the length thereof, said vehicle control signals including speed command signals that operate through said control circuit means for drive of said carrier vehicles at speeds commanded by said speed command signals, the lengths of said assigned portions along said guideway being substantially less than a safe following distance of a vehicle behind a vehicle that is moving at a maximum speed along said guideway, and message developing means for supplying a message to each of said monitoring and control means which includes speed and location data as to any vehicle ahead that has a speed of movement such as to require any deceleration of a vehicle passing said monitoring and control means, said speed and location data including the speed of the vehicle ahead and the assigned portion of the guideway ahead in which it is moving, and each of said monitoring and control means including processor means operative to control said speed command signal as a function of said speed and location data as to any vehicle ahead.

30. A transportation system as defined in claim 29, each of said monitoring and control means including detected vehicle speed signal means for developing detected vehicle speed data corresponding to the speed of passing carrier vehicles, said message developing means comprising data transmission means included in each of said monitoring and control means for transmitting data corresponding to said detected vehicle speed data, and detected vehicle data receiving means included in each of said monitoring and control means for receiving data corresponding to data transmitted from data transmission means of a monitoring and control means assigned to a portion of said guideway ahead of said assigned portion.

31. A transportation system as defined in claim 30, said data transmitted by said data transmission means of each monitoring and control means including a retransmission of any data transmitted from a monitoring and control means that is assigned to a portion of said guideway ahead of said assigned portion, each said retransmission of data including data identifying the monitoring and control means forming the original source of retransmitted detected speed data to thereby provide said speed and location data.

32. A transportation system as defined in claim 31, said detected vehicle data transmission means being operative to transmit said data to a first monitoring and control means assigned to a portion of said guideway immediately behind said assigned portion and to receive said detected vehicle data transmitted from a second monitoring and control means assigned to a portion of said guideway immediately ahead of said assigned portion, being also operative to retransmit data received from said second monitoring and control means to said first monitoring and control means, each said transmission of data including data identifying the initial source thereof, and each monitoring and control means including processing means for processing received data and generating a speed command signal for control of passing carrier vehicles to maintain a safe distance between carrier vehicles.

33. A transportation system as defined in claim 29, said guideway including a main line guideway and a branch line guideway merging with said main line guideway in a certain region, said monitoring and control means including main line monitoring and control means and branch line monitoring and control means, merge control means coupled to said main line and branch line monitoring and control means for monitoring detected vehicle data and for controlling speeds of carrier vehicles moving on said branch line guideway to safely enter traffic on said main line guideway, said merge control means being operative to apply signals to said detected vehicle data receiving means of said main line monitoring and control means to simulate a carrier vehicle so moving along said main line guideway as to reach said merge region at the same time as a carrier vehicle moving on said branch line guideway.

34. A transportation system as defined in claim 33, said message developing means further including means for supplying messages to monitoring and control means. along said branch line guideway to cause movement of a vehicle thereon at a safe following distance behind any vehicle that may be ahead of said simulated carrier vehicle.

35. A transportation system as defined in claim 1, said vehicle circuit means including means for transmitting identification messages to said monitoring and control means through signals applied through said movable elements and said stationary elements, said messages being in the form of digital data and being transmitted at a rate such that each monitoring and control means receives at least several complete messages during a time interval in which a carrier vehicle moving at maximum speed passes through a length of said guideway that is assigned to said monitoring and control means.

36. A transportation system as defined in claim 1, said guideway being divided into a number of separate sections for control purposes, each of said separate sections including a plurality of said monitoring and control means therealong, and section control means for each of said sections coupled through communication links said plurality of said monitoring and control means thereof for supplying control data for control of vehicles moving along said section.

37. A transportation system as defined in claim 1, said bodies of various types including a plurality of platforms onto which automobiles can be securely loaded, said stop positions including platform receiving positions and platform delivery positions at which platforms loaded with automobiles may be interconnected with and disconnected from front and rear posts of carrier vehicles positioned thereat, and said holding positions including automobile loading and automobile unloading positions which are associated with said platform receiving and delivery positions and at which platforms may be loaded and unloaded by driving of automobiles thereon and therefrom.

38. A transportation system as defined in claim 37, storage means for storing a plurality of said platforms, and platform handling means for transfer of platforms from said storage means to said automobile loading positions and for transfer of platforms from said automobile unloading positions to said storage means.

39. A transportation system as defined in claim 38, receiving driveway means and delivery driveway means for driving of automobiles onto and from platforms at said automobile loading and unloading positions, said automobile loading positions and automobile unloading positions being between said receiving and delivery driveway means.

40. A transportation system as defined in claim 39, and said platform storage means arranged to store said platforms in stacked relation and being located between said automobile loading and unloading positions.

41. A transportation system as defined in claim 1, said guideway including track means for engagement by said wheel means to support said carrier vehicles for movement along said guideway in a predetermined path and being formed in sections each section comprising left and right side walls of sheet material extending for the length of said section, left and right lower longitudinally extending frame members separate from said left and right side walls, left and right upper longitudinally extending frame members separate from said left and right side walls, a plurality of assemblies in longitudinally spaced relation each assembly including left and right vertical members of sheet material in longitudinally spaced vertical planes and a cross member of sheet material having opposite ends secured to lower portions of said vertical members, means securing lower ends of each assembly to said left and right lower frame members at predetermined points of connection therealong, means securing upper ends of said left and right vertical members to said left and right upper frame members at predetermined points of connection therealong, means securing outside portions said vertical members to said left and right side walls at predetermined points of connection therealong, and track support means for supporting said track means along inside portions of said vertical members, said vertical members being of uniform shape and dimensions and said track support means having uniform positions relative to said vertical members, said predetermined points of connection being such as to obtain predetermined axes and radii of curvature of said track in vertical and horizontal directions.

42. A transportation system as defined in claim 1, said guideway including a bottom wall portion, and said bottom, side and top wall portions including materials that absorb acoustic energy, said stationary and movable elements being in closely spaced relation during movement of said carrier vehicles along said guideway, and said guideway providing a protected environment for signal transmissions made through inductive couplings between said stationary and movable elements.

43. A transportation system, comprising: a plurality of carrier vehicles, a guideway for guiding said carrier vehicles for movement therealong and having stop positions therealong, and drive means carried by said carrier vehicles for coaction with said guideway for effecting movement of said carrier vehicles along said guideway between said stop positions therealong, characterized in that for increased efficiency of use of said carrier vehicles, each of said carrier vehicles is adapted to carry bodies of various types including bodies in the form of platforms on which single automobiles can be secured, and characterized in the provision of transfer means for moving said bodies between transfer positions in proximity to certain of said stop positions and holding positions that are located alongside said guideway at a substantial distance from said transfer positions, connection means operable in connect conditions thereof to securely interconnect bodies and carrier vehicles positioned at said transfer positions and operable in disconnect conditions thereof to allow said transfer means to move said bodies between said transfer positions and said holding positions, and control means for controlling said drive means to effect automated movement of each of said carrier vehicles from any one of said stop positions to another of said stop positions, whereby bodies for which there may be no present demand may be transferred at one of said stop positions and away from one of said carrier vehicles which may then be moved to another of said stop positions to be loaded with another of said bodies for which there may be a present demand.

44. A transportation system as defined in claim 43, means associated with said connection means for effecting electrical connections between electrical circuit means in said bodies and electrical circuit means in said carrier vehicles.

45. A transportation system as defined in claim 43, said connection means including connectors on said bodies, support pad means on said carrier vehicles, and releasable locking means for effecting a secure locking interengagement between said connectors and said support pad means to securely connect any said one of said bodies and one of said carrier vehicles, and said transfer means including support elements movable horizontally between first positions in supporting relation to said connectors and second positions clear of said supporting relation to said connectors, and said releasable locking means including locking elements operable to released positions when said support elements of said transfer means are moved to said first positions and operable to locked positions when said support elements of said transfer means are moved to said second positions.

46. A transportation system as defined in claim 45, first electrical contact means carried by said support pad means, second electrical contact means carried by said connectors, and third electrical contact means carried by said locking elements for connecting said first and second electrical contact means when said locking elements are moved to said locked positions thereof.

47. A transportation system as defined in claim 43, wherein one of said bodies includes data entry and storage means, signal processor means in one of said carrier vehicles, and signal transmitting means operative when said connection means is operative between said one of said carrier vehicles and said one of said bodies for transmitting signals between said signal processor means and said data entry and storage means.

48. A transportation system, comprising: a plurality of carrier vehicles each including a main frame, front and rear wheel means each including a pair of left and right wheels having a horizontal axis of rotation, front and rear support means for supporting said frame means from said front and rear wheel means, means for supporting a load on said frame means, a guideway for supporting and guiding said carrier vehicles for movement therealong in paths that have straight and curved portions and that have stop positions therealong, said guideway including left and right tracks for engagement by said left and right wheels of said front and rear wheel means, and drive means carried by said carrier vehicles for effecting movement of said carrier vehicles along said guideway from one of said stop positions to another of said stop positions, characterized in that at least one of said front and rear support means include at least one bogie frame that is pivotal relative to said main frame about a vertical steering axis that is in proximity to a vertical plane through said horizontal axis of rotation of said left and right wheels carried thereby, and turn control means cooperating with said guideway to control rotation of said pivotal bogie frame about said vertical steering axis thereof and operating to maintain said horizontal axes of rotation of wheels of both said front and rear wheel means in parallel relation while moving along straight portions of said paths and in intersecting relation at a common vertical turn axis while moving along curved portions of said paths.

49. A transportation system as defined in claim 48, said guideway including left and right guide means extending along left and right sides thereof, and said turn control means including left and right turn control portions carried by said frame at positions spaced from said vertical turn axis for cooperative engagement with said guide means to control the angular position of said bogie frame about said vertical turn axis.

50. A transportation system as defined in claim 49, said left and right turn control portions being pivotal about left and right vertical axes, and said turn control means including cam and cam follower means acting between said turn control portions and said main frame to control rotation of said bogie frame about said vertical turn axis and to maintain said horizontal axes of said front and rear pairs of wheels in parallel relation while moving along said straight portions of said paths and in intersecting relation at a common vertical turn axis while moving along curved portions of said paths.

51. A transportation system as defined in claim 49, said guideway including a Y junction having an entrance and left and right exits, said left and right guide means being left and right ribs projecting from the outer sides of said tracks, said turn control means having a first condition of operation in which said left portion engages said left guide means to control movement to said left exit and a second condition of operation in which said right portion engages said right guide means to control movement to said right exit, and said turn control means further including a left position control wheel movable in said first condition of operation to an active position opposite said left wheel on said bogie frame and on the outside of said left rib and a right position control wheel movable in said second condition of operation to an active position opposite said right wheel on said bogie frame and on the outside of said right rib.

52. A transportation system as defined in claim 48, said drive means including electric motor means carried by said bogie frame, and differential gearing means coupling said electric motor means to said left and right wheels carried by said bogie frame.

53. A transportation system as defined in claim 48, wherein said front and rear support means are such as to provide both front and rear pivotal bogie frames and associated front and rear turn control means, each of said front and rear wheel means including both a pair of lower wheels and a pair of upper wheels, said guideway including both left and right lower tracks for engagement by said lower wheels and left and right upper tracks for engagement by said upper wheels, bearing means supported from said front and rear pivotal bogie frames for journaling said lower and upper wheels, and spring means operative between said front and rear bogie frames and said bearing means for urging said upper wheels into pressure engagement with said downwardly facing surfaces of said upper tracks.

54. A transportation system, comprising: a plurality of carrier vehicles, a guideway for guiding said carrier vehicles for movement therealong and having stop positions therealong, and drive means carried by said carrier vehicles for coaction with said guideway for effecting movement of said carrier vehicles along said guideway between said stop positions therealong, characterized in that each of said carrier vehicles is adapted to carry platforms on which single automobiles can be secured, and characterized in the provision of transfer means for moving said bodies between transfer positions in proximity to certain of said stop positions and holding positions that are at substantial distances from said transfer positions, connection means operable in connect conditions thereof to securely interconnect bodies and carrier vehicles positioned at said transfer positions and operable in disconnect conditions thereof to allow said transfer means to move said bodies between said transfer positions and said holding positions, means carried by said transfer means for operating said connection means between said connect and disconnect conditions, and control means for controlling said drive means to effect automated movement of each of said carrier vehicles from any one of said stop positions to another of said stop positions, said transfer positions including platform transfer positions at which platforms loaded with automobiles may be interconnected with and disconnected from carrier vehicles positioned thereat, said holding positions including automobile loading/unloading positions which are associated with but at substantial distances from said platform transfer positions, and platform support means at said automobile loading/unloading positions.

55. A transportation system as defined in claim 54, storage means for storing a plurality of said platforms, and platform handling means for transfer of platforms between said storage means and platform support means at said automobile loading/unloading positions.

56. A transportation system as defined in claim 54, said automobile loading/unloading positions including a pair of positions alongside said guideway with a first position of said pair being primarily for loading of an automobile on a platform thereat and with a second position of said pair being primarily for unloading of an automobile from a platform thereat, a pair of receiving and delivery driveway means for driving of automobiles onto and from platforms at said first and second positions, said platform storage means being arranged to store a plurality of said platforms in stacked relation and at a storage position in proximity to said first and second positions.

57. A transportation system as defined in claim 56, said platform handling means comprising lift means for releasable engagement with said platforms, vertical conveyor means for effecting lifting and lowering movements of said lift means, and horizontal conveyor means for moving said vertical conveyor means horizontally between positions over said platform storage position and said first and second positions.

58. A transportation system as defined in claim 54, each of said platforms including support means for supporting automobile wheels, and retaining means operable between lowered inactive positions and elevated active positions in which they are locked in positions such as to limit automobile movement.

59. A transportation system as defined in claim 58, operating elements on said platforms coupled to said retaining means, and position setting means associated with said platform support means and engageable with said operating elements of platforms supported by said platform support means for effecting operation of said retaining means between said inactive and active positions thereof.

60. A transportation system as defined in claim 59, said operating elements being in the form of shafts rotatable about transverse horizontal axes, and said position setting means including coupling means movable inwardly along said axes to couple to ends of said shafts, and electric motor means for rotating said coupling means to control movement of said retaining means between said inactive and active positions.

61. A transportation system as defined in claim 58, said retaining means including end flap means pivotally secured to opposite ends of said platforms for movement from lowered inactive positions and elevated active positions in which they limit automobile movement and in which they also provide downwardly facing surfaces that extend angularly upwardly to act as aerodynamic fairings to reduce aerodynamic drag during high speed transport of said platforms, and operating means for said end flap means.

62. A transportation system as defined in claim 58, said retaining means including wheel chock means, and operating means for effecting movement of said wheel chock means upwardly from lowered inactive positions and then rearwardly and forwardly to active positions in engagement with front and rear sides of automobile tires.

63. A transportation system as defined in claim 62, said operating means including rack means connected to said wheel chock means to effect said movements thereof, and a pair of pinion means meshed with said rack means and rotatable about horizontal axes, and operating elements coupled to said pinions.

64. A transportation system as defined in claim 58, cage means on said platforms operable between lowered inactive folded positions and active positions in which they extend upwardly along the sides of automobiles on said platforms.

65. A transportation system as defined in claim 54, driveway means for driving of automobiles onto platforms at said automobile loading positions, stop means, and stop support means for supporting said stop means at certain positions for engagement by front bumpers of automobiles driven from said driveway means and onto platforms at said loading positions to stop said automobiles in approximate centered positions on said platforms.

66. A transportation system as defined in claim 65, said stop support means including energy absorbing means for absorption of kinetic energy of impact of said stop means by a moving automobile.

67. A transportation system as defined in claim 65, said stop support means being operable after stopping of automobiles to move said stop means away from said front bumpers and to allow said transfer means to transfer said automobile platforms to said platform receiving positions.

68. A transportation system as defined in claim 65, said stop support means being operative for controlling the position of said stop means in accordance with dimensions of an automobile to be driven onto said platform.

69. A transportation system, comprising: a plurality of carrier vehicles having wheel means thereon, a guideway including track means for engagement by said wheel means to support said carrier vehicles for movement along said guideway in a predetermined path and being formed in sections each section having a frame structure comprising left and right side walls of sheet material extending for the length of said section, left and right lower longitudinally extending frame members separate from said side walls, left and right upper longitudinally extending frame members separate from said side walls, a plurality of assemblies in longitudinally spaced relation each assembly including left and right vertical members of sheet material in longitudinally spaced vertical planes and a cross member of sheet material having opposite ends secured to lower portions of said vertical members, means securing lower ends of each assembly to said left and right lower frame members at predetermined points of connection therealong, means securing upper ends of said left and right vertical members to said left and right upper frame members at predetermined points of connection therealong, and means securing outside portions said vertical members to said left and right side walls at predetermined points of connection therealong, and track support means for supporting said track means along inside portions of said vertical members, said vertical members being of uniform shape and dimensions and said track support means having uniform positions relative to said vertical members, said predetermined points of connection being such as to obtain predetermined axes and radii of curvature of said track in vertical and horizontal directions.

70. A transportation system as defined in claim 69, said track support means including intermediate support means supported by said frame structure for underlying said tracks, resilient means along said intermediate support means for supporting said tracks therefrom, said intermediate support means and said resilient means cooperating with said tracks to provide an optimum path of movement of carrier vehicles so long as the ends of each section are accurately supported in certain positions, adjustable support means for supporting said guideway sections, each of said adjustable support means being arranged for support of one end of said frame structure of one of said guideway sections and one end of said frame structure of an adjacent one of said guideway sections from a support column which is supported from underlying earth and being adjustable to compensate for movements away from said certain positions due to instabilities in the underlying earth.

71. A transportation system as defined in claim 70, said adjustable support means including first and second operating means for independently adjusting the vertical positions of opposite sides of supported ends of said adjacent guideway sections, and a third operating means for simultaneously adjusting the horizontal positions said opposite sides of said supported ends.

72. A transportation system as defined in claim 70, said resilient means having a resiliency that varies along each guideway section to have a greater resiliency at the ends of each section than at the center of each section and to compensate for deflections of said frame and said intermediate support means due to the weight of a passing carrier vehicle and any load thereon.

73. A transportation system as defined in claim 69, each of said tracks being formed of interleaved strips in a laminated construction that provides a substantially continuous and smooth support for said wheel means while allowing for thermal contractions and expansions of said strips.

74. A transportation system, comprising: a plurality of carrier vehicles, a guideway for guiding said carrier vehicles for movement therealong, drive means for moving said carrier vehicles along said guideway between stop positions therealong, characterized in the provision of wireless signal transmission means including stationary elements supported within said guideway and movable elements supported by said carrier vehicles and inductively coupled to said stationary elements during movement of said carrier vehicles within said guideway, monitoring and control means along said guideway for applying control signals to said stationary elements, and control circuit means on said carrier vehicles coupled to said movable elements for receiving said control signals and for controlling said drive means to effect automated movement of each of said carrier vehicles from one of said stop positions to another of said stop positions, said stationary elements and said monitoring and control means connected thereto being assigned to contiguous portions of said guideway along the length thereof, said vehicle control signals including speed command signals that operate through said control circuit means for drive of said carrier vehicles at speeds commanded by said speed command signals, the lengths of said assigned portions along said guideway being substantially less than a safe following distance of a vehicle behind a vehicle that is moving at a maximum speed along said guideway, and message developing means for supplying a message to each of said monitoring and control means which includes speed and location data as to any vehicle ahead that has a speed of movement such as to require any deceleration of a vehicle passing said monitoring and control means, said speed and location data including the speed of the vehicle ahead and the assigned portion of the guideway ahead in which it is moving, and each of said monitoring and control means including processor means operative to control said speed command signal as a function of said speed and location data as to any vehicle ahead.

75. A transportation system as defined in claim 74, said message developing means comprising data transmission means included in each of said monitoring and control means for transmitting data corresponding to said detected vehicle speed data, and detected vehicle data receiving means included in each of said monitoring and control means for receiving data corresponding to data transmitted from data transmission means of a monitoring and control means assigned to a portion of said guideway ahead of said assigned portion.

76. A transportation system as defined in claim 75, said data transmitted by said data transmission means of each monitoring and control means including a retransmission of any data transmitted from a monitoring and control means that is assigned to a portion of said guideway ahead of said assigned portion, each said retransmission of data including data identifying the monitoring and control means forming the original source of retransmitted detected speed data to thereby provide said speed and location data.

77. A transportation system as defined in claim 74, each of said monitoring and control means including passing vehicle detection means for detecting the passing of carrier vehicles past said assigned portion of said guideway, detected vehicle speed signal means for developing detected vehicle speed data corresponding to the speed of said passing carrier vehicles, detected vehicle data transmission means for transmitting data corresponding to said detected vehicle speed signal, and detected vehicle data receiving means for receiving data corresponding to data transmitted from detected vehicle data transmission means of a monitoring and control means assigned to a portion of said guideway ahead of said assigned portion for control of a command speed signal to be transmitted to said assigned portion and to control speed of passing carrier vehicles to maintain a safe distance between carrier vehicles.

78. A transportation system as defined in claim 77, said detected vehicle data transmission means being operative to transmit said data to a first monitoring and control means assigned to a portion of said guideway immediately behind said assigned portion and to receive said detected vehicle data transmitted from a second monitoring and control means assigned to a portion of said guideway immediately ahead of said assigned portion, being also operative to retransmit data received from said second monitoring and control means to said first monitoring and control means, each said transmission of data including data identifying the initial source thereof, and each monitoring and control means including processing means for processing received data and generating a speed command signal for control of passing carrier vehicles to maintain a safe distance between carrier vehicles.

79. A transportation system as defined in claim 74, said guideway including a main line guideway and a branch line guideway merging with said main line guideway in a certain region, said monitoring and control means including main line monitoring and control means and branch line monitoring and control means, merge control means coupled to said main line and branch line monitoring and control means for monitoring detected vehicle data and for controlling speeds of carrier vehicles moving on said branch line guideway to safely enter traffic on said main line guideway, said merge control means being operative to apply signals to said main line monitoring and control means to simulate a carrier vehicle so moving along said main line guideway as to reach said merge region at the same time as a carrier vehicle moving on said branch line guideway, and said merge control means further including means for supplying signals to monitoring and control means along said branch line guideway to cause movement of a vehicle thereon at a safe following distance behind any vehicle that may be ahead of said simulated carrier vehicle.

80. A transportation system as defined in claim 74, means including said stationary elements for providing transmission lines that extend along said contiguous assigned portions of said guideway and that are terminated by impedances having values approximately equal to characteristic impedances thereof.

* * * * *